US011566409B2

(12) United States Patent
Sun

(10) Patent No.: US 11,566,409 B2
(45) Date of Patent: Jan. 31, 2023

(54) WATER SUPPLY MECHANISM FOR A BOWL RIM AND A WATER INLET MECHANISM

(71) Applicant: Kohler (China) Investment Co., Ltd., Shanghai (CN)

(72) Inventor: Junfeng Sun, Shanghai (CN)

(73) Assignee: Kohler (China) Investment Co., Ltd., Shanghai (CN)

( * ) Notice: Subject to any disclaimer, the term of this patent is extended or adjusted under 35 U.S.C. 154(b) by 0 days.

(21) Appl. No.: 17/245,648

(22) Filed: Apr. 30, 2021

(65) Prior Publication Data

US 2021/0348374 A1 Nov. 11, 2021

(30) Foreign Application Priority Data

May 6, 2020 (CN) ..... 202010374427.3
May 6, 2020 (CN) ..... 202010374768.0
May 6, 2020 (CN) ..... 202020727104.3
May 6, 2020 (CN) ..... 202020727105.8
May 6, 2020 (CN) ..... 202020727396.0
(Continued)

(51) Int. Cl.
*E03D 1/34* (2006.01)
*E03D 1/32* (2006.01)

(52) U.S. Cl.
CPC ..... *E03D 1/34* (2013.01); *E03D 1/32* (2013.01)

(58) Field of Classification Search
CPC ..... E03D 1/34
USPC ..... 4/434, 420, 466, 471
See application file for complete search history.

(56) References Cited

U.S. PATENT DOCUMENTS 6,321,392 B1 11/2001 Sim
2005/0120715 A1* 6/2005 Labrador ..... F03G 7/00 60/618
2007/0039087 A1 2/2007 Bringmann
2014/0289950 A1 10/2014 Kitaura et al.

FOREIGN PATENT DOCUMENTS

CN 1688776 A 10/2005
CN 1811080 A 8/2006
CN 203808183 U 9/2014
(Continued)

OTHER PUBLICATIONS

Chinese Office Action form Chinese Patent Application No. 202010374427.3, dated Nov. 20, 2022, 20 pages. (including English summary).

(Continued)

*Primary Examiner* — Lori L Baker
(74) *Attorney, Agent, or Firm* — Lempia Summerfield Katz LLC

(57) ABSTRACT

A water supply mechanism for the bowl rim of the toilet is configured to supply water to a bowl of a toilet body of the toilet for flushing, including: an inlet valve assembly communicated with a water source; a water-feeding power unit including a water inlet connected with the inlet valve assembly and a water outlet communicated with the water inlet of the water-feeding power unit; and an outlet pipe connected with the water outlet of the water-feeding power unit and communicated with a water channel at the bowl rim of the toilet body. Compared with the prior art, the toilet body is flushed under sufficient water pressure, so that the toilet body can be made cleaner.

20 Claims, 23 Drawing Sheets

(30) Foreign Application Priority Data

May 6, 2020 (CN) ..... 202020727853.6
May 6, 2020 (CN) ..... 202020727854.0

(56) References Cited

FOREIGN PATENT DOCUMENTS

| | | | |
|---|---|---|---|
| CN | 104358296 | A | 2/2015 |
| CN | 205116339 | U | 3/2016 |
| CN | 206189536 | U | 5/2017 |
| CN | 206873578 | U | 1/2018 |
| CN | 108797733 | A | 11/2018 |
| CN | 108824583 | A | 11/2018 |
| CN | 208183894 | U | 12/2018 |
| CN | 109281362 | A | 1/2019 |
| CN | 109518775 | A | 3/2019 |
| CN | 109723115 | A | 5/2019 |
| CN | 208815641 | U | 5/2019 |
| CN | 209975657 | U | 1/2020 |
| CN | 210032018 | U | 2/2020 |
| JP | H09209433 | A | 8/1997 |
| JP | 2000328626 | A | 11/2000 |

OTHER PUBLICATIONS

Chinese Office Action form Chinese Patent Application No. 202010374768.0, dated Sep. 21, 2022, 8 pages. (including English summary).

* cited by examiner

WATER SUPPLY MECHANISM FOR A BOWL RIM AND A WATER INLET MECHANISM

CROSS REFERENCE TO RELATED APPLICATION

This application claims the benefit of priority to: Chinese Patent Application No. 202020727854.0 filed in the Chinese Intellectual Property Office on May 6, 2020, the contents of which are hereby incorporated by reference in its entirety; Chinese Patent Application No. 202010374427.3 filed in the Chinese Intellectual Property Office on May 6, 2020, the contents of which are hereby incorporated by reference in its entirety; Chinese Patent Application No. 202020727104.3 filed in the Chinese Intellectual Property Office on May 6, 2020, the contents of which are hereby incorporated by reference in its entirety; Chinese Patent Application No. 202020727396.0 filed in the Chinese Intellectual Property Office on May 6, 2020, the contents of which are hereby incorporated by reference in its entirety; Chinese Patent Application No. 202020727853.6 filed in the Chinese Intellectual Property Office on May 6, 2020, the contents of which are hereby incorporated by reference in its entirety; Chinese Patent Application No. 202020727105.8 filed in the Chinese Intellectual Property Office on May 6, 2020, the contents of which are hereby incorporated by reference in its entirety; and Chinese Patent Application No. 202010374768.0 filed in the Chinese Intellectual Property Office on May 6, 2020, the contents of which are hereby incorporated by reference in its entirety.

FIELD

The present disclosure relates to a sanitary apparatus and method. More specifically, the present disclosure relates to a toilet and a water supply mechanism for a bowl rim thereof. The present disclosure also relates to a toilet and a water inlet mechanism thereof. The present disclosure also relates to a toilet and a water supply mechanism thereof. The present disclosure also relates to a toilet and a jet structure thereof. The present disclosure also relates to a water supply mechanism for a jet hole thereof. The present disclosure also relates to a toilet and a medicament dispensing mechanism thereof. The present disclosure also relates to a toilet and a method for flushing the same.

BACKGROUND

The toilet is an indispensable sanitary device in people's daily life, the basic principle of which is to convert potential energy of water into kinetic energy by use of gravity of the water, so as to carry excrements and discharge the same into a drain. In some toilets, pipelines are used to connect the toilet to the household water supply line, so that water can be provided to the bowl of a toilet body for flushing the toilet body. In the condition that the pressure of the household water supply line in a building is very low, it is impossible to provide sufficient flow to the bowl for flushing, thus the toilet body cannot be made clean.

SUMMARY

The present disclosure aims at providing a toilet and a water supply mechanism for a bowl rim thereof, so that a toilet body is flushed under sufficient water pressure, such that the toilet body can be made cleaner.

In order to solve the foregoing technical problems, the present disclosure provides a water supply mechanism for a bowl rim of a toilet, configured to supply water to a bowl of a toilet body of the toilet for flushing, including: an inlet valve assembly communicated with a water source; a water-feeding power unit including a water inlet connected with the inlet valve assembly and a water outlet communicated with the water inlet of the water-feeding power unit; and an outlet pipe connected with the water outlet of the water-feeding power unit and communicated with a water channel at the bowl rim of the toilet body.

The present disclosure further provides a toilet, including: the water supply mechanism for the bowl rim as described above.

Compared with the prior art, in the present disclosure, the inlet valve assembly, the water-feeding power unit and the outlet pipe are provided, the inlet valve assembly is communicated with the water source, and the water inlet of the water-feeding power unit is communicated with the inlet valve assembly, when the inlet valve assembly is opened, water from the water source, passing through the inlet valve assembly, is pushed by the water-feeding power unit, the pressure of the water flow increases and the water flow flows out from the water outlet of the water-feeding power unit. The water outlet of the water-feeding power unit is further connected with the outlet pipe, the outlet pipe is communicated with the water channel at the bowl rim of the toilet body, and the water flow flowing out of the water outlet of the water-feeding power unit passes the outlet pipe and enters the bowl rim of the toilet body, so that the bowl of the toilet body is flushed by the water flow with increased water pressure and thus the toilet body can be made cleaner.

Moreover, the inlet valve assembly includes: a valve body, wherein the valve body includes a water inlet end communicated with the water source and a water outlet end communicated with the water inlet end of the valve body; and a connecting portion connecting the water outlet end of the valve body and the water inlet of the water-feeding power unit, which is configured to butt the inlet valve assembly with the water-feeding power unit.

Moreover, the toilet includes: a water tank communicated with the water source and configured to store flushing water; and the water supply mechanism for the bowl rim further includes: a suction pipe connected with the connecting portion and at least partially extending into the water tank; the suction pipe being configured to suck water flow in the water tank when the water-feeding power unit is opened. Therefore, the water-feeding power unit can provide suction to the water flow in the water tank while increasing water pressure of the water flow entered from the inlet valve assembly, so that the water flow in the water tank enters the outlet pipe from the suction pipe, thereby increasing the water flow for flushing the toilet body, increasing pressure and impact force of the water flow, and further making the toilet body to more clean.

Moreover, the water supply mechanism for the bowl rim further includes: a one-way valve arranged on the suction pipe and configured to prevent the water flow from entering the water tank via the suction pipe. Due to the arrangement of the one-way valve, the water flow passing through the inlet valve assembly does not enter the water tank via the suction pipe, but directly flows into the water-feeding power unit, so that a normal flow direction of the water flow is maintained.

Moreover, the water supply mechanism for the bowl rim further includes: a flow limiter arranged at the water inlet end of the valve body, which avoids that positive pressure is formed at the water inlet of the water-feeding power unit, and thereby prevents the water in the inlet valve assembly from flowing backwards into the water tank.

Moreover, the suction pipe includes: a suction port extending into the water tank for sucking water. The diameter of the suction port of the suction pipe is smaller than the inner diameter of the suction pipe. Therefore, negative pressure is formed within the suction pipe, which further provides a power source for the water flow.

Moreover, the water supply mechanism for the bowl rim further includes: a main control module electrically connected with the water-feeding power unit and the inlet valve assembly, and configured to control the water-feeding power unit and the inlet valve assembly to be opened or closed. When a flush is needed, the main control module can directly control the water-feeding power unit and the inlet valve assembly to be opened, so that the operation is automated.

Moreover, the water supply mechanism for the bowl rim further includes: a power module electrically connected with the main control module and configured to supply power to the inlet valve assembly. In case of power failure of an external power supply device, the power module is used as a standby power supply to supply power to the main control module and the inlet valve assembly, so that the inlet valve assembly can be normally opened to flush the toilet body if desired.

The present disclosure also aims at providing a toilet and a water inlet mechanism thereof, so that the water inlet mechanism is more integrated, the whole size of the toilet is decreased, and the cost of the toilet is reduced.

In order to solve the foregoing technical problems, the present disclosure provides a water inlet mechanism of a toilet, including:

a vacuum breaker, including: an inner cavity pipe provided with an upstream chamber, an outer cavity pipe arranged around the inner cavity pipe, and a chamber valve for allowing or blocking communication between the inner cavity pipe and the outer cavity pipe, the inner cavity pipe and the outer cavity pipe being separated from each other to form a downstream chamber, and the downstream chamber being configured to communicate with the upstream chamber when the chamber valve is opened;

a general water inlet assembly connected with the inner cavity pipe and configured to allow or block communication between the upstream chamber and a water source;

a bowl rim water inlet assembly connected with the outer cavity pipe, configured to allow or block communication between the downstream cavity and a toilet body of the toilet, and further configured to supply the water flow in the downstream cavity to the bowl of the toilet body when being opened;

a tank water inlet assembly connected with the outer cavity pipe, configured to allow or block communication between the downstream cavity and the water tank of the toilet, and further configured to supply the water flow in the downstream cavity to the water tank when being opened; and a jet water inlet assembly connected with the outer cavity pipe, configured to allow or block communication between the downstream cavity and the toilet body of the toilet, and further configured to supply the water flow in the downstream cavity to a jet hole of the toilet body when being opened.

The present disclosure provides a toilet, including the water inlet mechanism as described above.

Comparing the present disclosure to the prior art, the vacuum breaker includes an inner cavity pipe, an outer cavity pipe and an chamber valve, wherein the outer cavity pipe is arranged around the inner cavity pipe, the upstream chamber is arranged in the inner cavity pipe, the inner cavity pipe and the outer cavity pipe are separated from each other to form the downstream chamber, and the general water inlet assembly is connected with the inner cavity pipe to supply water to the inner cavity pipe, and the water flow enters the upstream chamber opens the chamber valve by impact, and enters the downstream chamber. The bowl rim water inlet assembly, the tank water inlet assembly, and the jet water inlet assembly are all connected with the outer cavity pipe, when being opened the bowl rim water inlet assembly supply the water flow in the downstream chamber to the bowl of the toilet body, and thus the bowl of the toilet body can be cleaned. The tank water inlet assembly supplies the water flow in the downstream chamber to the water tank when being opened, and the jet water inlet assembly supplies the water flow in the downstream chamber to the jet hole of the toilet body when being opened, which can flush the bottom of the toilet body to remove dirt and help to smoothly form siphon. Therefore, the general water inlet assembly, the bowl rim water inlet assembly, the tank water inlet assembly and the jet water inlet assembly are connected with one vacuum breaker, water supplying to the toilet is achieved through a more simple and more integrated structure, so that the size of the toilet body can be decreased and the cost is reduced.

Moreover, the inner cavity pipe includes, from bottom to top, a liquid inlet abutting against the general water inlet assembly and a liquid outlet arranged opposite to the liquid inlet, wherein both the liquid inlet of the inner cavity pipe and the liquid outlet of the inner cavity pipe are communicated with the upstream chamber; and the chamber valve is arranged at the liquid outlet of the inner cavity pipe.

Moreover, a bracket for installing the vacuum breaker is arranged in the toilet; and the vacuum breaker includes: an upper valve body partially penetrating through the bracket, wherein the liquid outlet is arranged on the upper valve body; and the upper valve body includes a part of the inner cavity pipe and a part of the outer cavity pipe; a connecting assembly configured to fix the upper valve body on the bracket; a lower valve body and an upper valve body being in butt joint, wherein the liquid inlet is arranged on the lower valve body; and the lower valve body includes another part of the inner cavity pipe and another part of the outer cavity pipe; and a locking assembly configured to fix the upper valve body and the lower valve body to one another, which is convenient for securing and mounting the vacuum breaker.

Moreover, the outer cavity pipe of the upper valve body is provided with an abutting portion abutting against the side of the bracket facing the liquid outlet; and the side of the outer cavity pipe of the upper valve body facing the liquid inlet is provided with an external thread; and the connecting assembly includes a nut engaged with the external thread and configured to fix the upper valve body on the bracket in coordination with the abutting portion, thus securing and mounting the upper valve body.

Moreover, the connecting assembly further includes: a first sealing element sleeved on the outer cavity pipe of the upper valve body and arranged between the abutting portion and the bracket; and a second sealing element sleeved on the outer cavity pipe of the upper valve body and arranged between the nut and the bracket, so that the securing between the upper valve body and the bracket is firmer and tighter.

Moreover, the locking assembly includes: a union nut can be engaged with the external thread and configured to fix the outer cavity pipe of the upper valve body to the outer cavity pipe of the lower valve body, thus securing and mounting the lower valve body and the upper valve body.

Moreover, the outer cavity pipe of the lower valve body includes an insertion portion inserted into the downstream chamber of the upper valve body, and the insertion portion abuts against the inner wall of the outer cavity pipe of the upper valve body; the inner cavity pipe of the lower valve body abuts against the inner cavity pipe of the upper valve body; and the locking assembly further includes: at least one sealing ring sleeved on the insertion portion and abutting against the inner wall of the outer cavity pipe of the upper valve body; and a sealing gasket arranged at the position where the inner cavity pipe of the lower valve body abuts against and the inner cavity pipe of the upper valve body. Therefore, the sealing between the upper valve body and the lower valve body is better, and the water flow will not leak out.

Moreover, the general water inlet assembly includes: a general water inlet valve connected with the liquid inlet.

Moreover, the general water inlet assembly further includes: a filtering module connected with the general water inlet valve and communicated with the water source.

Moreover, a bowl rim opening is arranged on the outer cavity pipe of the upper valve body; and the bowl rim water inlet assembly—includes: a bowl rim pipe leading to the bowl of the toilet body; and a bowl rim valve connected with the bowl rim pipe and the bowl rim opening.

Moreover, a tank opening—is arranged on the outer cavity pipe of the upper valve body; and the tank water inlet assembly includes a tank valve connected with the tank opening so as to supply water to the water tank.

Moreover, a jet opening is arranged on the outer cavity pipe of the lower valve body; and the jet water inlet assembly includes: a jet pipe leading to the jet hole; and a jet valve connected with the jet pipe and the jet opening.

The present disclosure also aims at providing a toilet and a water supply mechanism thereof, so that the pipe structure of the water supply mechanism is simplified, and the cost of the device is reduced.

In order to solve the foregoing technical problems, the present disclosure provides a water supply mechanism of a toilet configured to supply water to a jet hole arranged on a toilet body of the toilet, including:

a water tank configured to store flushing water;

a vacuum breaker arranged in the water tank;

a discharge valve connected with the vacuum breaker; wherein the vacuum breaker is configured to makes the discharge valve communicate with the air; and the discharge valve is configured to discharge water in the water tank after being opened; and is also configured to keep the water in the water tank after being closed;

a discharge pipe connected with the discharge valve, including: a gravity discharge channel and a power discharge channel which are both communicated with the discharge valve, and the gravity discharge channel and the power discharge channel are both configured to supply water flow in the water tank to the jet hole after the discharge valve is opened; and a discharge power unit communicated with the downstream of the discharge valve and connected with the power discharge channel, and configured to pump water flow passing through the discharge valve into the power discharge channel.

The present disclosure further provides a toilet including the water supply mechanism as described above.

Comparing the present disclosure with the prior art, the vacuum breaker is arranged in the water tank, the discharge valve is connected with the vacuum breaker, and the discharge pipe is connected with the discharge valve. After the discharge valve is opened, the water in the water tank enters the discharge pipe. The discharge pipeline includes the gravity discharge channel and the power discharge channel, and the discharge power unit is further communicated with the discharge valve and is connected with the power discharge channel. The discharge power unit pumps the water flow passing through the discharge valve into the power discharge channel, the power discharge channel supplies the water flow to the jet hole, the gravity discharge channel also supplies water flow to the jet hole, and thus water supplying to the jet hole is realized through both the gravity discharge channel and the power discharge channel. Moreover, the power discharge channel and the gravity discharge channel are both communicated with the discharge valve, and thus the power discharge channel and the gravity discharge channel are both communicated with the vacuum breaker, so that the dirty water in the toilet body will not flow back into the water tank through the power discharge channel or the gravity discharge channel. That is to say, the water tank is insulated from the dirty water in the toilet body by one vacuum breaker. Since only one vacuum breaker is employed in the discharge mechanism, cost of device is thus saved. Moreover, in the pipe layout, the power discharge channel is a portion of the discharge pipe, which only needs to be communicated with the discharge valve, and does not need to add a connecting pipe to connect a separate vacuum breaker. Accordingly, the pipe layout is simplified, the space for the overall layout is decreased, the size of toilet can be reduced, thereby the occupied bathroom space, and requirements of customers can be met better.

Moreover, the discharge power unit includes: a suction joint provided with a power suction port communicated with the discharge pipe; and a pump body connected with the suction joint and provided with a power water outlet communicated with the power discharge channel. The pump body is configured to suck a portion of water flow passing through the discharge valve and convey the portion of water flow to the power discharge channel through the power water outlet.

Moreover, the discharge pipe further includes: a water tank discharge channel connected with the discharge valve and communicated with the gravity discharge channel and the power discharge channel; wherein the power suction port is connected into the water tank discharge channel.

Moreover, the water supply mechanism further includes: a locking assembly configured to lock the suction joint on the pipe wall of the water tank discharge channel, so that the discharge power unit is fixed.

Moreover, the outer surface of the suction joint is provided with an external thread; and the pipe wall of the water tank discharge channel is provided with an opening for the suction joint to pass through. The side of the suction joint facing the pump body is provided with a bulge, and the bulge is configured to support the pipe wall of the water tank discharge channel. The locking assembly includes: a nut being able to engage with the external thread and fix the suction joint in the opening in cooperation with the bulge.

Moreover, the locking assembly further includes: a first sealing element sleeved on the external thread and arranged between the pipe wall of the water tank discharge channel and the nut; and a second sealing element arranged between the bulge and the pipe wall of the water tank discharge channel. At this time, the nut is in flexible contact with the pipe wall of the water tank discharge channel, and the bulge is also in flexible contact with the pipe wall of the water tank discharge channel, so that the water flow will not leak from the position between the opening and the suction joint, and thus the suction joint is secured more firmly.

Moreover, the pipe wall of the water tank discharge channel is connected with the wall surface of the water tank.

The present disclosure also aims at providing a toilet and a jet structure thereof, so that the jet structure can be connected with a plurality of water supply ends, and the toilet can be flushed and used stably and normally.

In order to solve the foregoing technical problems, the present disclosure provides a jet structure of a toilet, including: a ceramic wall arranged on a toilet body of the toilet and provided with an opening; a non-ceramic jet body passing through the opening; a connecting assembly configured to fix the non-ceramic jet body on the ceramic wall; a liquid delivery joint including a liquid output portion passing through the non-ceramic jet body and a plurality of liquid input portions communicated with the liquid output portion, wherein each of the liquid input portions is communicated with different water supply ends, and the liquid output portion is configured to spray water to a jet hole on the toilet body; and a locking assembly configured to fix the liquid delivery joint and the non-ceramic jet body together.

The present disclosure further provides a toilet, including the jet structure as described above.

Compared with the prior art, the present disclosure is provided with the ceramic wall, the non-ceramic jet body, the connecting assembly, the liquid delivery joint and the locking assembly, wherein the ceramic wall is arranged on the toilet body, the non-ceramic jet body passes through the opening in the ceramic wall, and the non-ceramic jet body is fixed on the toilet body by the connecting assembly. The liquid delivery joint includes the liquid output portion and the plurality of liquid input portions, and each of the liquid input portions is further communicated with different water supply ends. The jet body is a non-ceramic jet body, and the liquid delivery joint can be fixed in the non-ceramic jet body by the locking assembly, which avoids that the liquid delivery joint cannot be fixedly connected with the ceramic wall. Moreover, the liquid output portion passes through the non-ceramic jet body, and water can be supplied to respective liquid input portions from different water supply ends to ensure that water can be stably flushed out from the liquid output portion under different conditions in order to clean the toilet body, so that the toilet can be stably operated without much limitation. Moreover, the liquid output portion directly discharges water into the toilet body, which also prevents the water flow from leaking out when the water flow passes through the non-ceramic jet body, so that the toilet is more reliable to use.

Moreover, the non-ceramic jet body includes a head facing the jet hole, and a tail arranged opposite to the head. The head of the non-ceramic jet body is provided with an abutting portion abutting against the ceramic wall, and the tail of the non-ceramic jet body is provided with an external thread. The connecting assembly includes a nut engaged with the external thread, which is configured to fix the non-ceramic jet body at the opening in the ceramic wall in coordination with the abutting portion.

Moreover, the locking assembly includes: a joint nut engaged with the external thread of the non-ceramic jet body and configured to fix the non-ceramic jet body and the liquid delivery joint to one another.

Moreover, the locking assembly further includes: at least one joint sealing ring, which is sleeved on the liquid output portion and abuts against the liquid output portion and the inner wall of the non-ceramic jet body, thereby realizing sealedly fixing between the liquid output portion and the non-ceramic jet body.

Moreover, the connecting assembly further includes a first sealing element and/or a second sealing element; and diameters of the first sealing element and the second sealing element are both larger than the diameter of the opening in the ceramic wall. The first sealing element is sleeved on the tail of the non-ceramic jet body, and abuts between the opening in the ceramic wall and the nut. The second sealing element is sleeved on the head of the non-ceramic jet body, and abuts between the opening in the ceramic wall and the abutting portion, thus realizing sealedly fixing of the non-ceramic jet body and the ceramic wall.

Furthermore, the first sealing element includes a sealing ring and/or a spacer, which are/is sleeved on the tail of the non-ceramic jet body.

Moreover, the second sealing element includes at least one group of rubber gaskets;

In another embodiment, the second sealing element includes at least one group of rubber gaskets and plastic sheets.

Further, the water supply end includes two water supply portions; and two liquid input portions are also arranged and are respectively communicated with different water supply portions.

Moreover, a water mixing cavity communicated with the jet hole is formed by the ceramic wall around a wall surface of the toilet body.

The present disclosure aims at providing a toilet and a water supply mechanism for a jet hole thereof, so that the water flow with sufficient water pressure enters the jet hole, and the cost is reduced.

In order to solve the foregoing technical problems, the present disclosure provides a water supply mechanism for a jet hole of a toilet, wherein the toilet includes a toilet body, and a water tank configured to store flushing water, including:

a ceramic wall connected with the toilet body of the toilet, and the toilet body is provided with a jet hole. The ceramic wall is provided surrounding the periphery of the toilet body, and a water mixing cavity is formed in the surrounded region of the toilet body;

a water tank discharge valve connected with the water tank;

a gravity discharge channel connected with the downstream of the water tank discharge valve, connected to the water mixing cavity, so as to discharge the water flow in the water tank to the water mixing cavity by use of gravity of the water flow after the water tank discharge valve is opened;

an acceleration discharge channel connected with the downstream of the water tank discharge valve, connected to the water mixing cavity, so as to discharge the water flow in the water tank to the water mixing cavity after the water tank discharge valve is opened;

a discharge power unit arranged on the acceleration discharge channel and configured to supply power for discharging the water flow in the acceleration discharge channel into the water mixing cavity; and a water source discharge assembly communicated with an external water source and connected to the water mixing cavity to discharge the water flow in the external water source to the water mixing cavity.

The present disclosure further provides a toilet, including: the water supply mechanism for the jet hole as described above.

Comparing the prior art, the ceramic wall, the water tank discharge valve, the gravity discharge channel, the acceleration discharge channel, the discharge power unit and the water source discharge assembly are arranged. The ceramic wall is connected with the periphery of the jet hole of the toilet body to form the water mixing cavity. The water tank discharge valve is connected with the water tank, the water tank discharge valve is opened to allow the water flow in the water tank to enter the gravity discharge channel and the acceleration discharge channel, which are both connected to the water mixing cavity, so that the water in the water tank can enter the water mixing cavity. Moreover, the discharge power unit is arranged on the acceleration discharge channel to accelerate the water flow in the acceleration discharge channel, so that the water in the acceleration discharge channel enter the water mixing cavity with an increased speed. Meanwhile, the water source discharge assembly also supplies water from the external water source into the water mixing cavity to mix with the water flows supplied by the gravity discharge channel and the acceleration discharge channel, so that the water flow in the water mixing cavity rushes out from the jet hole with strong impulse, and thus the toilet can work stably and meet the requirements for flushing. Moreover, because all of the gravity discharge channel, the acceleration discharge channel and the water source discharge assembly supply water to the water mixing cavity, the working water flow required by the jet hole is composed of multiple water flows, and the discharge power unit only need to provide power to the water flow in the acceleration discharge channel, so that is the discharge power unit may have a small output flow, a smaller size, and a low price, which thereby reduces the cost.

Moreover, the ceramic wall is provided with a channel opening, and the channel opening connects the gravity discharge channel to the water mixing cavity, thereby realizing that the water flow in the gravity discharge channel enters the water mixing cavity by use of gravity.

Moreover, the gravity discharge channel is a ceramic channel and integrally formed with the ceramic wall.

Moreover, the water source discharge assembly includes: a water source valve; and a water source discharge channel connected with the water source valve and configured to discharge the water flow to the water mixing cavity after the water source valve is opened.

Moreover, an opening communicated with the water mixing cavity is arranged on the ceramic wall. The water supply mechanism for the jet hole further includes a liquid delivery joint inserted into the opening; and the liquid delivery joint includes a first liquid input end connected with the acceleration discharge channel, a second liquid input end connected with the water source discharge channel, and a liquid output end communicated with a first liquid inlet and a second liquid inlet. The liquid output end is communicated with the water mixing cavity, thereby realizing that water flow in the water source discharge channel and the acceleration discharge channel flows into the water mixing cavity together.

Moreover, the water supply mechanism for the jet hole further includes: a fixing device configured to fix the liquid delivery joint at the opening, thus realizing that the liquid delivery joint is fixed on the ceramic wall, so as to make the water flow flow into the water mixing cavity stably.

Moreover, the fixing device includes: a jet body passing through the opening, wherein the liquid delivery joint passes through the jet body; a connecting assembly configured to fix the jet body on the ceramic wall; and a locking assembly configured to fix the liquid delivery joint and the jet body together.

Moreover, the water supply mechanism for the jet hole further includes: a main control module electrically connected with the water tank discharge valve, the discharge power unit and the water source discharge assembly, and configured to control the water tank discharge valve, the discharge power unit and the water source discharge assembly to be opened or closed; wherein the main control module is further configured to control the discharge power unit and/or the water source discharge assembly to be closed before the water tank discharge valve is closed. Because of the large impulse of the three water flows, siphon can be achieved in the siphon pipe and the dirt can be discharged instantaneously. When no large amount of water is needed after the siphon and dirt discharging being finished, the main control module controls at least one of the discharge power unit and the water source valve to be closed. At this time, only the water flow in the gravity discharge channel enters the water mixing cavity to form a water-seal surface subsequently, and thus water can be saved.

Moreover, the water supply mechanism for the jet hole further includes a power module electrically connected with the main control module and configured to supply power to the water tank discharge valve and the water source discharge assembly. In case of power failure of an external power supply device, the power module is used as a standby power supply to supply power to the main control module, the water tank discharge valve and the water source valve, so that the toilet can be operated normally.

The present disclosure also aims at providing a toilet and a medicament dispensing mechanism thereof, so that the medicament can be saved, and the service life of the medicament can be prolonged, thereby reducing the cost.

In order to solve the foregoing technical problems, the present disclosure provides a medicament dispensing mechanism of a toilet, wherein the toilet includes a water tank, a toilet body, and a water supply mechanism for a bowl rim configured to supply water to the bowl of the toilet body. A suction pipe of the water supply mechanism for the bowl rim extends into the water tank to suck water in the water tank, and the medicament dispensing mechanism includes: a medicament storage box configured to store medicament; a medicament channel communicated with the medicament storage box and connected with the suction pipe; and a channel opening-closing valve arranged in the water tank and configured to make the medicament channel communicate with the medicament storage box when the water level in the water tank is lower than the preset water level.

The present disclosure further provides a toilet, including a water tank, a toilet body, a water supply mechanism for a bowl rim configured to supply water to the bowl of the toilet body, and the medicament dispensing mechanism as described above; wherein a suction pipe of the water supply mechanism for the bowl rim extends into the water tank to suck water in the water tank.

Comparing with the prior art, the present disclosure is provided with the medicament storage box, the medicament channel and the channel opening-closing valve. The medicament channel is communicated with the medicament storage box and is connected with the suction pipe, and the suction pipe sucks the water flow in the water tank and supplies the water flow to the bowl of the toilet body; when the water level in the water tank drops to the preset water level, the channel opening-closing valve opens the medicament channel to make the medicament channel communicate with the medicament storage box, the medicament flows into the medicament channel and enters the suction pipe through the medicament channel, and thus is supplied to the toilet body together with the water flow sucked by the suction pipe from the water tank, so as to flush the toilet body. When the suction pipe just starts to suck the water flow in the water tank, the water level in the water tank is not lower than the preset water level. Now, the channel opening-closing valve does not open the medicament channel, the medicament cannot enter the suction pipe, and the water flushing the toilet body at this time is pure water. As the water in the water tank is sucked away, the water level drops. Only when the water level in the water tank is lower than the preset water level, the medicament enters the suction pipe to disinfect and clean the toilet body. Therefore, it is allowed to use the medicament in the later stage of flushing, instead of the whole process of flushing. Accordingly, the medicament is saved, the service life of the medicament is prolonged, which avoids frequent supplement of the medicament and thus reduces the cost.

Moreover, the medicament channel includes a medicament inlet end communicated with the medicament storage box. The channel opening-closing valve includes: a floating portion arranged in the water tank; a valve cap configured to open or close the medicament inlet end; and a connecting portion connected with the floating portion and the valve cap, extending from the water tank to the medicament storage box, and configured to pull the valve cap away from the medicament inlet end when the floating portion is lower than the preset water level.

Moreover, the connecting portion includes: a first lifting rod coupled to the outer wall of the medicament storage box via a hinge joint, one end of the first lifting rod being connected with the floating portion; wherein the first lifting rod rotates around its hinge joint on the outer wall of the medicament storage box; and a second lifting rod, wherein two ends of the second lifting rod are respectively connected with the other end of the first lifting rod and the valve cap; and the second lifting rod is configured to drive the valve cap to open or close the medicament inlet end when the first lifting rod rotates.

Moreover, the medicament channel includes: a main pipe connected with the suction pipe, wherein the medicament inlet end is arranged on the main pipe; and a limiter pipe connected with the inlet end and configured to be abutted against by the valve cap when the valve cap is pulled to its limiting position by the second lifting rod; and the limiter pipe is provided with a water inlet area communicated with the medicament storage box.

Moreover, the medicament dispensing mechanism further includes: a floating ball, which is movably arranged in the limiter pipe, located at the side of the valve cap facing the medicament inlet end and configured to block the medicament inlet end. Therefore, when the medicament in the medicament storage box is completely discharged, the floating ball falls down to close the medicament inlet end, which avoids external air from being introduced into a waterway of the water supply mechanism for the bowl rim, especially in this embodiment, which thus prevents the air from entering the water pump and ensures a working efficiency of the water pump.

Moreover, a maximum sectional area of the floating ball is larger than the area of the medicament inlet end. Therefore, the floating ball can completely seal the medicament inlet end after falling.

Moreover, the suction pipe includes a suction port extending into the water tank, wherein the diameter of the suction port of the suction pipe is smaller than the inner diameter of the suction pipe; and a damper valve is arranged in the main pipe, which prevents the medicament from leaking into the suction pipe from the medicament inlet end. Meanwhile, when the suction pipe does not suck the water in the water tank, which means there is no need for the medicament to enter the toilet body at this time, even if the water level in the water tank is below the preset water level, and the medicament inlet end is opened, there will be no negative pressure in the suction pipe and the damper valve will not be opened, and thus the medicament will not enter the suction pipe and there is no waste.

Moreover, the medicament storage box is further provided with an isolating element therein, in the isolating element is provided an isolation area configured to place a medicament items, and the isolating element is provided with a plurality of leakage holes communicated with the isolation area. Therefore, the water flow is allowed to enter the isolation area through the leakage holes to dissolve the medicament item, and drifting of medicament item residues is avoided, which help to form a standard material distribution and avoid from affecting other components.

Moreover, a side wall of the medicament storage box is provided with an opening for the water flow in the water tank to enter the medicament storage box; and the medicament storage box is provided with a door plate configured to close the opening.

Moreover, an opening communicated with the water mixing cavity is arranged on the ceramic wall; and the door plate is configured to, when the opening is closed, abut against the periphery of the opening, and is inclined, from top to bottom, towards the inside of the medicament storage box. When the water in the water tank reaches a certain amount, the door plate may be flushed, and the water flow enters the medicament storage box to dissolve the medicament item. When the water in the medicament storage box reaches a certain amount, the door plate is pushed to continue to close the opening. Therefore, water can automatically enter the medicament storage box.

The present disclosure aims at providing a toilet and a method for flushing the same, so that the water pressure is sufficient to make the toilet be normally used, and the flushing of the toilet is cleaner.

In order to solve the foregoing technical problems, the present disclosure provides a toilet, including: a toilet body configured to receive sewage and a water tank configured to store flushing water, wherein the toilet further includes: a main control module, a general water inlet mechanism communicated with a water source, a bowl rim water supply mechanism and a jet hole water supply mechanism, both communicated with the general water inlet mechanism. A jet hole is arranged on the toilet body;

the general water inlet mechanism includes: a vacuum breaker, a general water inlet assembly configured to allow or block communication between the vacuum breaker and the water source, a bowl rim water inlet valve configured to allow or block communication between the vacuum breaker and the bowl rim water supply mechanism, a jet hole water inlet valve configured to allow or block communication between the vacuum breaker and the jet hole water supply mechanism, and a tank water inlet valve configured to allow or block communication between the vacuum breaker and the water tank; and the bowl rim water supply mechanism includes: a bowl rim connecting pipe connected with the bowl rim water inlet valve, a bowl rim water supply power unit communicated with the bowl rim connecting pipe of the bowl margin, a suction pipe connected with the bowl rim water supply power unit and at least partially extending into the water tank, and a bowl rim power outlet pipe communicated with a water outlet of the bowl rim water supply power unit and a channel at the bowl margin of the toilet body;

wherein, the main control module is electrically connected with the general water inlet assembly, the bowl rim water inlet valve, the jet hole water inlet valve, the tank water inlet valve, and the bowl rim water supply power unit; and is configured to control the general water inlet assembly and the bowl rim water inlet valve to open and supply water to the bowl rim of the toilet body; and is further configured to open the bowl rim water supply power unit and suck the water flow in the water tank of the toilet through the suction pipe and to close the bowl rim water inlet valve and the bowl rim water supply power unit, and simultaneously open the jet hole water supply mechanism to discharge water to the jet hole of the toilet body.

The present disclosure further provides a method for flushing a toilet, applicable to the toilet above, specifically including the following acts of: receiving a flushing instruction; opening the general water inlet assembly and the bowl rim water inlet valve to supply water to the bowl margin of the toilet body; opening the bowl rim water supply power unit and pumping the water flow in the water tank of the toilet to supply water to the bowl rim of the toilet body; and closing the bowl rim water inlet valve and the bowl rim water supply power unit, and opening the jet hole water supply mechanism to discharge water to the jet hole of the toilet body.

Comparing the present disclosure with the prior art, the general water inlet mechanism includes the vacuum breaker, the general water inlet assembly, the bowl rim water inlet valve, the jet hole water inlet valve, and the tank water inlet valve, the main control module controls the open of the general water inlet assembly, and then the water of the water source enters the vacuum breaker. The bowl rim water supply mechanism includes the bowl rim connecting pipe, the bowl rim water supply power unit, the suction pipe, and the bowl rim power outlet pipe, the main control module opens the bowl rim water inlet valve, then the water flow enters the bowl rim connecting pipe from the vacuum breaker, and meanwhile, the main control module controls the bowl rim water supply power unit to open to provide power for the water flow entered the bowl rim connecting pipe from the vacuum breaker, then the pressure of the water flow is increased and the water flow enters the bowl rim power outlet pipe. Meanwhile, the bowl rim water supply power unit provides a suction force to the water flow in the water tank to let the suction pipe suck the water in the water tank, and then the water flow in the water tank enters the bowl rim power outlet pipe from the suction pipe. Therefore, the two water flows flow to the bowl margin of the toilet body, so that the water flow for flushing the toilet body increases, the pressure of the water flow also increases, and the impact force of the water flow increases, thus ensuring sufficient water pressure to supply water to the bowl rim of the toilet body. Therefore, the toilet can be flushed with a sufficient water pressure in different situation, and the toilet can be operated normally and be flushed cleanly.

Moreover, the toilet further includes: a ceramic wall surrounding the jet hole and connected with the toilet body, wherein a water mixing cavity is formed in the surrounded region of the toilet body; the jet hole water supply mechanism includes: a gravity discharge channel, an acceleration discharge channel and a water source discharge channel, all communicated with the water mixing cavity, a water tank discharge valve connected with the water tank, and a jet hole discharge power unit arranged on the acceleration discharge channel; the gravity discharge channel and the acceleration discharge channel are configured to discharge a water flow from the water tank to the water mixing cavity after the water tank discharge valve is opened; and the water source discharge channel is configured to discharge the water flow in the vacuum breaker to the water mixing cavity after the jet hole water inlet valve is opened; and the water tank discharge valve and the jet hole discharge power unit are electrically connected with the main control module.

Moreover, the vacuum breaker includes: an inner cavity pipe provided with an upstream chamber, an outer cavity pipe arranged around the inner cavity pipe, and a chamber valve for allowing or blocking communication between the inner cavity pipe and the outer cavity pipe, wherein the inner cavity pipe and the outer cavity pipe are separated from each other to form a downstream chamber, and the downstream chamber is configured to communicate with the upstream chamber when the chamber valve is opened; the general water inlet assembly is connected with the inner cavity pipe and configured to allow or block communication between the upstream chamber and the water source; and the bowl rim water inlet valve and the jet hole water inlet valve are both connected with the outer cavity pipe; the bowl rim water inlet valve is configured to allow or block communication between the downstream chamber and the bowl rim connecting pipe; and the jet hole water inlet valve is configured to allow or block communication between the downstream chamber and the water source discharge channel.

Moreover, the inner cavity pipe includes, from bottom to top, a liquid inlet abutting against the general water inlet assembly and a liquid outlet arranged opposite to the liquid inlet, wherein both the liquid inlet of the inner cavity pipe and the liquid outlet of the inner cavity pipe are communicated with the upstream chamber; and the chamber valve is arranged at the liquid outlet of the inner cavity pipe. A bracket for installing the vacuum breaker is arranged in the toilet.

The vacuum breaker includes: an upper valve body partially penetrating through the bracket, wherein the liquid outlet is arranged on the upper valve body; and the upper valve body includes: a part of the inner cavity pipe and a part of the outer cavity pipe; a general connecting assembly configured to fix the upper valve body on the bracket; a lower valve body and the upper valve body are in butting joint, wherein the liquid inlet is arranged on the lower valve body; and the lower valve body includes: another part of the inner cavity pipe and another part of the outer cavity pipe; and a general locking assembly configured to fix the upper valve body with the lower valve body to one another.

Moreover, the bowl rim water supply mechanism further includes: a one-way valve arranged on the suction pipe and configured to prevent the water flow from entering the water tank via the suction pipe.

Moreover, the water tank discharge valve includes: a water tank vacuum breaker arranged in the water tank; and a valve body connected with the water tank vacuum breaker; wherein the water tank vacuum breaker is configured to make the valve body communicate with the air; the valve body is configured to discharge water in the water tank to the gravity discharge channel and the acceleration discharge channel after being opened; and is further configured to seal the water in the water tank after being closed.

Moreover, the jet hole water supply mechanism further includes: a jet connecting pipe connected with the water tank discharge valve, wherein the jet connecting pipe is communicated with the gravity discharge channel. The discharge power unit includes: a suction joint provided with a power suction port communicated with the jet connecting pipe; and a pump body connected with the suction joint and provided with a power water outlet communicated with the acceleration discharge channel; wherein the pump body is configured to suck a portion of the water flow passing through the water tank discharge valve and convey the portion of water flow to the acceleration discharge channel through the power water outlet.

Moreover, the jet hole water supply mechanism further includes: a jet locking assembly configured to lock the suction joint on the pipe wall of the jet connecting pipe.

Moreover, an opening communicated with the water mixing cavity is arranged on the ceramic wall; and the jet hole water supply mechanism further includes: a liquid delivery joint inserted into the opening; and the liquid delivery joint includes: a first liquid input end connected with the acceleration discharge channel, a second liquid input end connected with the water source discharge channel, and a liquid output end communicated with a first liquid inlet and a second liquid inlet, wherein the liquid output end is communicated with the water mixing cavity.

Moreover, the jet hole water supply mechanism further includes: a fixing device configured to fix the liquid delivery joint at the opening.

Moreover, the fixing device includes: a jet body penetrating through the opening, wherein the liquid delivery joint penetrates through the jet body; a jet connecting assembly configured to fix the jet body on the ceramic wall; and a joint locking assembly configured to fix the liquid delivery joint with the jet body.

Moreover, the ceramic wall is further provided with a channel opening, and the channel opening connects the gravity discharge channel to the water mixing cavity.

Moreover, the jet body is a non-ceramic jet body.

Moreover, the toilet further includes a medicament dispensing mechanism, wherein the medicament dispensing mechanism includes: a medicament storage box configured to store medicament items; a medicament channel communicated with the medicament storage box and connected with the suction pipe; and a channel opening-closing valve arranged in the water tank and configured to make the medicament channel communicate with the medicament storage box when a water level in the water tank is lower than a preset water level.

Moreover, the medicament channel includes a medicament inlet end communicated with the medicament storage box. The channel opening-closing valve includes: a floating portion arranged in the water tank; a valve cap configured to open or close the medicament inlet end; and a connecting portion connected with the floating portion and the valve cap and extending from the water tank to the medicament storage box; and configured to pull the valve cap away from the medicament inlet end when the floating portion is lower than the preset water level.

Moreover, the connecting portion includes: a first lifting rod coupled to the outer wall of the medicament storage box, and one end of the first lifting rod being connected with the floating portion; wherein the first lifting rod rotates around its hinge joint on the outer wall of the medicament storage box; and a second lifting rod, wherein two ends of the second lifting rod are respectively connected with the other end of the first lifting rod and the valve cap; and the second lifting rod is configured to drive the valve cap to open or close the medicament inlet end when the first lifting rod rotates.

Moreover, the medicament channel includes: a main pipe connected with the suction pipe, wherein the medicament inlet end is arranged on the main pipe; and a limiter pipe connected with the medicament inlet end and configured to be abutted against by the valve cap when the valve cap is pulled to its limiting position by the second lifting rod; and the limiter pipe is provided with a water inlet area communicated with the medicament storage box.

Moreover, the medicament dispensing mechanism further includes: a floating ball, which is movably arranged in the limiter pipe, located at the side of the valve cap facing the medicament inlet end and configured to block the medicament inlet end.

Moreover, the suction pipe includes a suction port extending into the water tank, wherein the diameter of the suction port of the suction pipe is smaller than the inner diameter of the suction pipe; and a damper valve is arranged in the main pipe.

Moreover, the medicament storage box is further provided an isolating element therein, in the isolating element is provided an isolation area configured to place medicament items, and the isolating element is provided with a plurality of leakage holes communicated with the isolation area.

Moreover, a side wall of the medicament storage box is provided with an opening for the water flow in the water tank to enter the medicament storage box; and the medicament storage box is provided with a door plate configured to close the opening.

Moreover, the act of opening the jet hole water supply mechanism specifically includes:

opening the water tank discharge valve, the jet hole discharge power unit and the jet hole water inlet valve. Moreover, following the act of discharging water to the jet hole of the toilet body, the method further includes the following acts of:

after the water tank discharge valve is opened for a preset length of time, closing the jet hole discharge power unit and the jet hole water inlet valve;

after the jet hole discharge power unit and the jet hole water inlet valve are closed, closing the water tank discharge valve and opening the bowl rim water inlet valve and the bowl rim water supply power unit, and sucking the water flow in the water tank to continuously supply water to the bowl margin of the toilet body; and when a water level in the water tank is lower than a preset water level, opening the medicament channel of the medicament dispensing mechanism to communicate with the medicament storage box to dispense medicament to the suction pipe of the bowl rim water supply mechanism. Moreover, following the act of dispensing medicament to the suction pipe of the bowl rim water supply mechanism, the method further includes the following acts of: closing the medicament inlet end of the medicament channel; closing the bowl rim water inlet valve and the bowl rim water supply power unit; and opening the tank water inlet valve, and closing the tank water inlet valve and the general water inlet assembly after the water level in the water tank reaches the upper limit.

BRIEF DESCRIPTION OF THE FIGURES

One or more embodiments are illustrated with reference to the figures in the corresponding accompanying drawings, which should not be construed as limiting to the embodiments. Elements indicated by similar reference numbers in the accompanying drawings are similar elements. Unless otherwise stated, the figures in the accompanying drawings should not be construed as limiting to the scale.

Figure 1:
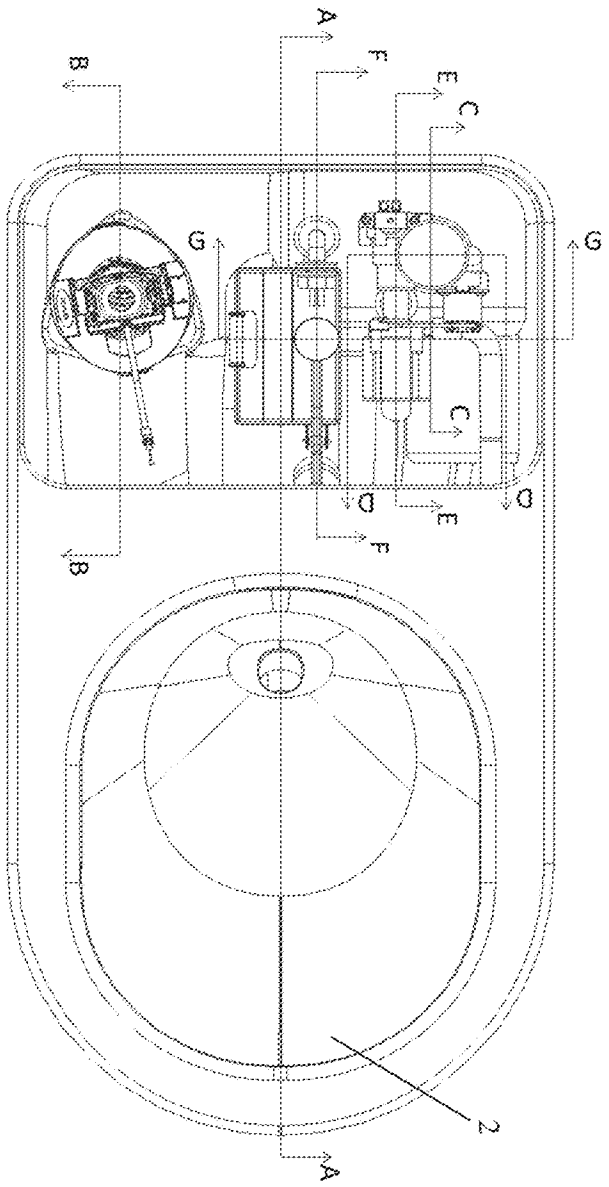
FIG. 1 is a top view of the toilet according to the present disclosure.

List of the reference signs used in the figures related to the first example according to the present disclosure:

REFERENCE NUMERALS

100—main control module; 200 —power module; 1—water tank; 2—toilet body; 20—jet hole; 21—ceramic wall; 211—channel opening; 22—water mixing cavity; 23—bracket; 24—bowl; 3—general water inlet mechanism/inlet valve assembly; 31—vacuum breaker; 311—upstream chamber; 3110—liquid inlet; 312—inner cavity pipe; 313—outer cavity pipe; 3130—abutting portion; 3131—insertion portion; 3132 —insertion portion; 314—chamber valve; 3141—ventilation cavity; 315—downstream chamber/downstream cavity; 3150—liquid outlet; 316—external thread; 317—nut; 318—union nut; 3191—first sealing element; 3192—second sealing element; 3193—sealing ring; 3194—sealing gasket; 3195—sealing element; 32—bowl rim water inlet valve/valve body/bowl rim valve; 320—bowl rim water inlet assembly; 321—water outlet end/water outlet of bowl rim valve; 322—bowl rim opening; 323—upper valve body; 324—lower valve body; 33—jet hole water inlet valve/jet valve; 330—jet water inlet assembly; 331—jet pipe; 332—water outlet of jet valve; 34—tank water inlet valve/valve of water tank; 341—water outlet of valve of water tank; 35—general water inlet assembly; 351—general water inlet valve; 352—filtering module; 41—bowl rim connecting pipe/connecting pipe; 42—bowl rim water supply power unit/water-feeding power unit/water pump; 421—water inlet; 422—water outlet; 43—suction pipe; 430—suction port; 44—bowl rim power outlet pipe/outlet pipe; 45—one-way valve; 5—jet hole water supply mechanism; 51—gravity discharge channel; 510—power suction port; 511—first sealing element; 512—second sealing element; 513—sealing ring; 514—spacer; 515—rubber gasket; 516—plastic sheet; 517—opening; 52—acceleration discharge channel/power discharge channel; 53—water source discharge channel; 54—water tank discharge valve; 541—water tank vacuum breaker/vacuum breaker; 542—valve body/discharge valve/water tank discharge valve; 55—jet hole discharge power unit/discharge power unit; 551—suction joint; 5510—bulge; 552—pump body; 561—external thread; 562—nut; 57—liquid delivery joint; 571—first liquid input end/liquid input portion; 572—second liquid input end/liquid input portion; 573—liquid output end/liquid output portion; 581—jet body/non-ceramic jet body; 5810—abutting portion; 5811—external thread; 5812—head; 5813—tail; 5821—nut; 5822—joint nut; 5823—joint sealing ring; 59—jet connecting pipe; 59'—water tank discharge channel; 591—pipe wall; 6—medicament dispensing mechanism; 61—medicament storage box; 62—medicament channel; 620—medicament inlet end; 621—main pipe; 622—limiter pipe; 631—floating portion; 632—valve cap; 633—connecting portion; 6331—first lifting rod; 6332—second lifting rod; 64—isolating element; 640—leakage hole; 65—isolation area; 67—floating ball; 68—damper valve; 681—spring element/spring member; 69—door plate; 691—side baffle; 692—supporting plate; A—water flow in gravity discharge channel; B—water flow in acceleration discharge channel; and C—water flow in water source discharge channel.

DETAILED DESCRIPTION

Toilets may have some technical problems. The toilet generally includes a water tank and a toilet body. After water from the water tank rushes into the toilet body, the water carries excrements in the toilet body and enters the drain. A water inlet valve of a toilet is located inside the water tank of the toilet, with an inlet of the valve body being located at the bottom of the water tank and a vacuum breaker being located at the top of the valve body. Water flows into the valve body through a central cavity and flows into the water tank from the central cavity. Such a vacuum-breaking structure of the water inlet valve has been widely accepted but cannot be used in a toilet that is flushed both by use of gravity of water from water tank and by use of energy from a household water supply line. For a valve body that uses pressure of the household water supply line for flushing, the water inlet of the valve body is directly connected with a water source, each water outlet is connected with one vacuum breaker respectively, and thus a plurality of vacuum breakers are required. In addition, when flushing the bottom of the toilet by use of energy from the household water supply line, water needs to pass through a lower valve body, and the pipe has to pass through the overflow plane of the toilet to be connected with the vacuum breaker at a higher position and then pass through the overflow plane of the toilet downwards to be connected with a jet hole of the toilet body, resulting in great waste of space and pipe.

The toilets may have another technical problem. When being used, in order to discharge excrements smoothly and prevent odor of the drain from overflowing reversely through the siphon pipe of the toilet body, a toilet is provided with a jet hole at the bottom of the toilet body, so that the water flow not only flushes the bowl of the toilet body, but also enters the siphon pipe from the jet hole to form siphon.

Water flow can enter the jet hole in two manner. One is that the water flow relies on gravity of the water in the water tank to pass through a discharge valve, and then rush into the jet hole. The discharge valve itself is provided with a vacuum breaker, which can stably insulate the water in the water tank and dirty water in the toilet body. The other is that a pump provides power to pump the water in the water tank and flush it into the jet hole. In this structure, the higher end of an outlet channel of the pump is connected with the water tank, the other lower end is connected with the jet hole, and an elevated section in the middle is connected with the vacuum breaker so as to insulate the water tank from the dirty water in the toilet body. Therefore, in such a toilet, two vacuum breakers are needed for the pipes supplying water to the jet hole, and in order to meet the connection requirements of the two vacuum breakers, pipes also need to be arranged accordingly. As a result, spatial layout of the pipes is relatively complicated, cost of the device is higher, and the corresponding toilet is large in size, which affects using sense of a user.

The toilets may have another technical problem. In a toilet using pipe water, a jet structure for flushing water is generally installed in the toilet, and a main function of the jet structure is to flush dirt inside the toilet so as to keep the inside of the toilet clean. Such a jet structure is generally arranged on a toilet body, and the toilet body is generally a ceramic piece. A jet for flushing includes a jet body and a rubber joint, the jet body is sealedly fixed to the ceramic piece, and then the rubber joint is sleeved on the jet body. The rubber joint has only one inlet that is connected with a water supply end, and the water supply end supplies water to the toilet body. The jet structure can only supply water through one channel, and thus the toilet body can only be flushed by water from one source. However, when the water supply end goes wrong, the toilet cannot be used normally, which limits the use of the toilet body.

The toilets may have another technical problem. A jet hole is arranged at the bottom of a toilet body of the toilet. During flushing, a water flow enters the siphon pipe through the jet hole to smoothly discharge dirt, and then siphon is also achieved in the siphon pipe and a water seal is formed to prevent unpleasant odor in the drain from reversely entering the toilet body. The toilet has a water outlet for discharging pressurized water from a water tank thereof to the bottom of the toilet, which thereby causes siphon. In such a toilet, a water pump is located in the water tank, and all energy needed for siphon is provided by the water pump, which requires that the water pump should have a large output flow and a good waterproof performance, indirectly leading to the water pump having a large size and a high price. Or, water can be directly flushed into the jet hole from a household water supply line, which requires a high water supply pressure and will cause poor flushing performance in home of many users.

The toilets may have another technical problem. To keep a toilet clean and sanitary, people usually put medicament products into a water tank. When water in the water tank is used to the toilet body, a water flow containing the medicament is directly flushed into the toilet body. However, if the toilet is not flushed for a long time, the medicament immersed in the water tank will keep dissolving all the time, which causes a very high concentration in the water tank. Water discharged from the toilet next time will carry a high-concentration medicament solution, which will result in waste. Moreover, due to the water replenishing ability of the toilet, a large amount of medicament will be dissolved in the new water solution. Due to such a large amount of water replenishing and water discharging, the utilization rate of the medicament is extremely low, which causes a relatively high use cost.

To make the objectives, technical solutions, and advantages of the present disclosure clearer, the embodiments of the present disclosure will be described in detail hereinafter with reference to the accompanying drawings. Those of ordinary skills in the art should understand that many technical details are provided in the embodiments of the present disclosure such that readers can better understand the present disclosure. However, the technical solutions sought to be protected by the claims of the present application can also be achieved without these technical details or the various changes and modifications based on the embodiments.

Figure 2:
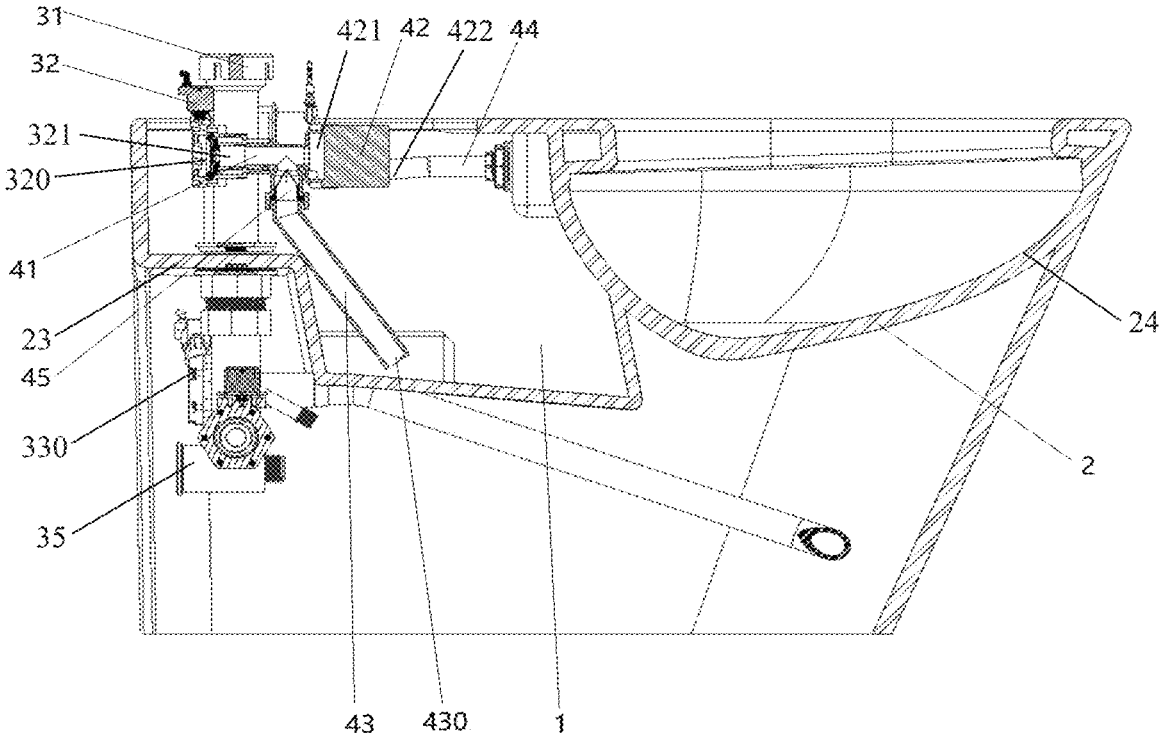
FIG. 2 is a schematic view, which is a section view as taken along line E-E in FIG. 1, of the internal structure of a toilet according to an embodiment of the present disclosure.
Figure 3:
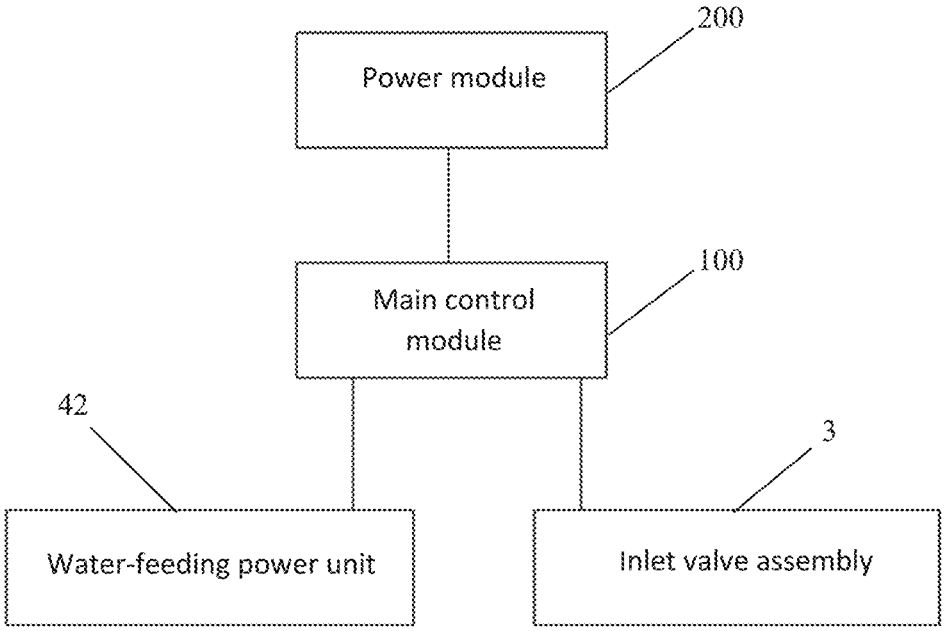
FIG. 3 is a view showing a circuit module of a water supply mechanism for a bowl rim according to an embodiment of the present disclosure.

First and Second Embodiments: Water Supply Mechanism for a Bowl Rim and Toilet Thereof FIG. 1 is a top view of the toilet according to the present disclosure. FIG. 2 is a schematic view, which is a section view as taken along line E-E in FIG. 1, of the internal structure of a toilet according to a first embodiment of the present disclosure. FIG. 3 is a view showing a circuit module of a water supply mechanism for a bowl rim according to the first embodiment of the present disclosure.

The first embodiment of the present disclosure relates to a water supply mechanism for a bowl rim of a toilet, as shown in FIG. 2, which is configured to supply water to a bowl 24 of a toilet body 2 of the toilet for flushing, including: an inlet valve assembly, a water-feeding power unit 42 and an outlet pipe 44. The inlet valve assembly is communicated with a water source, and is connected to a vacuum breaker. When the inlet valve assembly is opened, water flow from the water source flows through the vacuum breaker and enters the inlet valve assembly. The water-feeding power unit 42 includes a water inlet 421 connected to the inlet valve assembly and a water outlet 422 communicated with the water inlet 421 of the water-feeding power unit 42. The water flow entered the inlet valve assembly flows into the water inlet 421 of the water-feeding power unit 42 and then flows out from the water outlet 422 of the water-feeding power unit 42. The outlet pipe 44 is connected with the water outlet 422 of the water-feeding power unit 42 and also is communicated with a water channel at the bowl rim of the toilet body 2. The water flow flowing out of the water outlet 422 of the water-feeding power unit 42 enters the outlet pipe 44, and then flows from the outlet pipe 44 to the bowl rim of the toilet body 2. The water-feeding power unit 42 may be a water pump. After being pressurized by the water pump, the water flow reaches the bowl rim of the toilet body 2 at a greater flow rate, has larger impact force, and thus can flow down from the bowl rim of the toilet body 2 in a more favorable manner, so as to flush the whole toilet body 2. Of course, the water-feeding power unit 42 may also be other components.

In view of the above, it can be seen that, since the inlet valve assembly, the water-feeding power unit 42 and the outlet pipe 44 are provided, the inlet valve assembly is communicated with the water source, and the water inlet 421 of the water-feeding power unit 42 is communicated with the inlet valve assembly, when the inlet valve assembly is opened, water from the water source, passing through the inlet valve assembly, is pushed by the water-feeding power unit 42, the pressure of the water flow increases and the water flow flows out from the water outlet 422 of the water-feeding power unit 42. The water outlet 422 of the water-feeding power unit 42 is further connected with the outlet pipe 44, the outlet pipe 44 is communicated with the water channel at the bowl rim of the toilet body 2, and the water flow flowing out of the water outlet 422 of the water-feeding power unit 42 passes the outlet pipe 44 and enters the bowl rim of the toilet body 2, such that the bowl 24 of the toilet body 2 is flushed by the water flow with increased water pressure and thus the toilet body 2 can be made cleaner.

Further, as shown in FIG. 2, the inlet valve assembly 3 includes: a valve body 32 and a connecting portion 41. The valve body 32 includes a water inlet end communicated with the water source and a water outlet end 321 communicated with the water inlet end of the valve body 32. The connecting portion 41 connects the water outlet end 321 of the valve body 32 and the water inlet 421 of the water-feeding power unit 42. The connecting portion 41 may be a pipe that connects the water outlet end 321 of the valve body 32 and the water inlet 421 of the water-feeding power unit 42, such that the inlet valve assembly 3 is connected with the water-feeding power unit 42.

Moreover, as shown in FIG. 2, the toilet includes: a water tank 1 communicated with the water source and configured to store flushing water. The water supply mechanism for the bowl rim further includes: a suction pipe 43 connected with the connecting portion 41 and at least partially extending into the water tank 1; the suction pipe 43 is configured to suck water flow in the water tank 1 when the water-feeding power unit 42 is actuated or opened. Therefore, the water-feeding power unit 42 can provide suction to the water flow in the water tank 1 while increasing water pressure of the water flow entered from the inlet valve assembly 3, so that the water flow in the water tank 1 enters the outlet pipe 44 from the suction pipe 43, thereby increasing the water flow for flushing the toilet body 2, increasing pressure and impact force of the water flow, and further making the toilet body 2 more clean.

Further, as shown in FIG. 2, the water supply mechanism for the bowl rim further includes: a one-way valve 45 arranged on the suction pipe 43 and configured to prevent the water flow from entering the water tank 1 via the suction pipe 43. Due to the arrangement of the one-way valve 45, the water flow passing through the inlet valve assembly 3 does not enter the water tank 1 via the suction pipe 43, but directly flows into the water-feeding power unit 42, so that a normal flow direction of the water flow is maintained.

Moreover, as shown in FIG. 2, the water supply mechanism for the bowl rim further includes: a flow limiter arranged at the water inlet end of the valve body 32, which avoids that positive pressure is formed at the water inlet 421 of the water-feeding power unit 42 and thereby prevents the water in the inlet valve assembly 3 from flowing backwards into the water tank 1.

Further, as shown in FIG. 2, the suction pipe 43 includes: a suction port 430 extending into the water tank 1 for sucking water. The diameter of the suction port 430 of the suction pipe 43 is smaller than the inner diameter of the suction pipe 43. Therefore, negative pressure is formed within the suction pipe 43, which further provides a power source for the water flow.

Moreover, as shown in FIG. 3, the water supply mechanism for the bowl rim further includes: a main control module 100 electrically connected with the water-feeding power unit 42 and the inlet valve assembly 3 and configured to control the water-feeding power unit 42 and the inlet valve assembly 3 to be opened or closed. Power is supplied to the main control module 100, the water-feeding power unit 42 and the inlet valve assembly 3 from an external power supply device. When a flush is needed, the main control module 100 can directly control the water-feeding power unit 42 and the inlet valve assembly 3 to be opened, so that the operation is automated.

Moreover, as shown in FIG. 3, the water supply mechanism for the bowl rim further includes: a power module 200 electrically connected with the main control module 100 and configured to supply power to the inlet valve assembly 3. The power module 200 may be a battery pack, which is a lithium battery or a rechargeable battery, is arranged on the toilet and may be replaced. In case of power failure of the external power supply device, the power module 200 is used as a standby power supply to supply power to the main control module 100 and the inlet valve assembly 3, so that the inlet valve assembly 3 can be normally opened to flush the toilet body 2 if desired.

The second embodiment of the present disclosure relates to a toilet, including the water supply mechanism for the bowl rim according to the first embodiment.

Third and Fourth Embodiments: Water Inlet Mechanism and Toilet Thereof

Figure 4:
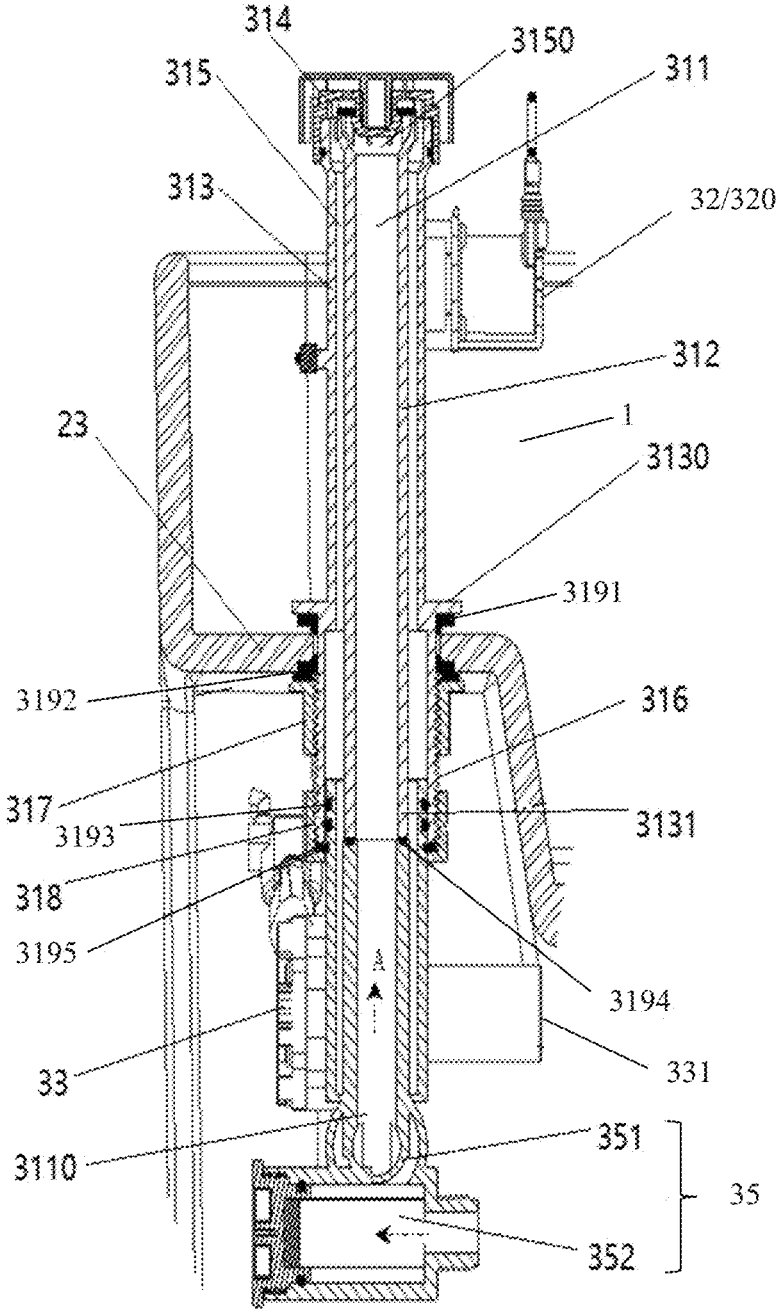
FIG. 4 is a section view as taken along line C-C in FIG. 1.
Figure 5:
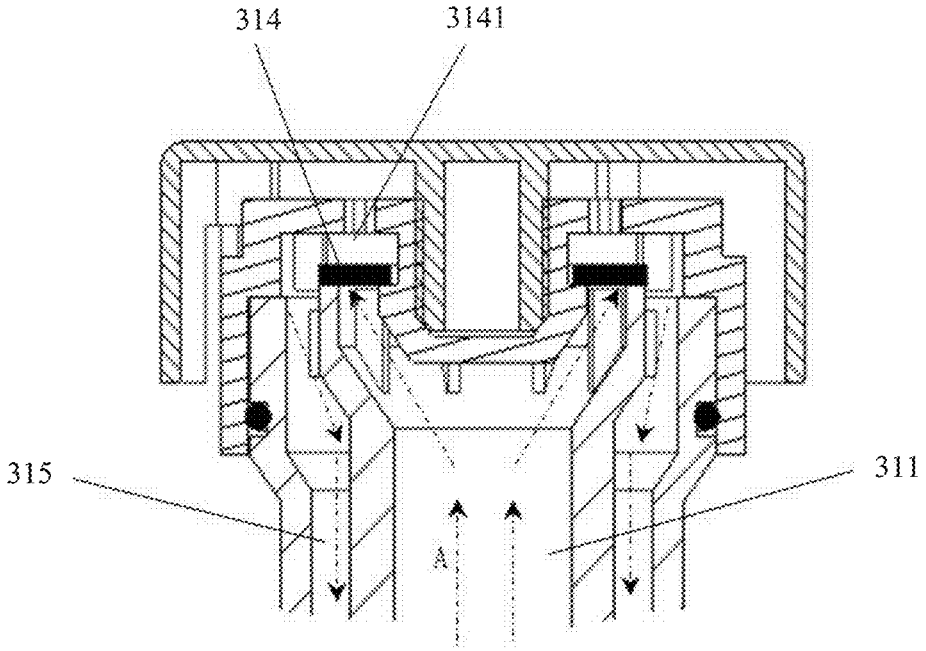
FIG. 5 is a partial schematic view of the top of the vacuum breaker shown in FIG. 4.
Figure 6:
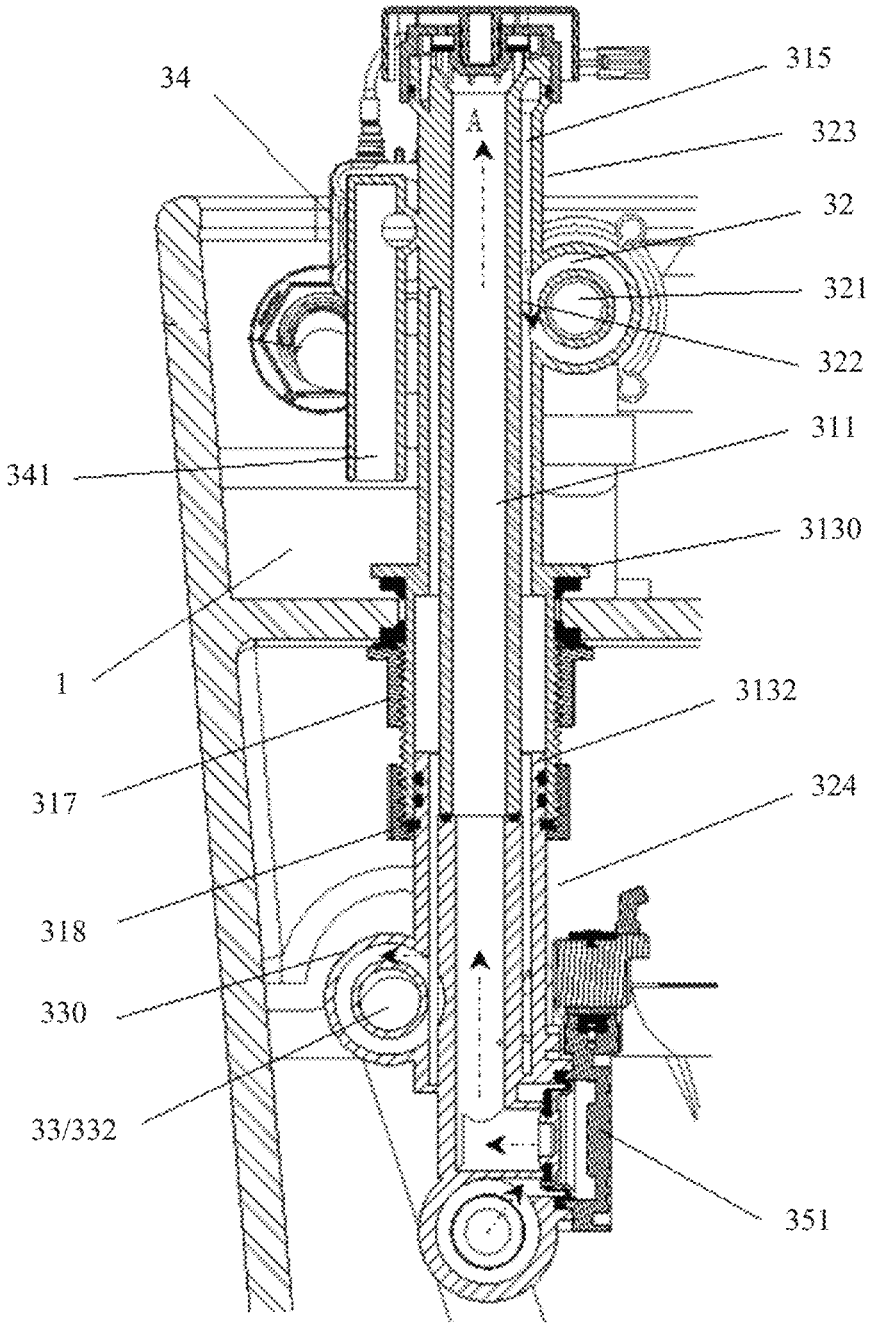
FIG. 6 is a section view as taken along line D-D in FIG. 1.

FIG. 1 is a top view of the toilet according to the present disclosure. FIG. 2 is a schematic view, which is a section view as taken along line E-E in FIG. 1, of the internal structure of a toilet according to a first embodiment of the present disclosure. FIG. 4 is a section view as taken along line C-C in FIG. 1. FIG. 5 is a partial schematic view of the top of the vacuum breaker shown in FIG. 4. FIG. 6 is a section view as taken along line D-D in FIG. 1.

The third embodiment of the present disclosure relates to a water inlet mechanism of a toilet, as shown in FIG. 1, FIG. 2, FIG. 4, FIG. 5, FIG. 6, including: a vacuum breaker 31, a general water inlet assembly 35, a bowl rim water inlet assembly 320, a tank water inlet assembly, and a jet water inlet assembly 330. The vacuum breaker 31 includes an inner cavity pipe 312 provided with an upstream chamber 311, an outer cavity pipe 313 arranged around the inner cavity pipe 312, and a chamber valve 314 for allowing or blocking communication between the inner cavity pipe 312 and the outer cavity pipe 313. The inner cavity pipe 312 and the outer cavity pipe 313 are separated from each other to form a downstream chamber 315, and the downstream chamber 315 is configured to communicate with the upstream chamber 311 when the chamber valve 314 is opened. The general water inlet assembly 35 is connected with the inner cavity pipe 312 and is configured to allow or block communication between the upstream chamber 311 and a water source. The bowl rim water inlet assembly 320 is connected with the outer cavity pipe 313, is configured to allow or block communication between the downstream cavity 315 and a toilet body 2 of the toilet, and is further configured to supply the water flow in the downstream cavity 315 to the bowl 24 of the toilet body 2 when being opened. The tank water inlet assembly is connected with the outer cavity pipe 313, is configured to allow or block communication between the downstream cavity 315 and the water tank 1 of the toilet, and is further configured to supply the water flow in the downstream cavity 315 to the water tank 1 when being opened. The jet water inlet assembly 330 is connected with the outer cavity pipe 313, is configured to allow or block communication between the downstream cavity 315 and the toilet body 2 of the toilet, and is further configured to supply the water flow in the downstream cavity 315 to the jet hole of the toilet body 2 when being opened.

In view of the above, it can be seen that, since the vacuum breaker 31 includes the inner cavity pipe 312, the outer cavity pipe 313 and the chamber valve 314, the outer cavity pipe 313 is arranged around the inner cavity pipe 312, the upstream chamber 311 is arranged in the inner cavity pipe 312, the inner cavity pipe 312 and the outer cavity pipe 313 are separated from each other to form the downstream chamber 315, and the general water inlet assembly 35 is connected with the inner cavity pipe 312, when water is supplied to the inner cavity pipe 312, the water flow enters the upstream chamber 311, opens the chamber valve 314 by impact, and enters the downstream chamber 315. The bowl rim water inlet assembly 320, the tank water inlet assembly and the jet water inlet assembly 330 are all connected with the outer cavity pipe 313, when being opened the bowl rim water inlet assembly 320 supply the water flow in the downstream chamber 315 to the bowl 24 of the toilet body 2, and thus the bowl 24 of the toilet body 2 can be cleaned. The tank water inlet assembly supplies the water flow in the downstream chamber 315 to the water tank 1 when being opened, and the jet water inlet assembly 330 supplies the water flow in the downstream chamber 315 to the jet hole of the toilet body 2 when being opened, which can flush the bottom of the toilet body 2 to remove dirt and help to smoothly form siphon. Therefore, the general water inlet assembly 35, the bowl rim water inlet assembly 320, the tank water inlet assembly and the jet water inlet assembly 330 are connected with one vacuum breaker 31, water supplying to the toilet body 2 is achieved through a more simple and more integrated structure, so that the size of the toilet body 2 can be decreased and the cost is reduced.

Moreover, as shown in FIG. 4 and FIG. 6, arrows A in the figures denote directions of water flow. The inner cavity pipe 312 includes, from bottom to top, a liquid inlet 3110 abutting against the general water inlet assembly 35 and a liquid outlet 3150 arranged opposite to the liquid inlet 3110. Both the liquid inlet 3110 of the inner cavity pipe 312 and the liquid outlet 3150 of the inner cavity pipe 312 are communicated with the upstream chamber, and the chamber valve 314 is arranged at the liquid outlet 3150 of the inner cavity pipe 312. Further, as shown in FIG. 5, a ventilation cavity 3141 is arranged in the vacuum breaker 31, which is located above the upstream chamber 311. When the toilet is not in use and a negative pressure exists at the liquid inlet 3110, an air flow will enter the ventilation cavity 3141 to press against the chamber valve 314 to make the chamber valve 314 seal the liquid inlet 3110, so that dirty water in the toilet cannot enter the upstream chamber 311 and thus cannot enter a domestic water supply pipeline, and the dirty water in the toilet is thereby insulated from the domestic water supply pipeline. After the general water inlet assembly 35 is opened, the water flow enters the upstream chamber 311. The water flow has impact force and can flow upwards to open the chamber valve 314 by impact, such that the water flow can enter the downstream chamber 315 to become water for flushing the toilet.

Further, a bracket 23 for installing the vacuum breaker 31 is arranged in the toilet. In this embodiment, the bracket 23 is connected with a side wall of the water tank 1 and an outer wall of the toilet body 2. The toilet body 2, the water tank 1 and the bracket 23 may all be ceramic elements. The vacuum breaker 31 includes an upper valve body 323, a connecting assembly, a lower valve body 324 and a locking assembly. The upper valve body 323 partially penetrates through the bracket 23, the liquid outlet 3150 is arranged on the upper valve body 323, and the upper valve body 323 includes a part of the inner cavity pipe 312 and a part of the outer cavity pipe 313. The connecting assembly is configured to fix the upper valve body 323 on the bracket 23. The lower valve body 324 and the upper valve body 323 are in butt joint, and the liquid inlet 3110 is arranged on the lower valve body 324. Moreover, the lower valve body 324 includes another part of the inner cavity pipe 312 and another part of the outer cavity pipe 313. The locking assembly is configured to fix the upper valve body 323 and the lower valve body 324 to one another.

Further, as shown in FIG. 4 and FIG. 2, the outer cavity pipe 313 of the upper valve body 323 is provided with an abutting portion 3130 abutting against the side of the bracket 23 facing the liquid outlet 3150, and the side of the outer cavity pipe 313 of the upper valve body 323 facing the liquid inlet 3110 is provided with an external thread 316. The connecting assembly includes a nut 317 engaged with the external thread 316 and configured to fix the upper valve body 323 on the bracket 23 in coordination with the abutting portion 3130.

Moreover, as shown in FIG. 4 and FIG. 6, the connecting assembly further includes a first sealing element 3191 and a second sealing element 3192. The first sealing element 3191 is sleeved on the outer cavity pipe 313 of the upper valve body 323 and is arranged between the abutting portion 3130 and the bracket 23. The second sealing element 3192 is sleeved on the outer cavity pipe 313 of the upper valve body 323 and is arranged between the nut 317 and the bracket 23. The first sealing element 3191 and the second sealing element 3192 may both be a rubber sealing gasket 3194, so that the abutting part 10 can be sealedly abutted against the bracket 23, a sealing performance between the nut 317 and the bracket 23 can also be improved, and the upper valve body 323 can be fixed more tightly on the bracket 23.

Further, as shown in FIG. 4 and FIG. 6, the locking assembly includes a union nut 318 that can be engaged with the external thread 316 and is configured to fix the outer cavity pipe 313 of the upper valve body 323 to the outer cavity pipe 313 of the lower valve body 324.

Moreover, as shown in FIG. 4 and FIG. 6, the outer cavity pipe 313 of the lower valve body 324 includes an insertion portion 3132 inserted into the downstream chamber 315 of the upper valve body 323, and the insertion portion 3132 abuts against the inner wall of the outer cavity pipe 313 of the upper valve body 323. The inner cavity pipe 312 of the lower valve body 324 abuts against the inner cavity pipe 312 of the upper valve body 323. The locking assembly further includes at least one sealing ring 3193 and a sealing gasket 3194. The sealing ring 3193 is sleeved on the insertion portion 3132 and abuts against the inner wall of the outer cavity pipe 313 of the upper valve body 323. The sealing gasket 3194 is arranged at the position where the inner cavity pipe 312 of the lower valve body 324 abuts against the inner cavity pipe 312 of the upper valve body 323. The sealing ring 3193 and the sealing gasket 3194 may both be a rubber sealing element or a silicone sealing element. A sealing element 3195 may also be arranged at the position where the union nut 318 abuts against the outer cavity pipe 313 of the upper valve body 323.

Specifically, as shown in FIG. 4 and FIG. 6, the upper valve body 323 partially penetrates through the bracket 23, the abutting portion 3130 abuts against the side of the bracket 23 facing the liquid outlet 3150, then the nut 317 is engaged with the external thread 316, thereby the nut 317 abuts against the side of the bracket 23 facing the liquid inlet 3110 by screwing the nut 317, so that the upper valve body 323 is fixed on the bracket 23. Meanwhile, the union nut 318 is engaged with the external thread 316 of the upper valve body 323, and then the lower valve body 324 and the upper valve body 323 are mounted together. The sealing ring 3193 is sleeved on the insertion portion 3132. The insertion portion 3132 is inserted into the downstream chamber 315 of the upper valve body 323, clinging to the inner wall of the outer cavity pipe 313 of the upper valve body 323. Combined with the arrangement of the sealing ring 3193, the sealing performance between the insertion portion 3132 and the inner wall of the outer cavity pipe 313 of the upper valve body 323 is improved. Therefore, the downstream chamber 315 of the upper valve body 323 is abutted against and communicated with the downstream chamber 315 of the lower valve body 324, and the water flow will not flow out between the insertion portion 3132 and the inner wall of the outer cavity pipe 313 of the upper valve body 323. At this time, the inner cavity pipe 312 of the lower valve body 324 abuts against the inner cavity pipe 312 of the upper valve body 323, and the sealing gasket 3194 may also be a sealing ring to seal, between the inner cavity pipe 312 of the lower valve body 324 and the inner cavity pipe 312 of the upper valve body 323, the position where the inner cavity pipe 312 of the lower valve body 324 abuts against the inner cavity pipe 312 of the upper valve body 323, so that the upstream chamber 311 of the upper valve body 323 is communicated with the upstream chamber 311 of the lower valve body 324 to form the whole upstream chamber 311, and the water flow will not seep out from the position where the inner cavity pipe 312 of the lower valve body 324 abuts against the inner cavity pipe 312 of the upper valve body 323. The union nut 318 is screwed to fix the lower valve body 324 together with the upper valve body 323. Therefore, the vacuum breaker 31 is mounted and fixed.

Moreover, as shown in FIG. 4 and FIG. 6, the general water inlet assembly 35 includes a general water inlet valve 351 connected with the liquid inlet 3110. When the general water inlet valve 351 is opened, water flow can enter the upstream chamber 311, open the chamber valve 314 by impact, and flow into the downstream chamber 315.

Further, the general water inlet assembly 35 further includes a filtering module 352 connected with the general water inlet valve 351 and communicated with the water source. The water source may be an interface to the water supply pipeline, which is connected with the filtering module 352 through a pipe, and the filtering module 352 may be a filtering joint with a filter element arranged inside. The filtering module 352 is communicated with the general water inlet valve 351. After the general water inlet valve 351 is opened, the water flow passes through the filtering module 352 and the general water inlet valve 351 in turn, enters the upstream chamber 311, opens the chamber valve 314 by impact, and flows into the downstream chamber 315.

Further, as shown in FIG. 4, FIG. 6, and FIG. 2, a bowl rim opening 322 is arranged on the outer cavity pipe 313 of the upper valve body 323. The bowl rim water inlet assembly 320 includes a bowl rim pipe and a bowl rim valve 32. The bowl rim pipe leads to the bowl of the toilet body 2, and the bowl rim valve 32 is connected with the bowl rim pipe and the bowl rim opening 322. After the bowl rim valve 32 is opened, the water flow in the downstream chamber 315 enters the bowl rim valve 32 through the bowl rim opening 322, flows into the bowl rim pipe from a water outlet 321 of the bowl rim valve 32, and finally enters the toilet body 2.

Moreover, as shown in FIG. 4, FIG. 6, and FIG. 2, a tank opening is arranged on the outer cavity pipe 313 of the upper valve body 323. The tank water inlet assembly includes a tank valve connected with the tank opening so as to supply water to the water tank 1. After the tank valve is opened, the water flow in the downstream chamber 315 enters the tank valve and enters the water tank 1 from a water outlet 341 of the tank valve.

Moreover, as shown in FIG. 4, FIG. 6, and FIG. 2, a jet opening is arranged on the outer cavity pipe 313 of the lower valve body 324. The jet water inlet assembly 330 includes a jet pipe 331 and a jet valve 33. The jet pipe 331 leads to the jet hole, and the jet valve 33 is connected with the jet pipe 331 and the jet opening. After the jet valve 33 is opened, the water flow in the downstream chamber 315 passes through the jet valve 33, enters the jet pipe 331 from a water outlet 332 of the jet valve 33, and finally enters the bottom of the toilet body 2 through the jet hole.

It is worth mentioning that, based on actual characteristic requirements of the toilet, as shown in FIG. 4, FIG. 6, and FIG. 2, the general water inlet valve 351 and the jet valve 33 are arranged on the lower valve body 324 of the vacuum breaker 31, the tank valve and the bowl rim valve 32 are arranged on the upper valve body 323 of the vacuum breaker 31, while the vacuum breaker 31 needs to be mounted and fixed on the bracket 23. In order to facilitate the securing and mounting of the vacuum breaker 31, the vacuum breaker 31 is divided into the upper valve body 323 and the lower valve body 324. When the upper valve body 323 is inserted onto the bracket 23, the bracket 23 does not interfere with the portion of the lower valve body where the general water inlet valve 351 and the jet valve 33 need to be mounted.

The fourth embodiment of the present disclosure provides a toilet, including the water inlet mechanism according to the third embodiment.

Fifth and Sixth Embodiments: Water Supply Mechanism and Toilet Thereof

Figure 7:
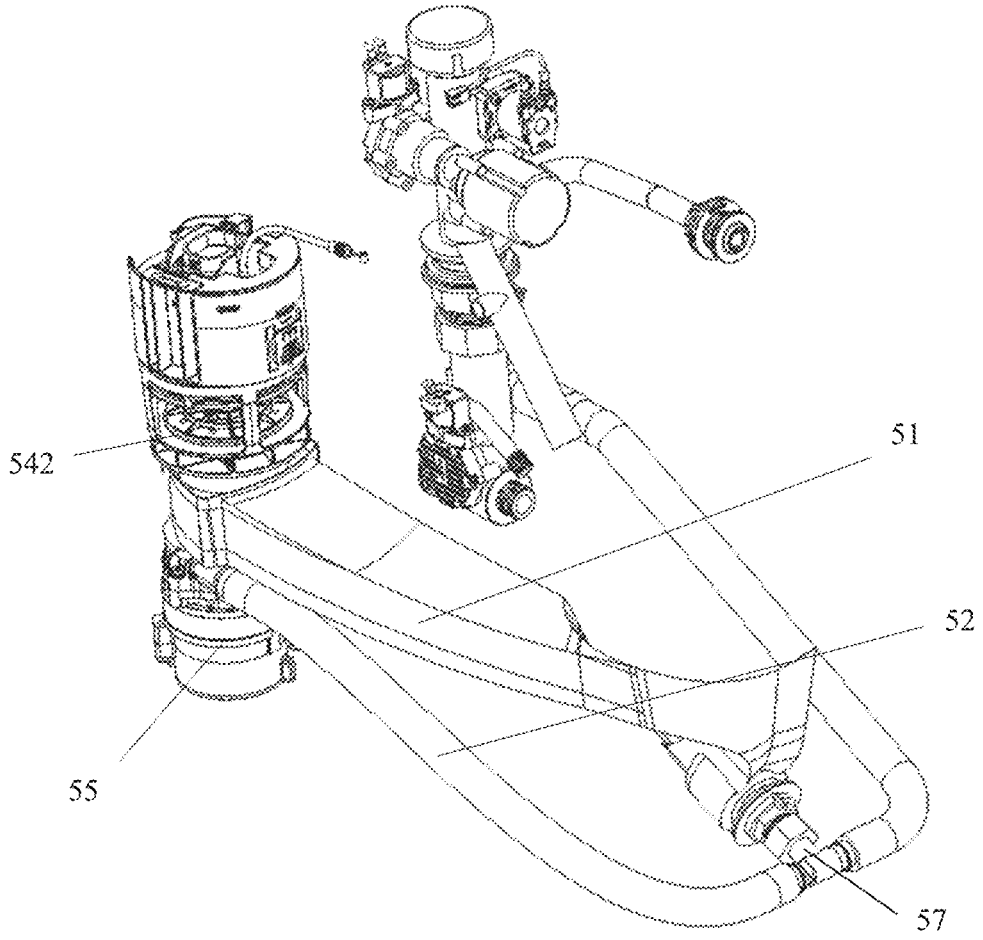
FIG. 7 is a schematic view of the internal structure of the toilet according to an embodiment of the present disclosure.
Figure 8:
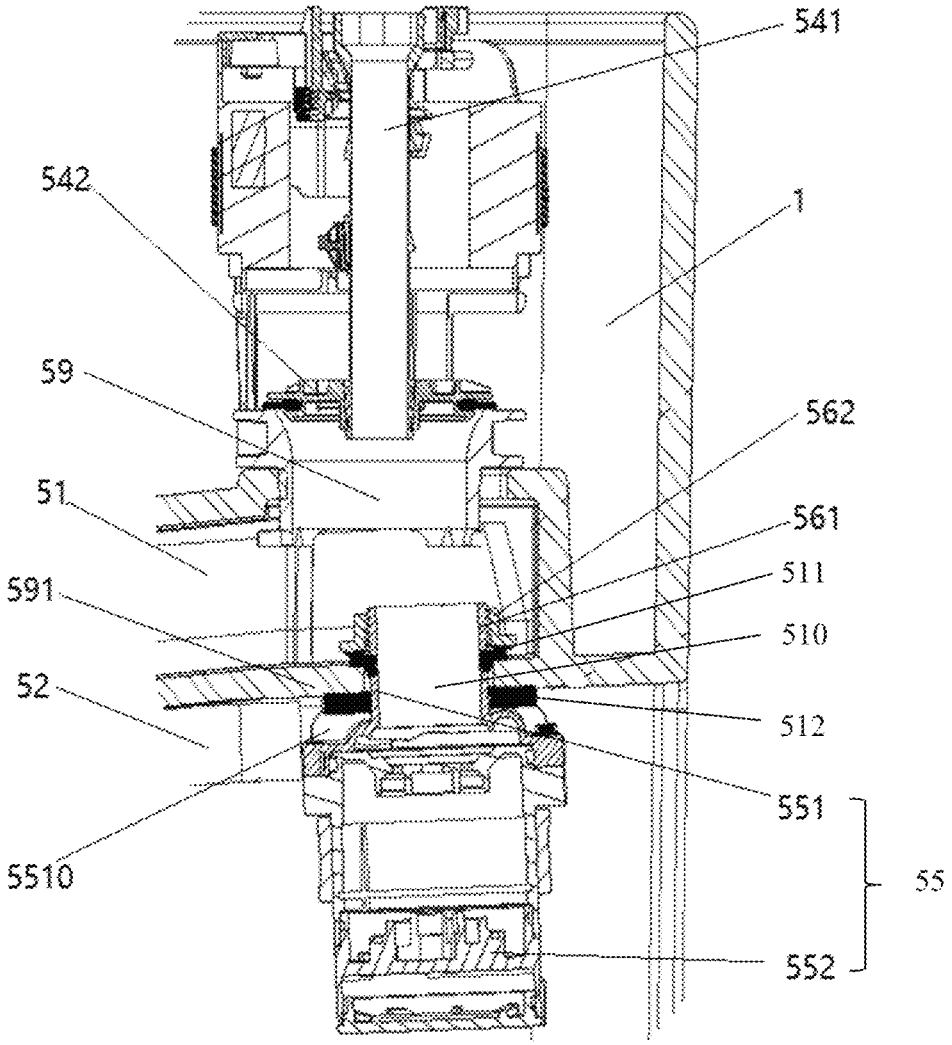
FIG. 8 is a section view as taken along line B-B in FIG. 1.
Figure 9:
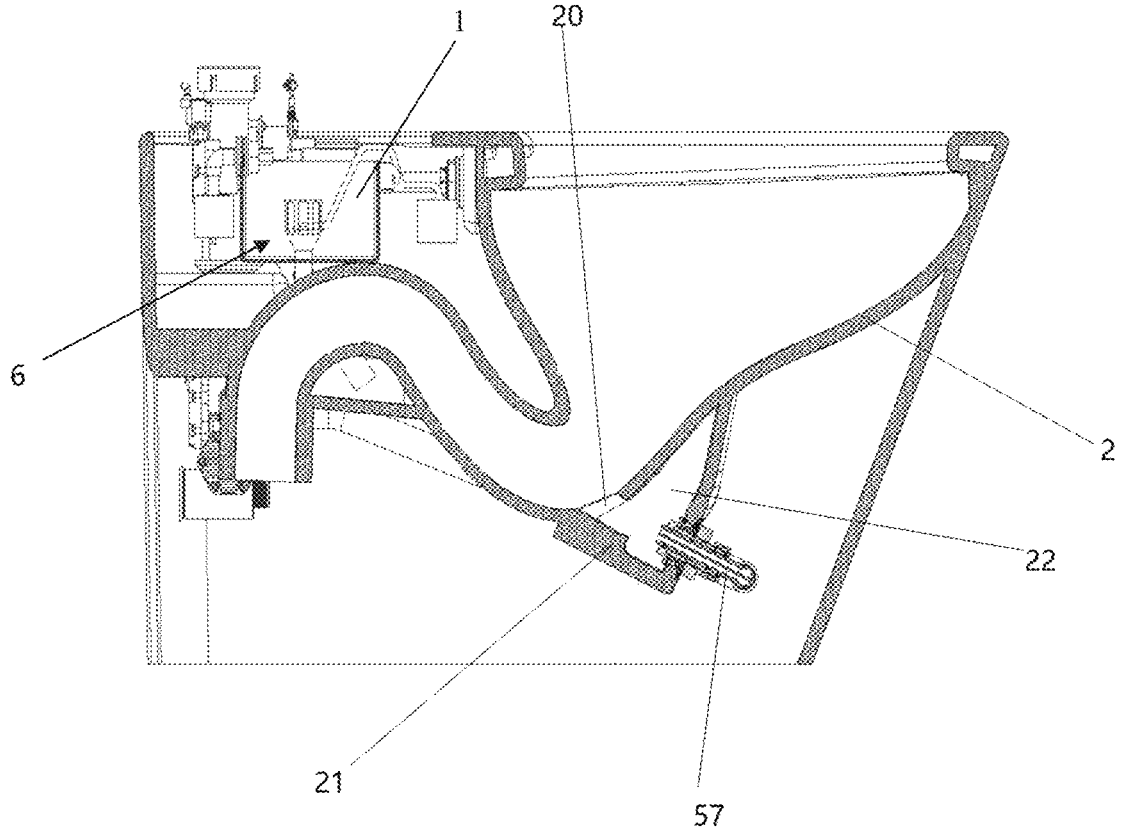
FIG. 9 is a section view as taken along line A-A in FIG. 1.

FIG. 1 is a top view of the toilet according to the present disclosure. FIG. 7 is a schematic view of the internal structure of the toilet according to an embodiment of the present disclosure. FIG. 8 is a section view as taken along line B-B in FIG. 1. FIG. 9 is a section view as taken along line A-A in FIG. 1.

The fifth embodiment of the present disclosure relates to a water supply mechanism of a toilet, as shown in FIG. 1, FIG. 7, FIG. 8, and FIG. 9, which is configured to supply water to a jet hole 20 arranged on a toilet body 2 of the toilet, including: a water tank 1, a vacuum breaker 541, a discharge valve 542, a discharge pipe, and a discharge power unit 55. The water tank 1 is configured to store flushing water, the vacuum breaker 541 is arranged in the water tank 1, the discharge valve 542 is connected with the vacuum breaker 541, and the vacuum breaker 541 makes the discharge valve 542 communicate with the air. The discharge valve 542 is configured to discharge water in the water tank 1 after being opened; and is also configured to keep the water in the water tank 1 after being closed. The discharge pipe is connected with the discharge valve 542, including a gravity discharge channel 51 and a power discharge channel 52 which are both communicated with the discharge valve 542, and the gravity discharge channel 51 and the power discharge channel 52 are both configured to supply water flow in the water tank 1 to the jet hole 8 after the discharge valve 542 is opened. The discharge power unit 55 is communicated with the downstream of the discharge valve 542 and is connected with the power discharge channel 52, and is configured to pump water flow passing through the discharge valve 542 into the power discharge channel 52.

Specifically, as shown in FIG. 7 and FIG. 9, after the discharge valve 542 is opened, the water flow passes through the inner chamber of the vacuum breaker 541 and enters the discharge pipe through the discharge valve 542. A portion of the water flow rushes directly from the gravity discharge channel 51 to the jet hole 8 by use of gravity of the water flow. Another portion of the water flow flows to the power discharge channel 52, is accelerated due to the drive of the discharge power unit 55, and flows from the power discharge channel 52 to the jet hole 8. The two water flows will mix when approaching the jet hole 8, and then under the action of laminar flow effect, the speed of the accelerated water decreases while the speed of the water from the water tank 1 increases, which thus accelerates forming of siphon in the toilet.

In view of the above contents, it can be seen that the vacuum breaker 541 is arranged in the water tank 1, the discharge valve 542 is connected with the vacuum breaker 541, and the discharge pipe is connected with the discharge valve 542. After the discharge valve 542 is opened, the water in the water tank 1 enters the discharge pipe. The discharge pipeline includes the gravity discharge channel 51 and the power discharge channel 52, and the discharge power unit 55 is further communicated with the discharge valve 542 and is connected with the power discharge channel 52. The discharge power unit 55 pumps the water flow passing through the discharge valve 542 into the power discharge channel 52, the power discharge channel 52 supplies the water flow to the jet hole 8, the gravity discharge channel 51 also supplies water flow to the jet hole 8, and thus water supplying to the jet hole 8 is realized through both the gravity discharge channel 51 and the power discharge channel 52. Moreover, the power discharge channel 52 and the gravity discharge channel 51 are both communicated with the discharge valve 542, and thus the power discharge channel 52 and the gravity discharge channel 51 are both communicated with the vacuum breaker 541, so that the dirty water in the toilet body 2 will not flow back into the water tank 1 through the power discharge channel 52 or the gravity discharge channel 51. That is to say, the water tank 1 is insulated from the dirty water in the toilet body 2 by one vacuum breaker 541. Since only one vacuum breaker 541 is employed in the discharge mechanism, cost of device is thus saved. Moreover, in the pipe layout, the power discharge channel 52 is a portion of the discharge pipe, which only needs to be communicated with the discharge valve 542 and does not need to add a connecting pipe to connect a separate vacuum breaker. Accordingly, the pipe layout is simplified, the space for the overall layout is decreased, the size of toilet can be reduced, thereby the occupied bathroom space, and requirements of customers can be met better.

Further, as shown in FIG. 8, the discharge power unit 55 includes a suction joint 551 and a pump body 552. The suction joint 551 is provided with a power suction port 510 communicated with the discharge pipe. The pump 52 is connected with the suction joint 551 and is provided with a power water outlet communicated with the power discharge channel 52. The pump body 552 is configured to suck a portion of water flow passing through the discharge valve 542 and convey the portion of water flow to the power discharge channel 52 through the power water outlet.

Moreover, as shown in FIG. 7 and FIG. 8, the discharge pipe further includes a water tank discharge channel 59' connected with the discharge valve 542 and communicated with the gravity discharge channel 51 and the power discharge channel 52. The power suction port 510 is connected into the water tank discharge channel 59'.

Further, as shown in FIG. 8, the water supply mechanism further includes a locking assembly configured to lock the suction joint 551 on the pipe wall 591 of the water tank discharge channel 59'.

Specifically, as shown in FIG. 8, the outer surface of the suction joint 551 is provided with an external thread. The pipe wall 591 of the water tank discharge channel 59' is provided with an opening for the suction joint 551 to pass through. The side of the suction joint 551 facing the pump body 552 is provided with a bulge 5510, and the bulge 5510 is configured to support the pipe wall 591 of the water tank discharge channel 59'. The locking assembly includes a nut 562 being able to engage with the external thread and fix the suction joint 551 in the opening in cooperation with the bulge 5510. During installation process, the suction joint 551 is passed through the opening, and then the nut 562 is engaged with the external thread, and the suction joint 551 is secured on the pipe wall 591 of the water tank discharge channel 59' by screwing the nut 562.

Moreover, as shown in FIG. 7 and FIG. 8, the discharge power unit 55 and the power discharge channel 52 are both arranged at the downstream of the discharge valve 542, and the suction joint 551 may also be arranged on the power discharge channel 52 and communicated with the inside of the power discharge channel 52. During operation, the pump body 552 provides power, the suction joint 551 quickly sucks water, and then the water is discharged from the power water outlet to the power discharge channel 52, such that the water flow is accelerated in the power discharge channel 52 and then flow into the jet hole 8.

Moreover, as shown in FIG. 8, the locking assembly further includes a first sealing element 511 and a second sealing element 512. The first sealing element 511 is sleeved on the external thread and is arranged between the pipe wall 591 of the water tank discharge channel 59' and the nut 562. The second sealing element 512 is arranged between the bulge 5510 and the pipe wall 591 of the water tank discharge channel 59'. The first sealing element 511 and the second sealing element 512 may both be rubber sealing gaskets. The second sealing element 512 is sleeved on the suction joint 551, and then the suction joint 551 is passed through the opening, so that the second sealing element 512 abuts against the pipe wall 591 the water tank discharge channel 59' and the bulge 5510. The second sealing element 152 is located at the position where the suction joint 551 passes through the opening. The second sealing element 512 is appressed to the pipe wall 591 of the water tank discharge channel 59'. Finally, the nut 562 is engaged with the external thread and then the nut 562 is screwed tightly. At this time, the nut 562 is in flexible contact with the pipe wall 591 of the water tank discharge channel 59', and the bulge 5510 is also in flexible contact with the pipe wall 591 of the water tank discharge channel 59', so that the water flow does not leak from the position between the opening and the suction joint 551, and thus the suction joint 551 is secured more firmly.

Moreover, as shown in FIG. 8, the pipe wall 591 of the water tank discharge channel 59' is connected to the wall surface of the water tank 1. In actual use, the pipe wall 591 of the water tank discharge channel 59' and the wall surface of the water tank 1 are both ceramic wall surfaces and are integrally formed, so that the discharge power unit 55 can be firmly positioned in the toilet.

The sixth embodiment of the present disclosure relates to a toilet, including the water supply mechanism as described above.

Seventh and Eighth Embodiments: Jet Structure and Toilet Thereof

Figure 10:
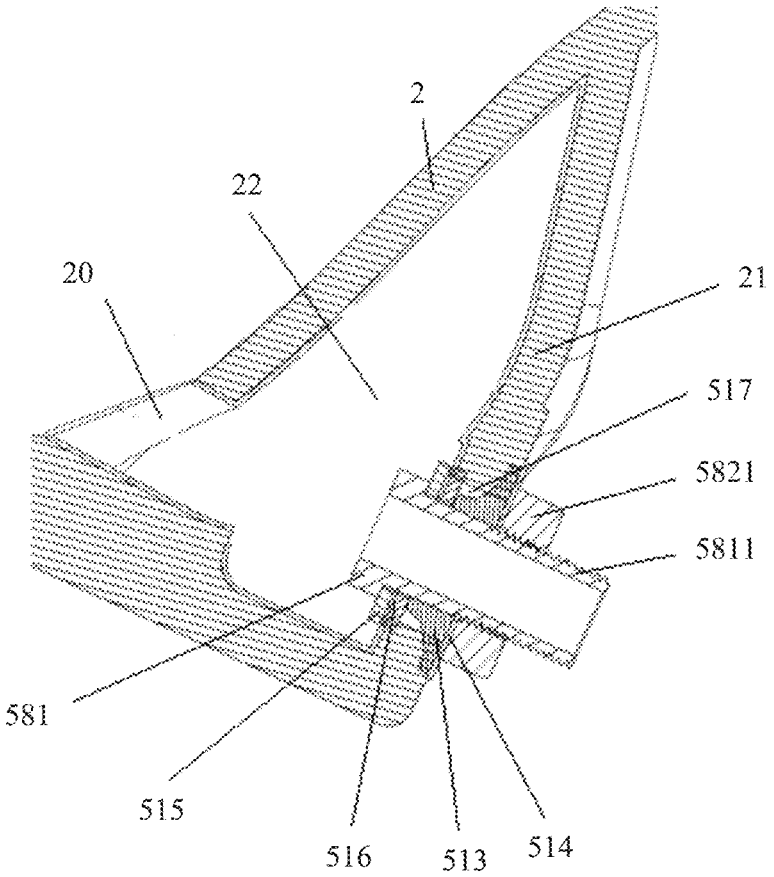
FIG. 10 is a schematic structural view of installing a non-ceramic jet body on a ceramic wall according to an embodiment of the present disclosure.
Figure 11:
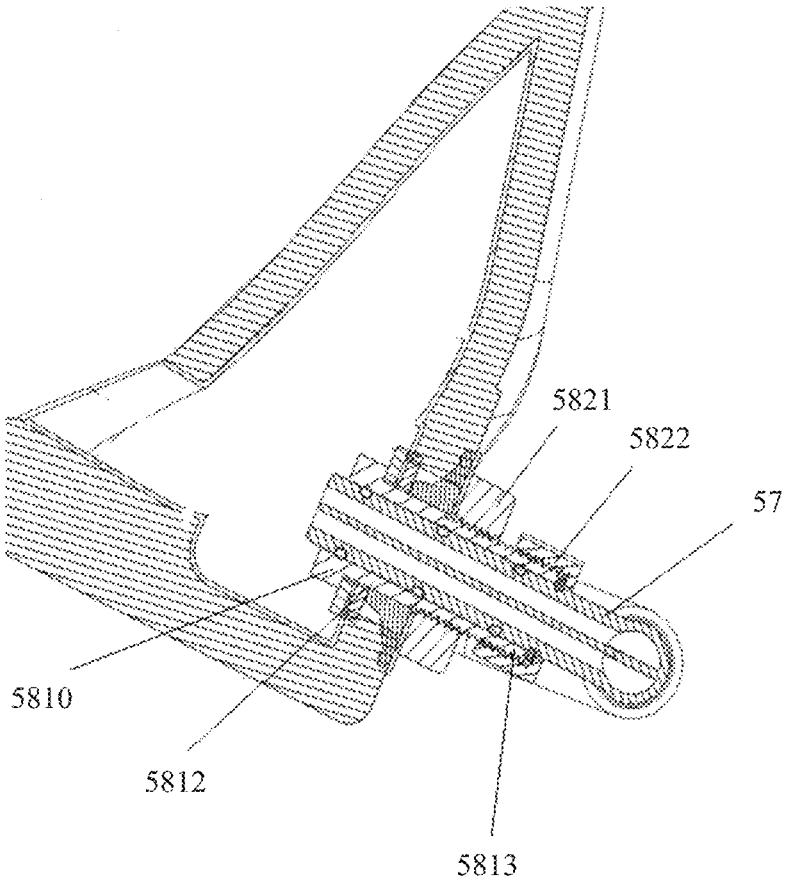
FIG. 11 is a schematic structural view of a jet structure according to an embodiment of the present disclosure.
Figure 12:
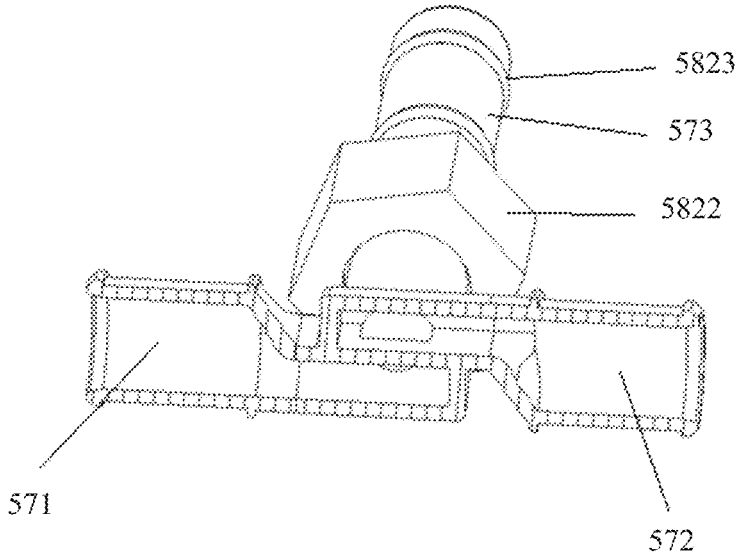
FIG. 12 is a schematic assembly view of a liquid delivery joint and a locking assembly according to an embodiment of the present disclosure.

FIG. 10 is a schematic structural view of installing a non-ceramic jet body on a ceramic wall according to an embodiment of the present disclosure. FIG. 11 is a schematic structural view of a jet structure according to an embodiment of the present disclosure. FIG. 12 is a schematic assembly view of a liquid delivery joint and a locking assembly according to an embodiment of the present disclosure.

The seventh embodiment of the present disclosure relates to a jet structure of a toilet, including a ceramic wall 21, a non-ceramic jet body 581, a connecting assembly, a liquid delivery joint 57 and a locking assembly. The ceramic wall 21 is arranged on a toilet body 2 of the toilet, and is provided with an opening 517. The non-ceramic jet body 581 passes through the opening 517, and the connecting assembly fixes the non-ceramic jet body 581 on the ceramic wall 21. The liquid delivery joint 57 includes a liquid output portion 573 passing through the non-ceramic jet body 581 and a plurality of liquid input portions communicated with the liquid output portion 573. Each of the liquid input portions is communicated with different water supply ends, and the liquid output portion 573 is configured to spray water to a jet hole 20 on the toilet body 2. The locking assembly fixes the liquid delivery joint 57 and the non-ceramic jet body 581 together. The non-ceramic jet body 581 is a plastic piece or a metal piece, and may also be other pieces.

Specifically, in this embodiment, two liquid input portions are arranged, i.e., a liquid input portion 571 and a liquid input portion 572. The two liquid input portions are both communicated with the liquid output portion 573. The liquid input portions may be communicated with a household water supply pipeline, or may be communicated with a water tank of the toilet. Both of the liquid input portions can supply water to the liquid output portion 573, and the water flow out of the liquid output portion 573 is directly sprayed to the jet hole 20.

In view of the above contents, it can be seen that, the ceramic wall 21, the non-ceramic jet body 581, the connecting assembly, the liquid delivery joint 57 and the locking assembly are provided, the ceramic wall 21 is arrange on the toilet body 2, the non-ceramic jet body 581 passes through the opening 517 in the ceramic wall 21, and the non-ceramic jet body 581 is fixed on the toilet body 2 by the connecting assembly. The liquid delivery joint 57 includes the liquid output portion 573 and the plurality of liquid input portions, and each of the liquid input portions is further communicated with different water supply ends. The jet body is a non-ceramic jet body 581, and the liquid delivery joint 57 can be fixed in the non-ceramic jet body 581 by the locking assembly, which avoids that the liquid delivery joint 57 cannot be fixedly connected with the ceramic wall 21. Moreover, the liquid output portion 573 passes through the non-ceramic jet body 581, and water can be supplied to respective liquid input portions from different water supply ends to ensure that water can be stably flushed out from the liquid output portion 573 under different conditions in order to clean the toilet body 2, so that the toilet can be stably operated without much limitation. Moreover, the liquid output portion 573 directly discharges water into the toilet body 2, which also prevents the water flow from leaking out when the water flow passes through the non-ceramic jet body 581, so that the toilet is more reliable to use.

Further, the non-ceramic jet body 581 includes a head 5812 facing the jet hole 20, and a tail 5813 arranged opposite to the head 5812. The head 5812 of the non-ceramic jet body 581 is provided with an abutting portion 5810 abutting against the ceramic wall 21, and the tail 5813 of the non-ceramic jet body 581 is provided with an external thread 5811. The connecting assembly includes a nut 5821 engaged with the external thread 5811, which is configured to fix the non-ceramic jet body 581 at the opening 517 in the ceramic wall 21 in coordination with the abutting portion 5810. When in use, the non-ceramic jet body 581 is passed through the opening 517 to make the abutting portion 5810 abut against the periphery of the opening 517, and then the nut 5821 is engaged with the external thread 5811 and is screwed to fix the non-ceramic jet body 581 to the ceramic wall 21. The ceramic wall 21 is generally a ceramic piece. The locking assembly includes a joint nut 5822. After the non-ceramic jet body 581 is fixed on the ceramic wall 21, the joint nut 5822 is engaged with the external thread 5811, a portion of the liquid output portion 573 of the liquid delivery joint 57 is passed through the non-ceramic jet body 581, and then the joint nut 5822 is screwed so as to fix the non-ceramic jet body 581 and the liquid delivery joint 57 to one another.

What is more worth mentioning is that, the locking assembly further includes at least one joint sealing ring 5823, which is sleeved on the liquid output portion 573 and abuts against the liquid output portion 573 and the inner wall of the non-ceramic jet body 581, thereby realizing sealedly fixing between the liquid output portion 573 and the non-ceramic jet body 581.

Moreover, the connecting assembly further includes a first sealing element, the diameter of which is larger than the diameter of the opening 517 in the ceramic wall 21. The first sealing element is sleeved on the tail 5813 of the non-ceramic jet body 581, and abuts between the opening 517 in the ceramic wall 21 and the nut 5821.

Moreover, the connecting assembly further includes a second sealing element, the diameter of which is larger than the diameter of the opening 517 in the ceramic wall 21. The second sealing element is sleeved on the head 5812 of the non-ceramic jet body 581, and abuts between the opening 517 in the ceramic wall 21 and the abutting portion 5810, thus realizing sealedly fixing of the non-ceramic jet body 581 and the ceramic wall 21.

Further, the first sealing element includes a sealing ring 513 and a spacer 514, which are sleeved on the tail 5813 of the non-ceramic jet body 581. Or, the first sealing element may include one of the sealing ring 513 or the spacer 514 only.

Moreover, the second sealing element includes at least one group of rubber gaskets 515. Or, the second sealing element includes at least one group of rubber gaskets 515 and plastic sheets 516.

Further, the water supply end includes two water supply portions. There are also two liquid input portions, which are communicated with different water supply portions, respectively.

Moreover, a water mixing cavity 22 communicated with the jet hole 20 is formed by the ceramic wall 21 around a wall surface of the toilet body 2. The water flow is flushed out from the liquid output portion and enters the water mixing chamber 100, and then is sprayed from the jet hole 20. In addition, the non-ceramic jet body 581 and the ceramic wall 21 are fixed sealedly, and the non-ceramic jet body and the liquid delivery joint 57 are also fixed sealedly, so that the water flow will not leak from the position between the non-ceramic jet body 581 and the ceramic wall 21 or the position between the non-ceramic jet body 581 and the liquid delivery joint 57, and the toilet can be operated more stably.

The eighth embodiment of the present disclosure relates to a toilet, including the jet structure according to the first embodiment.

Figure 13:
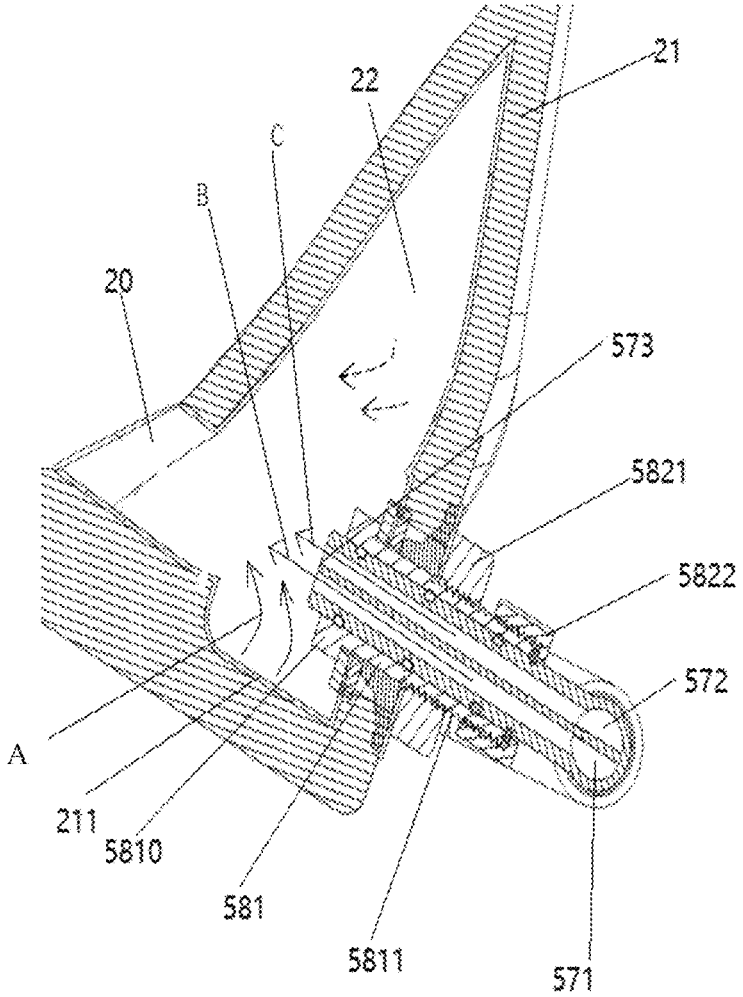
FIG. 13 is a schematic structure view of a jet body mounted on a ceramic wall according to the present disclosure.
Figure 14:
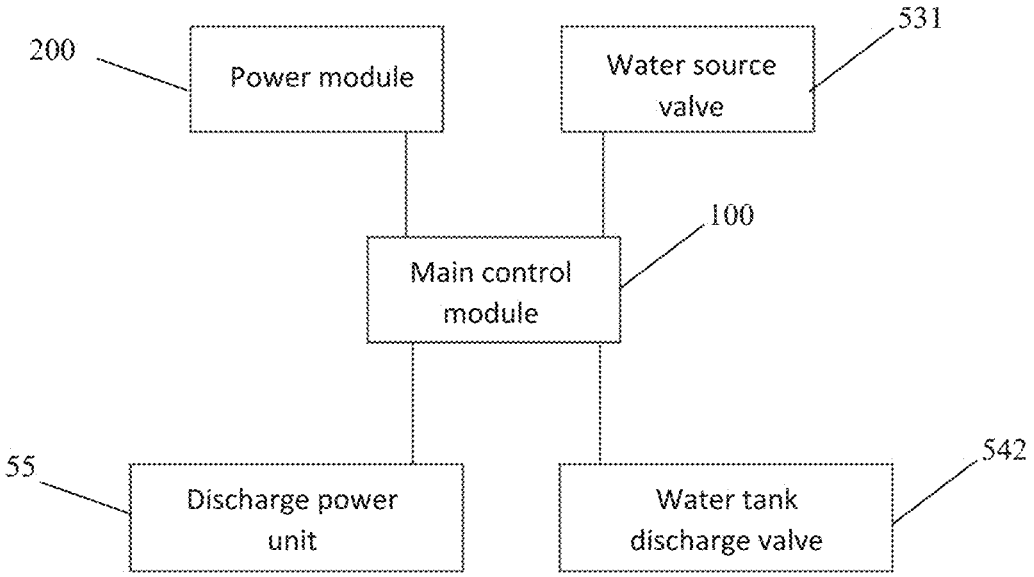
FIG. 14 is a view showing a circuit module of the toilet according to an embodiment of the present disclosure.

Ninth and Tenth Embodiments: Water Supply Mechanism for a Jet Hole and Toilet Thereof FIG. 7 is a schematic view of the internal structure of the toilet according to an embodiment of the present disclosure. FIG. 9 is a section view as taken along line A-A in FIG. 1. FIG. 13 is a schematic structure view of a jet body mounted on a ceramic wall according to the present disclosure. FIG. 14 is a view showing a circuit module of the toilet according to an embodiment of the present disclosure.

The ninth embodiment of the present disclosure relates to a water supply mechanism for a jet hole of a toilet. As shown in FIG. 7, FIG. 9 and FIG. 13, the toilet includes a toilet body 2, and a water tank 1 configured to store flushing water, and the water supply mechanism for the jet hole includes a ceramic wall 21, a water tank discharge valve 542, a gravity discharge channel 51, an acceleration discharge channel 52, a discharge power unit 55 and a water source discharge assembly. The discharge power unit 55 may be a water pump. The ceramic wall 21 is connected with the toilet body 2 of the toilet, and the toilet body 2 is provided with a jet hole 20. The ceramic wall is provided surrounding the periphery of the toilet body 2, and a water mixing cavity 22 is formed in the surrounded region of the toilet body 2. The water tank discharge valve 542 is connected with the water tank 1. The gravity discharge channel 51 is connected with the downstream of the water tank discharge valve 542 and is connected to the water mixing cavity 22 so as to discharge the water flow in the water tank 1 to the water mixing cavity 22 by use of gravity of the water flow after the water tank discharge valve 542 is opened. The acceleration discharge channel 52 is connected with the downstream of the water tank discharge valve 542 and is connected to the water mixing cavity 22 so as to discharge the water flow in the water tank 1 to the water mixing cavity 22 after the water tank discharge valve 542 is opened. The discharge power unit 55 is arranged on the acceleration discharge channel 52 to supply power for discharging the water flow in the acceleration discharge channel 52 into the water mixing cavity 22. The water source discharge assembly is communicated with an external water source and is connected to the water mixing cavity 22 to discharge the water flow in the external water source to the water mixing cavity 22.

In view of the above contents, it can be seen that, the ceramic wall 21, the water tank discharge valve 542, the gravity discharge channel 51, the acceleration discharge channel 52, the discharge power unit 55 and the water source discharge assembly are arranged. The ceramic wall 21 is connected with the periphery of the jet hole 20 of the toilet body 2 to form the water mixing cavity 22. The water tank discharge valve 542 is connected with the water tank 1, the water tank discharge valve 542 is opened to allow the water flow in the water tank 1 to enter the gravity discharge channel 51 and the acceleration discharge channel 52, which are both connected to the water mixing cavity 22, so that the water in the water tank 1 can enter the water mixing cavity 22. Moreover, the discharge power unit 55 is arranged on the acceleration discharge channel 52 to accelerate the water flow in the acceleration discharge channel 52, so that the water in the acceleration discharge channel 52 enter the water mixing cavity 22 with an increased speed. Meanwhile, the water source discharge assembly also supplies water from the external water source into the water mixing cavity 22 to mix with the water flows supplied by the gravity discharge channel 51 and the acceleration discharge channel 52, so that the water flow in the water mixing cavity 22 rushes out from the jet hole 20 with strong impulse, and thus the toilet can work stably and meet the requirements for flushing. Moreover, because all of the gravity discharge channel 51, the acceleration discharge channel 52 and the water source discharge assembly supply water to the water mixing cavity 22, the working water flow required by the jet hole 20 is composed of multiple water flows, and the discharge power unit 55 only need to provide power to the water flow in the acceleration discharge channel 52, so that the discharge power unit 55 may have an small output flow, a small size, and a low price, which thereby reduces the cost.

Further, as shown in FIG. 9 and FIG. 13, an arrow A in FIG. 13 indicates the outflow position of the water flow from the gravity discharge channel. The ceramic wall 21 is provided with a channel opening 211, and the channel opening 211 connects the gravity discharge channel 51 to the water mixing cavity 22.

Moreover, as shown in FIG. 7, FIG. 9 and FIG. 13, the water source discharge assembly includes a water source valve and a water source discharge channel 53. The gravity discharge channel 51 is connected with the water source valve to discharge the water flow to the water mixing cavity 22 after the water source valve is opened.

Moreover, as shown in FIG. 7 and FIG. 9, the gravity discharge channel 51 is a ceramic channel and is integrally formed with the ceramic wall 21.

Moreover, as shown in FIG. 7, FIG. 9, and FIG. 13, an arrow B in FIG. 13 indicates the outflow direction of the water flow from the acceleration discharge channel, and an arrow C indicates the outflow direction of the water flow from the water source discharge channel. An opening communicated with the water mixing cavity 22 is arranged on the ceramic wall 21. The water supply mechanism for the jet hole further includes a liquid delivery joint 57 inserted into the opening. The liquid delivery joint 57 includes a first liquid input end 571 connected with the acceleration discharge channel 52, a second liquid input end 572 connected with the water source discharge channel 53, and a liquid output end 573 communicated with a first liquid inlet and a second liquid inlet. The liquid output end 573 is communicated with the water mixing cavity 22.

Moreover, as shown in FIG. 7, FIG. 9 and FIG. 13, the water supply mechanism for the jet hole further includes a fixing device configured to fix the liquid delivery joint 57 at the opening.

Specifically, as shown in FIG. 7, FIG. 9, and FIG. 13, the fixing device further includes a jet body 581, a connecting assembly and a locking assembly. The jet body 581 passes through the opening, the liquid delivery joint 57 passes through the jet body 581, and the jet body is a non-ceramic piece. The connecting assembly fixes the jet body 581 on the ceramic wall 21, and the locking assembly fixes the liquid delivery joint 57 and the jet body 581 together. A head of the jet body 581 is provided with an abutting portion 5810 abutting against the ceramic wall 21, and a tail of the jet body 581 is provided with an external thread 5811. The connecting assembly includes a nut 5821 engaged with the external thread 5811, which fix the jet body 581 at the opening of the ceramic wall 21 in coordination with the abutting portion 5810. When in use, the jet body 581 is passed through the opening to allow the abutting portion 5810 to abut against the periphery of the opening, and then the nut 5821 is engaged with the external thread 5811 and is screwed to fix the jet body 581 to the ceramic wall 21. The locking assembly includes a joint nut 5822. After the jet body 581 is fixed on the ceramic wall 21, the joint nut 5822 is engaged with the external thread 5811, a portion of the liquid output end of the liquid delivery joint 57 is passed through the jet body 581, and then the joint nut 5822 is screwed so as to fix the non-ceramic jet body 581 and the liquid delivery joint 57 to one another.

Moreover, as shown in FIG. 14, the water supply mechanism 5 for the jet hole further includes a main control module 100 electrically connected with the water tank discharge valve 542, the discharge power unit 55 and the water source valve in the water source discharge assembly, and configured to control the water tank discharge valve 542, the discharge power unit 55 and the water source discharge assembly to be opened or closed. The main control module 100 is further configured to control the discharge power unit 55 and/or the water source discharge assembly to be closed before the water tank discharge valve 542 is closed.

Specifically, as shown in FIG. 7, FIG. 9, and FIG. 14, in actual use, the main control module 100 controls the water tank discharge valve 542, the discharge power unit 55 and the water source valve to be opened, and water in the water tank 1 flows into the gravity discharge channel 51 and the acceleration discharge channel 52. The discharge power unit 55 accelerates the water flow in the acceleration discharge channel 52, so that the water flow entering the first liquid input end 571 of the liquid delivery joint 57 is faster. The water flow of the gravity discharge channel 51 flows into the channel opening 211 on the ceramic wall 21 and enters the water mixing cavity 22. After the water source valve is opened, water in the water source flows into the second liquid input end 572 of the liquid delivery joint 57 from the water source discharge channel 53 and enters the water mixing cavity 22. The water flow in the water source discharge channel 53 and the water flow in the acceleration discharge channel 52 enter the water mixing cavity 22 and drive the water flow from the gravity discharge channel 51 to spray out together from the jet hole, so that the jet force is large. Because of the large impulse of the three water flows, siphon can be achieved in the siphon pipe and the dirt can be discharged instantaneously. When no large amount of water is needed after the siphon and dirt discharging being finished, the main control module 100 controls at least one of the discharge power unit 55 and the water source valve to be closed. At this time, only the water flow in the gravity discharge channel 51 enters the water mixing cavity 22 to form a water-seal surface subsequently, and thus water can be saved.

Further, as shown in FIG. 14, the water supply mechanism for the jet hole further includes a power module 200 electrically connected with the main control module 100 and configured to supply power to the water tank discharge valve 542 and the water source discharge assembly. The power module 200 may be a battery pack, which is a lithium battery or a rechargeable battery, is arranged on the toilet and may be replaced. In case of power failure of an external power supply device, the power module 200 is used as a standby power supply to supply power to the main control module 100, the water tank discharge valve 542 and the water source valve, so that the toilet can operate normally.

The tenth embodiment of the present disclosure relates to a toilet, including the water supply mechanism for the jet hole according to the ninth embodiment.

Figure 15:
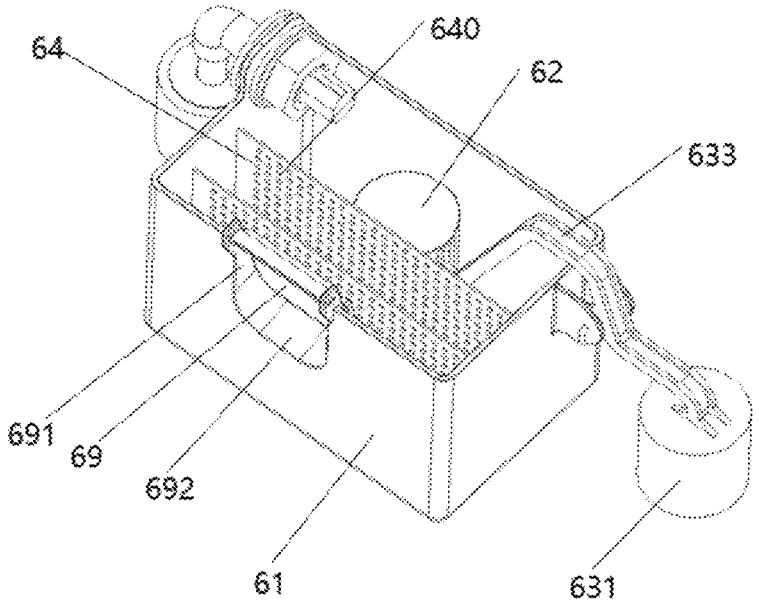
FIG. 15 is a schematic structural view of a medicament dispensing mechanism according to the present disclosure.
Figure 16:
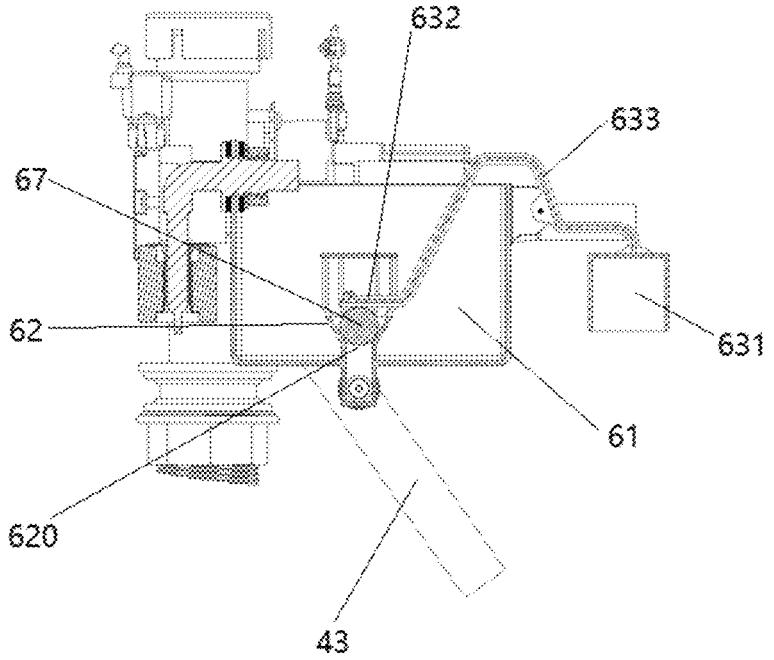
FIG. 16 is a section view as taken along line F-F in FIG. 1 when the water level in a water tank does not reach a preset water level.
Figure 17:
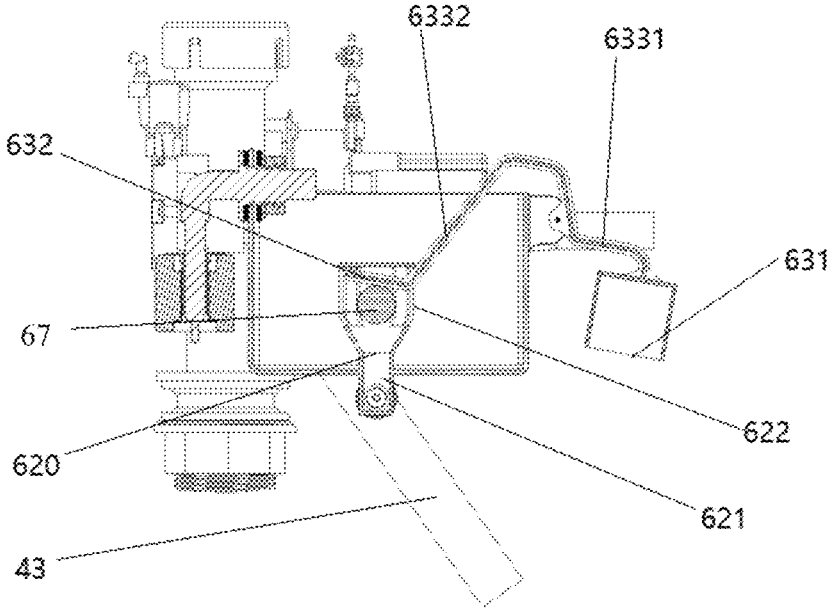
FIG. 17 is a section view as taken along line F-F in FIG. 1 when the water level in the water tank reaches the preset water level.
Figure 18:
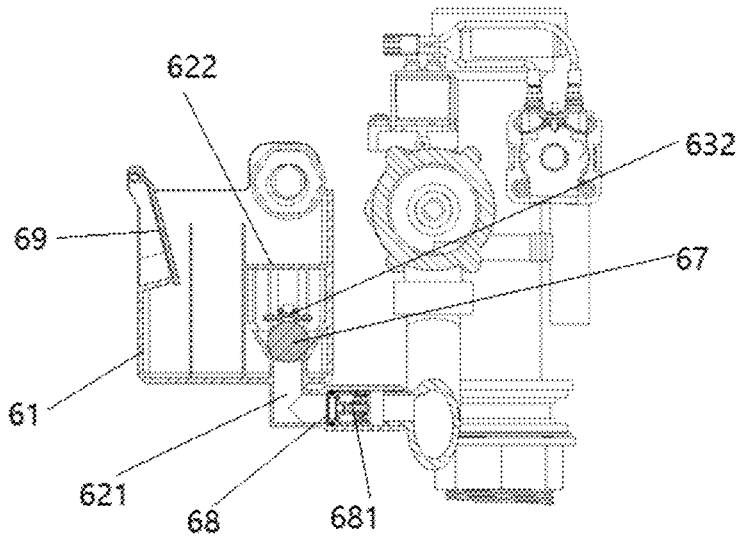
FIG. 18 is a section view as taken along line G-G in FIG. 1 when the water level in the water tank does not reach the preset water level.
Figure 19:
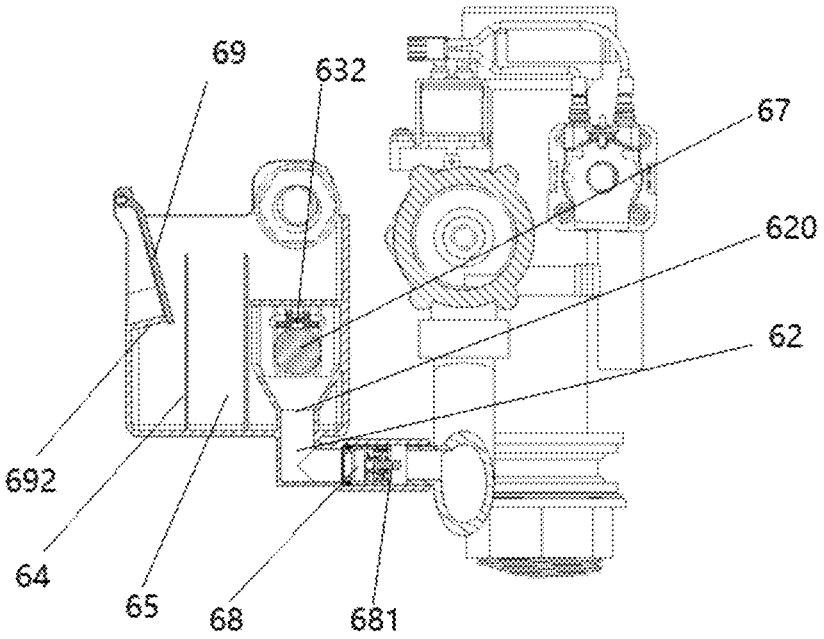
FIG. 19 is a section view as taken along line G-G in FIG. 1 when the water level in the water tank reaches the preset water level.

Eleventh and Twelfth Embodiments: Medicament Dispensing Mechanism and Toilet Thereof FIG. 1 is a top view of the toilet according to the present disclosure. FIG. 2 is a schematic view, which is a section view as taken along line E-E in FIG. 1, of the internal structure of a toilet according to an embodiment of the present disclosure. FIG. 15 is a schematic structural view of a medicament dispensing mechanism according to the present disclosure. FIG. 16 is a section view as taken along line F-F in FIG. 1 when the water level in a water tank does not reach a preset water level. FIG. 17 is a section view as taken along line F-F in FIG. 1 when the water level in the water tank reaches the preset water level. FIG. 18 is a section view as taken along line G-G in FIG. 1 when the water level in the water tank does not reach the preset water level. FIG. 19 is a section view as taken along line G-G in FIG. 1 when the water level in the water tank reaches the preset water level.

The eleventh embodiment of the present disclosure relates to a medicament dispensing mechanism of a toilet. As shown in FIG. 1, FIG. 2, FIG. 15, FIG. 16, FIG. 17, FIG. 18, and FIG. 19, the toilet includes a water tank 1, a toilet body 2, and a water supply mechanism for a bowl rim configured to supply water to the bowl 24 of the toilet body 2. A suction pipe 43 of the water supply mechanism for the bowl rim extends into the water tank 1, and a water pump 42 of the water supply mechanism for the bowl rim provides power to let the suction pipe 43 suck water in the water tank 1. The medicament dispensing mechanism includes a medicament storage box 61, a medicament channel 62 and a channel opening-closing valve. Medicament items are put into the medicament storage box 61 and water is put into the medicament storage box 61 to dissolve the medicament items to form medicament and store it in the medicament storage box 61. The medicament channel 62 is communicated with the medicament storage box 61 and is connected with the suction pipe 43. The channel opening-closing valve is arranged in the water tank 1. When the water in the water tank 1 is sucked away by the suction pipe 43, the water level in the water tank 1 drops. When the water level is lower than the preset water level, the channel opening-closing valve opens the medicament channel 62 to make the medicament channel 62 communicate with the medicament storage box 61. At this time, the medicament in the medicament storage box 61 enters the suction pipe 43 via the medicament channel 62.

As shown in FIG. 15, FIG. 2, FIG. 16 and FIG. 17, the suction pipe 43 sucks the water in the water tank 1 to flush the toilet body 2 and discharge dirt out of the toilet, and then the water in the water tank 1 is sucked by a jet pipe and is sprayed into the siphon pipe of the toilet via a jet hole of the toilet body 2 to achieve siphon. At this time, the water level drops to the preset level, the suction pipe continues to suck water in the water tank 1, and the medicament channel 62 is thus opened by the channel opening-closing valve. The medicament flows through the suction pipe 43, from the bowl rim of the toilet body 2 to the bowl 24, and finally forms a water-seal surface containing the medicament at the bottom of the toilet body 2, so as to keep the inside of the toilet body 2 clean and sanitary.

In view of the above contents, it can be seen that, the medicament storage box 61, the medicament channel 62 and the channel opening-closing valve are provided, the medicament channel 62 is communicated with the medicament storage box 61 and is also connected with the suction pipe 43, and the suction pipe 43 sucks the water flow in the water tank 1 and supplies it to the bowl 24 of the toilet body 2. When the water level in the water tank 1 drops to the preset water level, the channel opening-closing valve opens the medicament channel 62 to make the medicament channel 62 communicate with the medicament storage box 61, the medicament flows into the medicament channel 62 and enters the suction pipe 43 through the medicament channel 62, and thus is supplied to the toilet body 2 together with the water flow sucked by the suction pipe 43 from the water tank 1, so as to flush the toilet body 2. When the suction pipe 43 just starts to suck the water flow in the water tank 1, the water level in the water tank 1 is not lower than the preset water level. Now, the channel opening-closing valve does not open the medicament channel 62, the medicament cannot enter the suction pipe, and the water flushing the toilet body 2 at this time is pure water. As the water in the water tank 1 is sucked away, the water level drops. Only when the water level in the water tank 1 is lower than the preset water level, the medicament enter the suction pipe and enter the toilet body 2 via the bowl rim to form a water-seal surface, to disinfect and clean the toilet body 2. Therefore, it is allowed to use the medicament in the later stage of flushing, instead of the whole process of flushing. Accordingly, the medicament is saved, the service life of the medicament is prolonged, which avoids frequent supplement of the medicament and thus reduces the cost.

Moreover, as shown in FIG. 15, FIG. 2, FIG. 16, and FIG. 17, the medicament channel 62 includes a medicament inlet end 620 communicated with the medicament storage box 61. The channel opening-closing valve includes a floating portion 631, a valve cap 632 and a connecting portion 633. The floating portion 631 is arranged in the water tank 1. The valve cap 632 is configured to open or close the medicament inlet end 620. The connecting portion 633 is connected with the floating portion 631 and the valve cap 632, extends from the water tank 1 to the medicament storage box 61, and is configured to pull the valve cap 632 away from the medicament inlet end 620 when the floating portion 631 is lower than the preset water level.

Further, as shown in FIG. 15, FIG. 2, FIG. 16, and FIG. 17, the connecting portion 633 includes a first lifting rod 6331 and a second lifting rod 6332. The first lifting rod 6331 is coupled to the outer wall of the medicament storage box 61 via a hinge joint, one end of the first lifting rod is connected with the floating portion 631, and the other end of the first lifting rod is connected with the second lifting rod 6332. The first lifting rod 6331 rotates around its hinge joint on the outer wall of the medicament storage box 61. Two ends of the second lifting rod 6332 are respectively connected with the other end of the first lifting rod 6331 and the valve cap 632. The second lifting rod 6332 is configured to drive the valve cap 632 to open or close the medicament inlet end 620 when the first lifting rod 6331 rotates.

Specifically, as shown in FIG. 15, FIG. 2, FIG. 16, and FIG. 17, when the water level in the water tank 1 is higher than the preset water level, the floating portion 631 is lifted by the water flow, and the second lifting rod 6332 is pressed down to abut against the valve cap 632 to close the medicament inlet end 620. When the water level in the water tank 1 drops, floating force acting on the floating portion 631 gradually decreases, so that the floating portion 631 drives the first lifting rod 6331 to rotate clockwise around the hinge joint, and the second lifting rod 6332 is also being driven, that is, in a rising trend. When the water level is lower than the preset water level, the second lifting rod 6332 drives the valve cap 632 to separate from the medicament inlet end 620 completely, and at this time, the medicament in the medicament storage box 61 enters the medicament channel 62. In addition, when water is refilled into the water tank 1, the water flow reaches the floating portion 631. After the floating portion 631 suffers from floating force, the first lifting rod 6331 rotates counterclockwise around the hinge joint, and the valve cap 632 and the second lifting rod 6332 are pushed down by the first lifting rod 6331 until the valve cap 632 closes the medicament inlet end.

Moreover, as shown in FIG. 15, FIG. 2, FIG. 16, and FIG. 17, the medicament channel 62 includes a main pipe 621 and a limiter pipe 622. The main pipe 621 is connected with the suction pipe 43, and the medicament inlet end 620 is arranged on the main pipe 621. The limiter pipe 622 is connected with the inlet end and is configured to be abutted against by the valve cap when the valve cap 632 is pulled to its limiting position by the second lifting rod 6332. The limiter pipe 622 is provided with a water inlet area communicated with the medicament storage box 61. When the water level in the water tank 1 is extremely low, the valve cap 632 will not be lifted by the second lifting rod 6332 without limit and will not be overturned to break away from its running track, so that the valve cap 632 can move in a limited area. When the water level in the water tank 1 rises and floating force is acted on the floating portion 631, the second lifting rod 6332 can drive the valve cap 632 to continuously close the medicament inlet end 620.

Further, as shown in FIG. 15, FIG. 2, FIG. 16, and FIG. 17, the medicament dispensing mechanism further includes a floating ball 67, which is movably arranged in the limiter pipe 622, located at the side of the valve cap 632 facing the medicament inlet end 620 and is configured to block the medicament inlet end 620. Therefore, when the medicament in the medicament storage box 61 is completely discharged, the floating ball 67 falls down to close the medicament inlet end 620, which avoids external air from being introduced into a waterway of the water supply mechanism for the bowl rim, especially in this embodiment, which thus prevents the air from entering the water pump 42 and ensures working efficiency of the water pump 42.

Moreover, as shown in FIG. 15, FIG. 2, FIG. 16, and FIG. 17, a maximum sectional area of the floating ball 67 is larger than the area of the medicament inlet end 620. Therefore, the floating ball 67 can completely seal the medicament inlet end 620 after falling. In this embodiment, the limiter pipe 622 includes a tapered portion, the pipe diameter of which gradually decreases toward the medicament inlet end 620, and the tapered portion is connected with the medicament inlet end 620. Therefore, the floating ball 67 slides along the wall surface of the tapered portion when falling, and can thus accurately close the medicament inlet end 620.

Further, as shown in FIG. 15, FIG. 2, FIG. 18, and FIG. 19, the suction pipe 43 includes a suction port extending into the water tank 1, wherein the diameter of the suction port of the suction pipe 43 is smaller than the inner diameter of the suction pipe 43. A damper valve 68 is arranged in the main pipe 621. After the channel opening-closing valve opens the medicament inlet end 20, the water pump 42 works, and the suction pipe 43 sucks the water in the water tank 1. Since the diameter of the suction port of the suction pipe 43 is smaller than the inner diameter of the suction pipe 43, a negative pressure will be generated in the suction pipe 43, which pulls a spring member 681 in the damper valve 68 to open the damper valve 68 and make the medicament channel 62 unobstructed. When the channel opening-closing valve closes the medicament inlet end 620, the damper valve 68 further blocks the medicament channel 62 to prevent the medicament from leaking from the medicament inlet end 620 into the suction pipe 43. Meanwhile, when the suction pipe 43 does not suck the water in the water tank 1, which means there is no need for the medicament to enter the toilet body 2 at this time, even if the water level in the water tank 1 is below the preset water level and the medicament inlet end 620 is opened, there will be no negative pressure in the suction pipe 43 and the damper valve 68 will not be opened, and thus the medicament will not enter the suction pipe 43 and there is no waste.

Further, as shown in FIG. 15, FIG. 18, and FIG. 19, the medicament storage box 61 is further provided with an isolating element 64 therein, in the isolating element 64 is provided an isolation area 65 configured to place medicament items, and the isolating element 64 is provided with a plurality of leakage holes 640 communicated with the isolation area 65. Therefore, the water flow is allowed to enter the isolation area 65 through the leakage holes 640 to dissolve the medicament items, and drifting of medicament item residues is avoided, which help to form a standard material distribution and avoid from affecting other components.

Moreover, as shown in FIG. 15, FIG. 18, and FIG. 19, a side wall of the medicament storage box 61 is provided with an opening for the water flow in the water tank 1 to enter the medicament storage box 61; and the medicament storage box 61 is provided with a door plate 69 configured to close the opening.

Specifically, as shown in FIG. 15, FIG. 18, and FIG. 19, the upper end of the door plate 69 is coupled through a hinge joint to the side wall that is provided with the opening. The door plate 69 is configured to, when the opening is closed, abut against the periphery of the opening, and is inclined, from top to bottom, towards the inside of the medicament storage box 61. Two side baffles 53 extending into the water tank 1 are arranged along the lateral sides of the opening. The edge of the side baffle 691 departing from the opening is inclined, that is, the distance between the edge of the side baffle 691 and the bottom of the opening is greater than the distance between the edge of the side baffle 691 and the top of the opening. A supporting plate 692 extending into the water tank 1 is arranged at the bottom of the opening. The supporting plate 692 is connected with the two side baffles 53. When closing the opening, the door plate 59 abuts against the two side baffles 53 and the supporting plate 692. When the water in the water tank 1 reaches a certain amount, the door plate 69 can be pushed open, and the water flow can enter the medicament storage box 61 to dissolve the medicaments items. When the water in the medicament storage box 61 reaches a certain amount, the door plate 69 is pushed to continue to close the opening. Therefore, water can automatically enter the medicament storage box 61.

The twelfth embodiment of the present disclosure relates to a toilet, including a water tank, a toilet body, a water supply mechanism for a bowl rim configured to supply water to a bowl of the toilet body, and the medicament dispensing mechanism according to the eleventh embodiment. A suction pipe of the water supply mechanism for the bowl rim extends into the water tank to suck water in the water tank.

It is not difficult to find that this embodiment is a system embodiment corresponding to the eleventh embodiment, and this embodiment may be implemented in cooperation with the eleventh embodiment. Relevant technical details mentioned in the eleventh embodiment are still applicable in this embodiment, and thus will not be repeatedly described herein. Accordingly, related technical details mentioned in this embodiment may also be applied to the eleventh embodiment.

Figure 20:
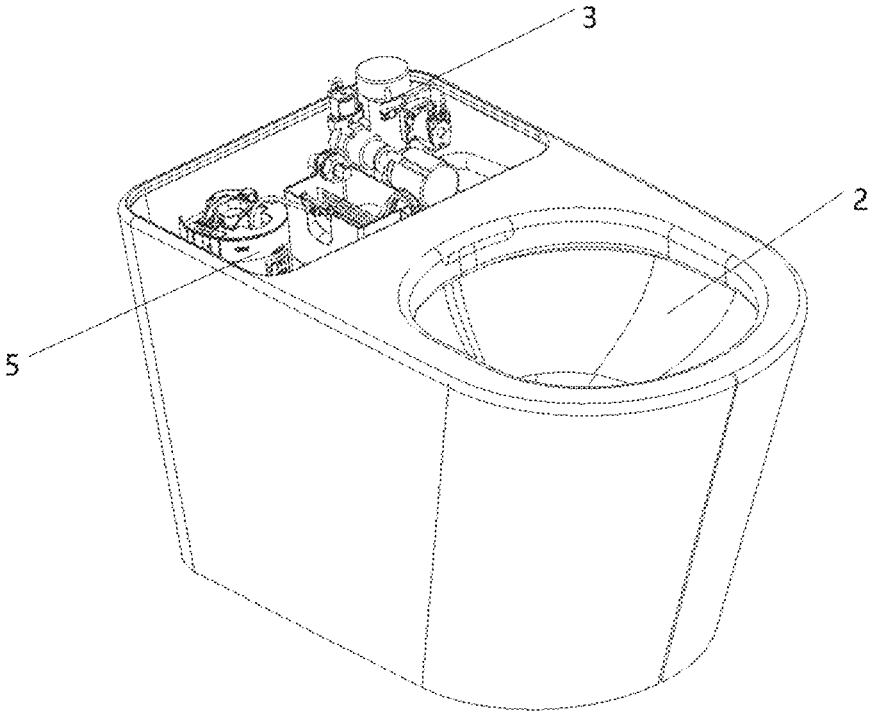
FIG. 20 is a perspective view of a toilet according to the present disclosure.
Figure 21:
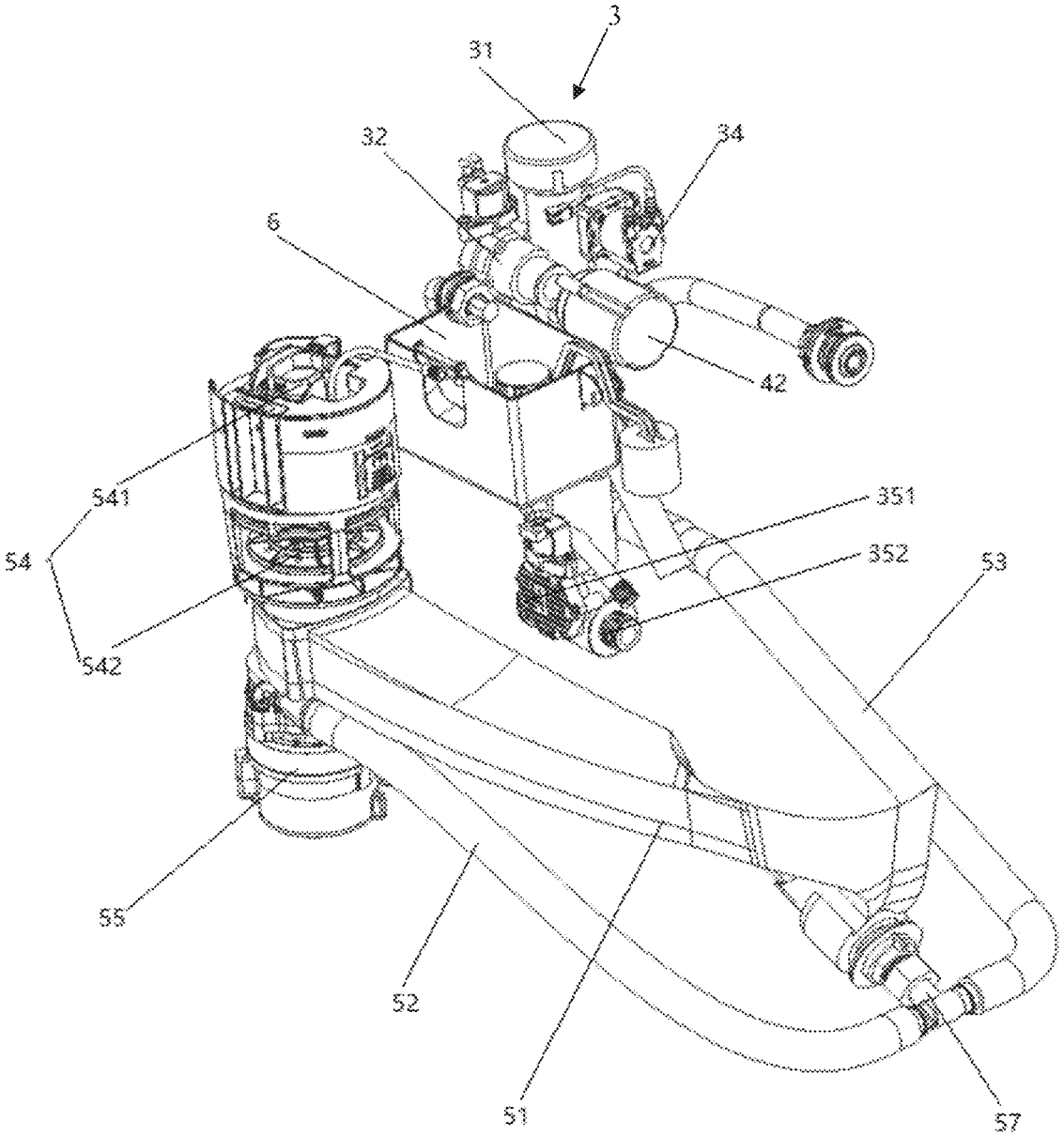
FIG. 21 is a schematic view of the internal structure of the toilet according to the present disclosure.
Figure 22:
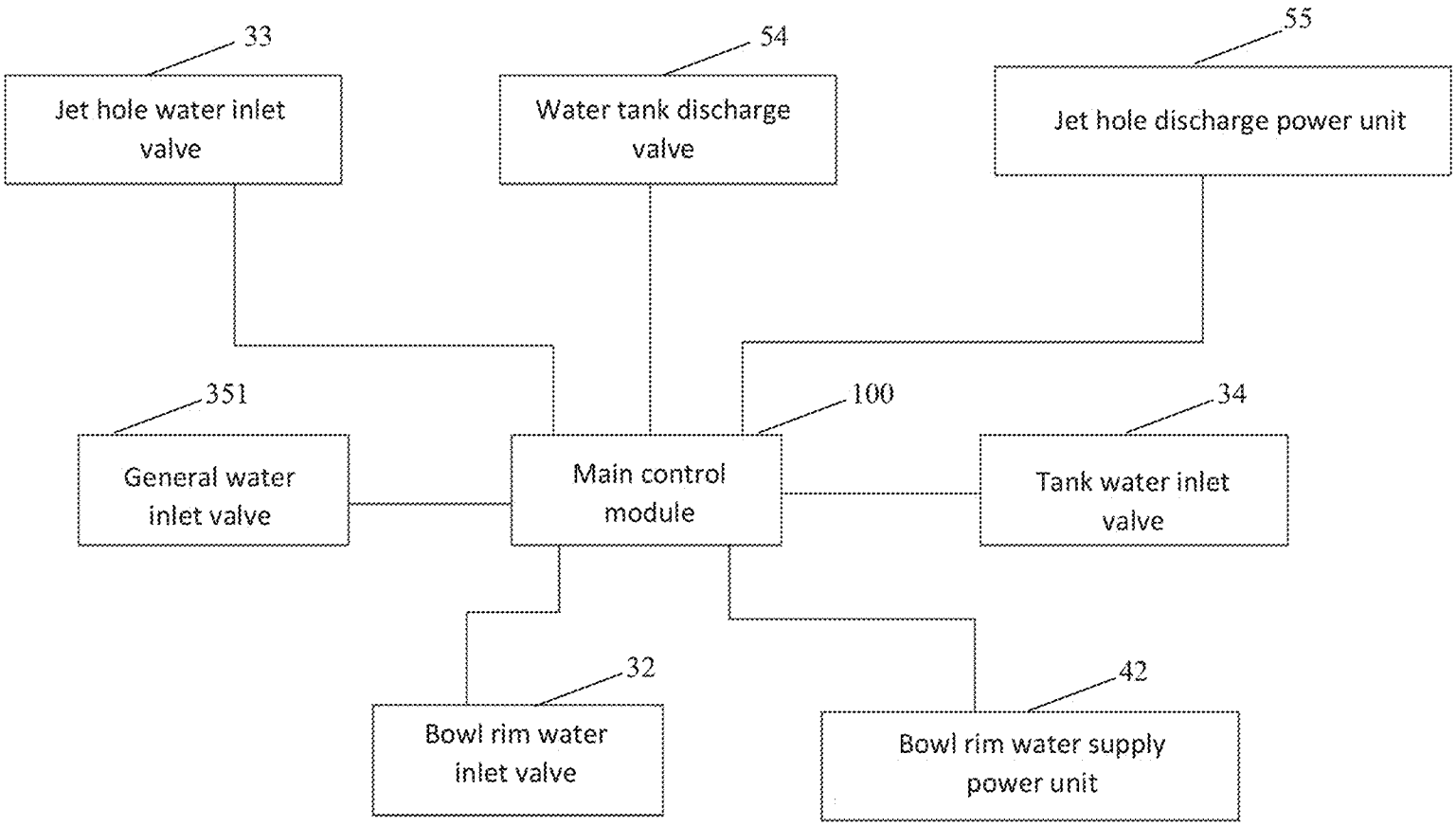
FIG. 22 is a circuit module view of the toilet according to the present disclosure.
Figure 23:
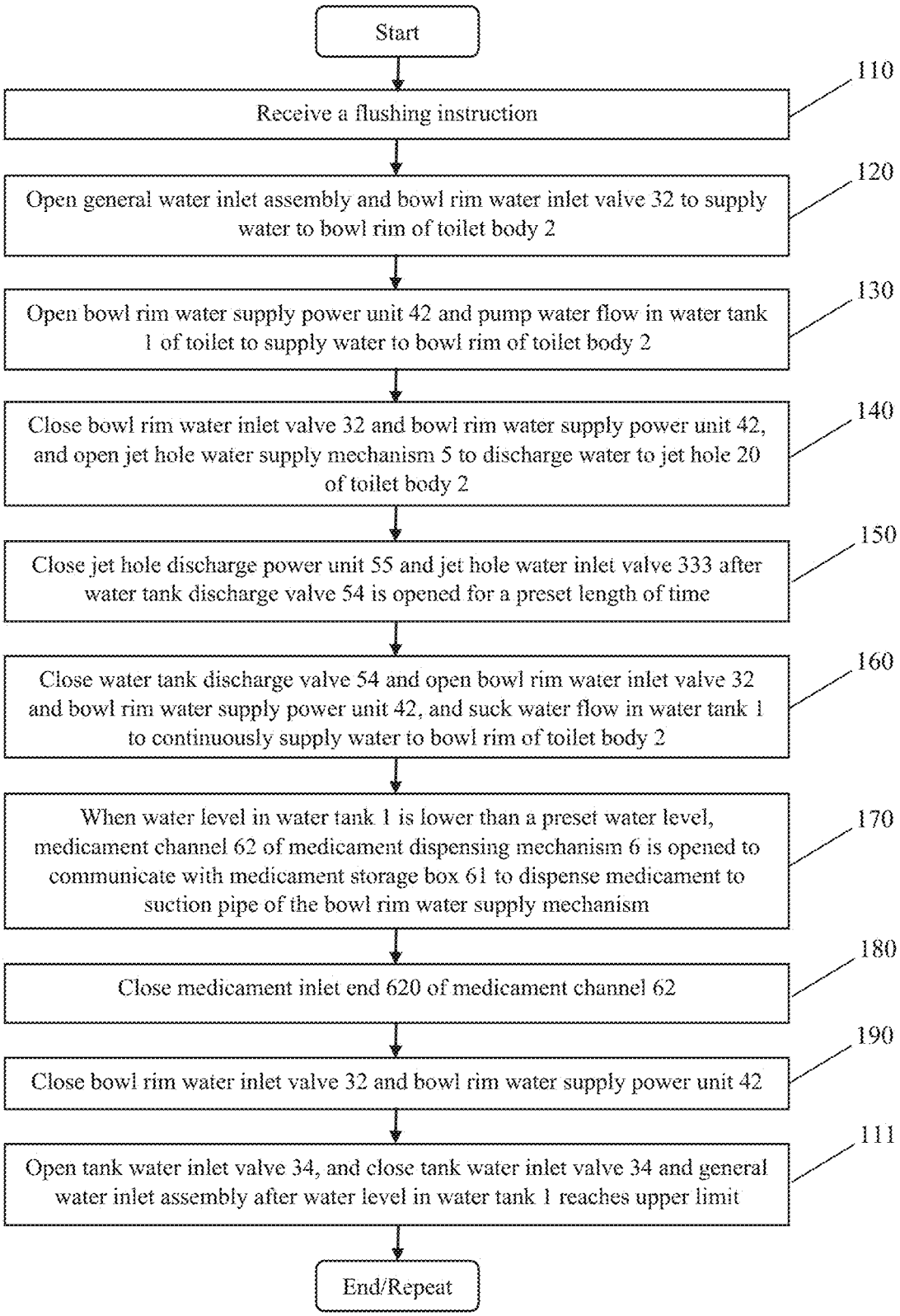
FIG. 23 is a flow chart of a method for flushing a toilet according to the present disclosure.

Thirteenth and Fourteenth Embodiments: Toilet and Method for Flushing the Toilet FIG. 1 is a top view of the toilet according to the present disclosure. FIG. 2 is a schematic view, which is a section view as taken along line E-E in FIG. 1, of the internal structure of a toilet according to an embodiment of the present disclosure. FIG. 4 is a section view as taken along line C-C in FIG. 1. FIG. 6 is a section view as taken along line D-D in FIG. 1. FIG. 8 is a section view as taken along line B-B in FIG. 1. FIG. 9 is a section view as taken along line A-A in FIG. 1. FIG. 13 is a schematic structure view of a jet body mounted on a ceramic wall according to the present disclosure. FIG. 15 is a schematic structural view of a medicament dispensing mechanism according to the present disclosure. FIG. 16 is a section view as taken along line F-F in FIG. 1 when the water level in a water tank does not reach a preset water level. FIG. 17 is a section view as taken along line F-F in FIG. 1 when the water level in the water tank reaches the preset water level. FIG. 18 is a section view as taken along line G-G in FIG. 1 when the water level in the water tank does not reach the preset water level. FIG. 19 is a section view as taken along line G-G in FIG. 1 when the water level in the water tank reaches the preset water level. FIG. 20 is a perspective view of a toilet according to the present disclosure. FIG. 21 is a schematic view of the internal structure of the toilet according to the present disclosure. FIG. 22 is a circuit module view of the toilet according to the present disclosure. FIG. 23 is a flow chart of a method for flushing a toilet according to the present disclosure.

The thirteenth embodiment of the present disclosure relates to a toilet, as shown in FIG. 20, FIG. 21, FIG. 1, and FIG. 9, including: a toilet body 2 configured to receive sewage and a water tank 1 configured to store flushing water. The toilet further includes a main control module 100, a general water inlet mechanism 3 communicated with a water source, a bowl rim water supply mechanism and a jet hole water supply mechanism 5, both communicated with the general water inlet mechanism 3. A jet hole 20 is arranged on the toilet body 2. The toilet further includes a ceramic wall 21 surrounding the jet hole 20 and connected with the toilet body 2, wherein a water mixing cavity 22 is formed in the surrounded region of the toilet body 2.

As shown in FIG. 20, FIG. 21, FIG. 1, FIG. 4, FIG. 6, and FIG. 9, the general water inlet mechanism 3 includes a vacuum breaker 31, a general water inlet assembly configured to allow or block communication between the vacuum breaker 31 and the water source, a bowl rim water inlet valve 32 configured to allow or block communication between the vacuum breaker 31 and the bowl rim water supply mechanism, a jet hole water inlet valve 33 configured to allow or block communication between the vacuum breaker 31 and the jet hole water supply mechanism 5, and a tank water inlet valve 34 configured to allow or block communication between the vacuum breaker 31 and the water tank 1. As shown in FIG. 21 and FIG. 2, the bowl rim water supply mechanism includes a bowl rim connecting pipe 41 connected with the bowl rim water inlet valve 32, a bowl rim water supply power unit 42 communicated with the bowl rim connecting pipe 41, a suction pipe 43 connected with the bowl rim water supply power unit 42 and at least partially extending into the water tank 1, and a bowl rim power outlet pipe 44 communicated with a water outlet of the bowl rim water supply power unit 42 and a channel at the bowl margin of the toilet body 2. As shown in FIG. 21, FIG. 9 and FIG. 13, the bowl rim water supply power unit 42 may be a water pump.

Further, the jet hole water supply mechanism 5 includes a gravity discharge channel 51, an acceleration discharge channel 52 and a water source discharge channel 53, all communicated with the water mixing cavity 22, a water tank discharge valve 54 connected with the water tank 1, and a jet hole discharge power unit 55 arranged on the acceleration discharge channel 52, wherein the jet hole discharge power unit 55 is a water pump. The gravity discharge channel 51 and the acceleration discharge channel 52 are configured to discharge a water flow from the water tank 1 to the water mixing cavity 22 after the water tank discharge valve 54 is opened; and the water source discharge channel 53 is configured to discharge the water flow in the vacuum breaker 31 to the water mixing cavity 22 after the jet hole water inlet valve 33 is opened.

As shown in FIG. 22, the main control module 100 is electrically connected with the general water inlet assembly, the bowl rim water inlet valve 32, the jet hole water inlet valve 33, the tank water inlet valve 34, the water tank discharge valve 54, the bowl rim water supply power unit 42 and the jet hole discharge power unit 55; and is configured to control the general water inlet assembly and the bowl rim water inlet valve 32 to open and supply water to the bowl rim of the toilet body 2; and is further configured to open the bowl rim water supply power unit 42 and suck the water flow in the water tank 1 of the toilet through the suction pipe after a first preset length of time; and is further configured to, when the bowl rim water supply power unit 42 has been opened for a second length of time, close the bowl rim water inlet valve 32 and the bowl rim water supply power unit 42, and simultaneously open the water tank discharge valve 54, the jet hole discharge power unit 55 and the jet hole water inlet valve 33 to discharge water to the jet hole 20 of the toilet body 2.

In view of the above contents, it can be seen that the general water inlet mechanism 3 includes the vacuum breaker 31, the general water inlet assembly, the bowl rim water inlet valve 32, the jet hole water inlet valve 33, and the tank water inlet valve 34. The main control module 100 controls the general water inlet assembly to open, and then the water of the water source enters the vacuum breaker 31. The bowl rim water supply mechanism includes the bowl rim connecting pipe 41, the bowl rim water supply power unit 42, the suction pipe 43, and the bowl rim power outlet pipe 44, the main control module 100 opens the bowl rim water inlet valve 32, then the water flow enters the bowl rim connecting pipe 41 from the vacuum breaker 31, and meanwhile, the main control module 100 controls the bowl rim water supply power unit 42 to open to provide power for the water flow entered the bowl rim connecting pipe 41 from the vacuum breaker 31, then the pressure of the water flow is increased and the water flow enters the bowl rim power outlet pipe 44. Meanwhile, the bowl rim water supply power unit 42 provides a suction force to the water flow in the water tank 1 to let the suction pipe 43 suck the water in the water tank 1, and then the water flow in the water tank 1 enters the bowl rim power outlet pipe 44 from the suction pipe 43. Therefore, the two water flows flow to the bowl margin of the toilet body 2, so that the water flow for flushing the toilet body 2 increases, the pressure of the water flow also increases, and the impact force of the water flow increases, thus ensuring sufficient water pressure to supply water to the bowl rim of the toilet body 2. Therefore, the toilet can be flushed with a sufficient water pressure in different situations, and the toilet can be operated normally and be flushed cleanly.

Moreover, the jet hole water supply mechanism 5 includes the gravity discharge channel 51, the acceleration discharge channel 52 and the water source discharge channel 53 as well as the water tank discharge valve 54 and the jet hole discharge power unit 55. When the main control module 100 opens the jet hole water inlet valve 33, the water flow in the vacuum breaker 31 enters the water source discharge channel 53 and flows into the water mixing cavity 22. The main control module 100 opens the water tank discharge valve 54, the water flow in the water tank 1 enters the gravity discharge channel 51 and the acceleration discharge channel 52, which are in turn connected into the water mixing cavity 22, so that the water in the water tank 1 enters the water mixing cavity 22. Moreover, the jet hole discharge power unit 55 is arranged on the acceleration discharge channel 52 to accelerate the water flow in the acceleration discharge channel 52, so that the water in the acceleration discharge channel 52 enters the water mixing cavity 22 in an increased speed. In the water mixing cavity 22, the water flows from the gravity discharge channel 51, the acceleration discharge channel 52 and the water source discharge channel 53 are mixed, so that the water flow in the water mixing cavity 22 rushes out from the jet hole 20 with strong impulse, so that the toilet can work stably and meet the requirements for flushing. Therefore, the toilet can be flushed with a sufficient water pressure in different situations, and the toilet can be operated normally and be flushed cleanly.

Moreover, as shown in FIG. 1, FIG. 4, and FIG. 6, arrows in the figures indicate inlet directions of the water flows. The vacuum breaker 31 includes an inner cavity pipe 312 provided with an upstream chamber 311, an outer cavity pipe 313 arranged around the inner cavity pipe 312, and a chamber valve 314 for allowing or blocking communication between the inner cavity pipe 312 and the outer cavity pipe 313. The inner cavity pipe 312 and the outer cavity pipe 313 are separated from each other to form a downstream chamber 315, and the downstream chamber 315 is configured to communicate with the upstream chamber 311 when the chamber valve 314 is opened. The general water inlet assembly is connected with the inner cavity pipe 312 and configured to allow or block communication between the upstream chamber 311 and the water source. The bowl rim water inlet valve 32 and the jet hole water inlet valve 33 are both connected with the outer cavity pipe 313. The bowl rim water inlet valve 32 is configured to allow or block communication between the downstream chamber 315 and the bowl rim connecting pipe 41. The jet hole water inlet valve 33 is configured to allow or block communication between the downstream chamber 315 and the water source discharge channel 53.

Moreover, as shown in FIG. 1, FIG. 4 and FIG. 6, the inner cavity pipe 312 includes, from bottom to top, a liquid inlet 3110 abutting against the general water inlet assembly and a liquid outlet 3150 arranged opposite to the liquid inlet 3110, wherein both the liquid inlet 3110 of the inner cavity pipe 312 and the liquid outlet 3150 of the inner cavity pipe 312 are communicated with the upstream chamber; and the chamber valve 314 is arranged at the liquid outlet 3150 of the inner cavity pipe 312. A ventilation cavity is further arranged in the vacuum breaker 31. The ventilation cavity is located above the upstream chamber 311. When the toilet is not in use, and a negative pressure exists at the liquid inlet 3110, an air flow will enter the ventilation cavity to press against the chamber valve 314 to make the chamber valve 314 seal the liquid inlet 3110, so that dirty water in the toilet cannot enter the upstream chamber 311, and thus cannot enter the domestic water supply pipeline, so that the dirty water in the toilet is insulated from the domestic water supply pipeline. After the general water inlet assembly is conducted, the water flow enters the upstream chamber 311. The water flow has impact force and can flow upwards to open the chamber valve 314 by impact, such that the water flow can enter the downstream chamber 315 to become water for flushing the toilet.

In this embodiment, as shown in FIG. 21, FIG. 1, FIG. 4 and FIG. 6, the general water inlet assembly includes a general water inlet valve 351 electrically connected with the main control module 100 and is connected with the liquid inlet 3110. When the general water inlet valve 351 is opened, the water flow may enter the upstream chamber 311 to open the chamber valve 314 by impact and flow into the downstream chamber 315. The general water inlet assembly further includes a filtering module 352 connected with the general water inlet valve 351 and communicated with the water source. The water source may be an interface to the water supply pipeline, which is connected with the filtering module 352 through a pipe, and the filtering module 352 may be a filtering joint with a filter element arranged inside. The filtering module 352 is communicated with the general water inlet valve 351. After the general water inlet valve 351 is opened, the water flow passes through the filtering module 352 and the general water inlet valve 351 in turn, and enters the upstream chamber 311 to open the chamber valve 314 by impact and flows into the downstream chamber 315.

Further, as shown in FIG. 1, FIG. 4 and FIG. 6, a bracket 23 for installing the vacuum breaker 31 is arranged in the toilet. The vacuum breaker 31 includes an upper valve body, a general connecting assembly, a lower valve body and a general locking assembly. The upper valve body partially penetrates through the bracket 23, and the liquid outlet 3150 is arranged on the upper valve body. Moreover, the upper valve body includes a part of the inner cavity pipe 312 and a part of the outer cavity pipe 313. The general connecting assembly is configured to fix the upper valve body on the bracket 23. The lower valve body and the upper valve body are in butt joint, and the liquid inlet 3110 is arranged on the lower valve body. Moreover, the lower valve body includes another part of the inner cavity pipe 312 and another part of the outer cavity pipe 313. The general locking assembly is configured to fix the upper valve body with the lower valve body to one another.

Further, as shown in FIG. 1, FIG. 4 and FIG. 6, the outer cavity pipe 313 of the upper valve body is provided with an abutting portion 3130 abutting against the side of the bracket 23 facing the liquid outlet 3150, and the side of the outer cavity pipe 313 of the upper valve body facing the liquid inlet 3110 is provided with an external thread 316. The connecting assembly includes a nut 317 engaged with the external thread 316 and configured to fix the upper valve body on the bracket 23 in coordination with the abutting portion 3130. A sealing gasket may also be arranged between the abutting portion 3130 and the bracket 23, and is sleeved on the outer cavity pipe 313 of the upper valve body, so that the abutting portion 3130 can be abutted sealedly against the bracket 23. Moreover, a sealing ring is also sleeved on the outer cavity pipe 313 of the upper valve body, so that the upper valve body are fixed more tightly on the bracket 23.

Further, as shown in FIG. 1, FIG. 4 and FIG. 6, the general locking assembly includes a union nut 318 that can be engaged with the external thread 316 and configured to fix the outer cavity pipe 313 of the upper valve body to the outer cavity pipe 313 of the lower valve body.

Moreover, as shown in FIG. 4 and FIG. 6, the outer cavity pipe 313 of the lower valve body includes an insertion portion 3131 inserted into the downstream chamber 315 of the upper valve body, and the insertion portion 3131 abuts against an inner wall of the outer cavity pipe 313 of the upper valve body. The inner cavity pipe 312 of the lower valve body abuts against the inner cavity pipe 312 of the upper valve body. The locking assembly further includes at least one sealing ring sleeved on the insertion portion and abutting against the inner wall of the outer cavity pipe 313 of the upper valve body.

Specifically, as shown in FIG. 4 and FIG. 6, the upper valve body partially penetrates through the bracket 23, and the abutting portion 3130 abuts against the side of the bracket 23 facing the liquid outlet 3150. The nut 317 is engaged with the external thread 316, and the nut 317 is screwed to abut against the side of the bracket 23 facing the liquid inlet 3110, thereby fixing the upper valve body on the bracket 23. Meanwhile, the union nut 318 is engaged with the external thread 316 of the upper valve body, and then the lower valve body and the upper valve body are mounted together. The sealing ring is sleeved on the insertion portion 3131. The insertion portion 3131 is inserted into the downstream chamber 315 of the upper valve body, clinging to the inner wall of the outer cavity pipe 313 of the upper valve body. Combined with the arrangement of the sealing, the sealing performance between the insertion portion 3131 and the inner wall of the outer cavity pipe 313 of the upper valve body is improved. Therefore, the downstream chamber 315 of the upper valve body is abuted against and communicated with the downstream chamber 315 of the lower valve body, and the water flow will not flow out between the insertion portion 3131 and the inner wall of the outer cavity pipe 313 of the upper valve body. At this time, the inner cavity pipe 312 of the lower valve body abuts against the inner cavity pipe 312 of the upper valve body, and the sealing gasket may also be a sealing ring to seal, between the inner cavity pipe 312 of the lower valve body and the inner cavity pipe 312 of the upper valve body, the position where the inner cavity pipe 312 of the lower valve body abuts against the inner cavity pipe 312 of the upper valve body, so that the upstream chamber 311 of the upper valve body is communicated with the upstream chamber 311 of the lower valve body to form the whole upstream chamber 311, and the water flow will not seep out from the position where the inner cavity pipe 312 of the lower valve body abuts against the inner cavity pipe 312 of the upper valve body. The union nut 318 is screwed to fix the lower valve body together with the upper valve body. Therefore, the vacuum breaker 31 is mounted and fixed.

Moreover, as shown in FIG. 2, the bowl rim water supply mechanism further includes: a one-way valve 45 arranged on the suction pipe 43 and configured to prevent the water flow from entering the water tank 1 via the suction pipe 43.

Further, as shown in FIG. 21 and FIG. 8, the water tank discharge valve 54 includes a water tank vacuum breaker 541 arranged in the water tank 1 and a valve body 542 connected with the water tank vacuum breaker 541. Moreover, the water tank vacuum breaker 541 is configured to make the valve body 542 communicate with the air. The valve body 542 is configured to discharge water in the water tank 1 to the gravity discharge channel 51 and the acceleration discharge channel 52 after being opened; and is further configured to seal the water in the water tank 1 after being closed.

Moreover, as shown in FIG. 21 and FIG. 8, the jet hole water supply mechanism 5 further includes a jet connecting pipe 59 connected with the water tank discharge valve 54, wherein the jet connecting pipe 59 is communicated with the gravity discharge channel 51. The jet hole discharge power unit 55 includes a suction joint 551 and a pump body 552. The suction joint 551 is provided with a power suction port 430 communicated with the jet connecting pipe 59. The pump body 552 is connected with the suction joint 551 and provided with a power water outlet communicated with the acceleration discharge channel 52. The pump body 552 is configured to suck a portion of the water flow passing through the water tank discharge valve 54 and convey the portion of water flow to the acceleration discharge channel 52 through the power water outlet.

Moreover, as shown in FIG. 8, the jet hole water supply mechanism 5 further includes a jet locking assembly configured to lock the suction joint 551 on the pipe wall of the jet connecting pipe 59. Specifically, an outer surface of the suction joint 551 is provided with an external thread 561. The pipe wall of the jet connecting pipe 59 is provided with an opening for the suction joint 551 to pass through. The side of the suction joint 551 facing the pump body 552 is provided with a bulge 5510, and the bulge 5510 is configured to support the pipe wall 591 of the jet connecting pipe 59. The jet locking assembly includes a nut 562 being able to engage with the external thread 561 and fix the suction joint 551 in the opening in cooperation with the bulge 5510. During the installation process, the suction joint 551 is passed through the opening, and then the nut 562 is engaged with the external thread 561, and the suction joint 551 is secured on the pipe wall 591 of the jet connecting pipe 59 by screwing the nut 562.

Moreover, as shown in FIG. 13, an opening communicated with the water mixing cavity 22 is arranged on the ceramic wall 21. The jet hole water supply mechanism 5 further includes a liquid delivery joint 57 inserted into the opening. The liquid delivery joint 57 includes a first liquid input end 571 connected with the acceleration discharge channel 52, a second liquid input end 572 connected with the water source discharge channel 53, and a liquid output end 573 communicated with a first liquid inlet 3110 and a second liquid inlet 3110, wherein the liquid output end 573 is communicated with the water mixing cavity 22.

Further, as shown in FIG. 13, the jet hole water supply mechanism 5 further includes a fixing device configured to fix the liquid delivery joint 57 at the opening.

Moreover, as shown in FIG. 13, the fixing device includes a jet body 581, a jet connecting assembly and a joint locking assembly. The jet body 581 passes through the opening, and the liquid delivery joint 57 passes through the jet body 581. The jet connecting assembly is configured to fix the jet body 581 on the ceramic wall 21. The joint locking assembly is configured to fix the liquid delivery joint 57 and the jet body 581.

Moreover, as shown in FIG. 9 and FIG. 13, the jet body 581 is a non-ceramic jet body 581. A head of the jet body 581 is provided with an abutting portion 5810 abutting against the ceramic wall 21, and a tail of the jet body 581 is provided with an external thread 5811. The jet connecting assembly includes a nut 5821 engaged with the external thread 5811, which fixes the jet body 581 at the opening of the ceramic wall 21 in coordination with the abutting portion 5810. When in use, the jet body 581 is passed through the opening to allow the abutting portion 5810 to abut against the periphery of the opening, and then the nut 5821 is engaged with the external thread 5811 and is screwed to fix the jet body 581 to the ceramic wall 21. The joint locking assembly includes a joint nut 5822. After the jet body 581 is fixed on the ceramic wall 21, the joint nut 5822 is engaged with the external thread 5811, a portion of the liquid outlet portion of the liquid delivery joint 57 is passed through the jet body 581, and the joint nut 5822 is screwed so as to fix the non-ceramic jet body 581 and the liquid delivery joint 57 to one another.

Further, as shown in FIG. 13, the ceramic wall 21 is further provided with a channel opening 211, and the channel opening 211 connects the gravity discharge channel 51 to the water mixing cavity 22. In FIG. 13, an arrow A indicates the outflow position of the water flow from the gravity discharge channel, an arrow B indicates the outflow direction of the water flow from the acceleration discharge channel, and an arrow C indicates the outflow direction of the water from the water source discharge channel.

Moreover, as shown in the above figures, the toilet further includes a medicament dispensing mechanism 6. The medicament dispensing mechanism 6 includes a medicament storage box 61, a medicament channel and a channel opening-closing valve. The medicament storage box 61 is configured to store medicament items. The medicament channel 62 is communicated with the medicament storage box 61 and is connected with the suction pipe 43. The channel opening-closing valve is arranged in the water tank 1 and configured to make the medicament channel 62 communicate with the medicament storage box 61 when a water level in the water tank 1 is lower than a preset water level. output Further, as shown in FIG. 15, FIG. 16, FIG. 17, FIG. 18, and FIG. 19, the medicament channel 62 includes a medicament inlet end 620 communicated with the medicament storage box 61. The channel opening-closing valve includes a floating portion 631, a valve cap 632, and a connecting portion 633, wherein the floating portion 631 is arranged in the water tank, and the valve cap 632 opens or closes the medicament inlet end 620. The connecting portion 633 is connected with the floating portion 631 and the valve cap 632 and extends from the water tank 1 to the medicament storage box 61; and is configured to pull the valve cap 632 away from the medicament inlet end 620 when the floating portion 631 is lower than the preset water level.

Moreover, as shown in FIG. 15, FIG. 16, FIG. 17, FIG. 18, and FIG. 19, the connecting portion 633 includes a first lifting rod 6331 and a second lifting rod 6332. The first lifting rod 6331 is coupled to the outer wall of the medicament storage box 61 via a hinge joint, and one end of the first lifting rod is connected with the floating portion 631. The first lifting rod 6331 rotates around its hinge joint on the outer wall of the medicament storage box 61. Two ends of the second lifting rod 6332 are respectively connected with the other end of the first lifting rod 6331 and the valve cap 632. The second lifting rod 6332 is configured to drive the valve cap 632 to open or close the medicament inlet end 620 when the first lifting rod 6331 rotates.

Specifically, as shown in FIG. 15, FIG. 16, FIG. 17, FIG. 18, and FIG. 19, when the water level in the water tank 1 is higher than the preset water level, the floating portion 631 is lifted by the water flow, and the second lifting rod 6332 is pressed down to abut against the valve cap 632 to close the medicament inlet end 620. When the water level in the water tank 1 drops, floating force acting on the floating portion 631 gradually decreases, so that the floating portion 631 drives the first lifting rod 6331 to rotate clockwise around the hinge joint, and the second lifting rod 6332 is also being driven, that is, in a rising trend. When the water level is lower than the preset water level, the second lifting rod 6332 drives the valve cap 632 to separate from the medicament inlet end 620 completely, and at this time, the medicament in the medicament storage box 61 enters the medicament channel 62. In addition, when water is refilled into the water tank 1, the water flow reaches the floating portion 631. After the floating portion 631 suffers from floating force, the first lifting rod 6331 rotates counterclockwise around the hinge joint, and the valve cap 632 and the second lifting rod 6332 are pushed down by the first lifting rod 6331 until the valve cap 632 closes the medicament inlet end.

Moreover, as shown in FIG. 15, FIG. 16, FIG. 17, FIG. 18, and FIG. 19, the medicament channel 62 includes a main pipe 621 and a limiter pipe 622. The main pipe 621 is connected with the suction pipe 43, and the medicament inlet end 620 is arranged on the main pipe 621. The limiter pipe 622 is connected with the medicament inlet end 620 and is configured to be abutted against by the valve cap when the valve cap 632 is pulled to its limiting position by the second lifting rod 6332. The limiter pipe 622 is provided with a water inlet area communicated with the medicament storage box 61. Therefore, when the water level in the water tank 1 is extremely low, the valve cap 632 will not be lifted by the second lifting rod 6332 without limit and will not be overturned to break away from its running track, so that the valve cap 632 can move in a limited area. When the water level in the water tank 1 rises and floating force is acted on the floating portion 631, the second lifting rod 6332 can drive the valve cap 632 to continuously close the medicament inlet end 620.

Further, as shown in FIG. 15, FIG. 16, FIG. 17, FIG. 18, and FIG. 19, the medicament dispensing mechanism 6 further includes a floating ball 67, which is movably arranged in the limiter pipe 622, located at the side of the valve cap 632 facing the medicament inlet end 620 and configured to block the medicament inlet end 620. Therefore, when the medicament in the medicament storage box 61 is completely discharged, the floating ball 67 falls down to seal the medicament inlet end 620, which avoids external air from being introduced into a waterway of the bowl rim water supply mechanism, especially in this embodiment, which thus prevents air from entering the water pump and ensures working efficiency of the water pump.

Moreover, as shown in FIG. 15, FIG. 16, FIG. 17, FIG. 18, and FIG. 19, the suction pipe 43 includes a suction port 430 extending into the water tank 1, wherein the diameter of the suction port 430 of the suction pipe 43 is smaller than the inner diameter of the suction pipe 43. A damper valve 68 is arranged in the main pipe 621. After the channel opening-closing valve opens the medicament inlet end 620, the bowl rim water supply power unit 42 works, and the suction pipe 43 sucks the water in the water tank 1. Since the diameter of the suction port 430 of the suction pipe 43 is smaller than the inner diameter of the suction pipe 43, a negative pressure will be generated in the suction pipe 43, which pulls a spring member 681 in the damper valve 68 to open the damper valve 68 and make the medicament channel 62 unobstructed. When the channel opening-closing valve closes the medicament inlet end 620, the damper valve 68 further blocks the medicament channel 62 to prevent the medicament from leaking from the medicament inlet end 620 into the suction pipe 43. Meanwhile, when the suction pipe 43 does not suck the water in the water tank 1, which means there is no need for the medicament to enter the toilet body 2 at this time, even if the water level in the water tank 1 is below the preset water level, and the medicament inlet end 620 is opened, there will be no negative pressure in the suction pipe 43 and the damper valve 68 will not be opened, and thus the medicament will not enter the suction pipe 43 and there is no waste.

Moreover, the medicament storage box 61 is further provided with an isolating element 64 therein, in the isolating element 64 is provided an isolation area 65 configured to place medicament items, and the isolating element 64 is provided with a plurality of leakage holes 640 communicated with the isolation area 65. Therefore, the water flow is allowed to enter the isolation area 65 through the leakage holes 640 to dissolve the drugs, and drifting of medicament items residues is avoided, which help to form a standard material distribution and avoid from affecting other components.

Further, as shown in FIG. 15, FIG. 16, FIG. 17, FIG. 18, and FIG. 19, a side wall of the medicament storage box 61 is provided with an opening for the water flow in the water tank 1 to enter the medicament storage box 61; and the medicament storage box 61 is provided with a door plate 69 configured to close the opening.

Specifically, as shown in FIG. 15, the upper end of the door plate 69 is coupled through a hinge joint to the side wall that is provided with the opening. The door plate 69 is configured to, when the opening is closed, abut against the periphery of the opening, and is inclined, from top to bottom, towards the inside of the medicament storage box 61. Two side baffles 691 extending into the water tank 1 are arranged along the lateral sides of the opening. The edge of the side baffle 691 departing from the opening is inclined, that is, the distance between the edge of the side baffle 691 and the bottom of the opening is greater than the distance between the edge of the side baffle 691 and the top of the opening. A supporting plate 692 extending into the water tank 1 is arranged at the bottom of the opening. The supporting plate 692 is connected with the two side baffles 691. When closing the opening, the door plate 69 abuts against the two side baffles 691 and the supporting plate 692. When the water in the water tank 1 reaches a certain amount, the door plate 69 can be pushed open, and the water flow can enter the medicament storage box 61 to dissolve the medicament items. When the water in the medicament storage box 61 reaches a certain amount, the door plate 69 is pushed to continue to close the opening. Therefore, water can automatically enter the medicament storage box 61.

A fourteenth embodiment of the present disclosure relates to a method for flushing a toilet, applicable to the toilet according to the thirteenth embodiment, which, as shown in FIG. 21, FIG. 6, and FIG. 23, specifically includes the following acts.

In act 110, a flushing instruction is received. In one embodiment, the flushing instruction may be electronically received from a user. For example, after the user has used the toilet, the user may send a flushing instruction to a controller (e.g. a main control module 100) of the toilet by pressing a button on the toilet or a button on a toilet remote. The button may convert the flushing instruction into a signal indicating that a flushing process should be performed. When the controller receives the signal, the controller may retrieve the flushing instruction from the signal and then perform the corresponding flushing instruction. The flushing instruction may contain the user's selection of flushing preference. For example, the user may select the water volume to be flushed into the toilet bowl, select whether a medicament for sterilizing the toilet bowl should be added into water, or select length of time for the flushing. A storage may store a plurality of predetermined user settings. The controller may retrieve a predetermined user setting corresponding to the flushing instruction sent by the user.

In another embodiment, the flushing instruction may be mechanically received from a user. For example, after the user has used the toilet, the user may send a flushing instruction by pressing a toilet flush lever on a toilet water tank. The toilet flush lever may be connected to a flushing mechanism as described in the present disclosure. Thus, the force applied to the toilet flush lever by the user may trigger the flushing mechanism to perform a flushing process.

In another embodiment, the flushing instruction may be generated automatically. For example, a sensor may be disposed in the toilet to determine whether the toilet has been used by a user. The sensor may be configured to detect whether the user is sitting on the toilet bidet or is moving from a sitting position to a standing position. When the sensor determines that the user is changing from a sitting position for a predetermined time period or is in a standing position, the sensor may automatically generate a flushing instruction and transmit the flushing instruction to the controller to perform a corresponding flushing process as described in the present disclosure. The sensor may also be configured to detect whether the water in the toilet bowl is clean or dirty. For example, the sensor may detect the color or odor of the water in the toilet bowl. When the sensor determines that the color or odor of the water in the toilet bowl exceeds a predetermined degree, the sensor may automatically generate a flushing instruction and transmit the flushing instruction to the controller to perform a corresponding flushing process as described in the present disclosure.

In act 120, the general water inlet assembly and the bowl rim water inlet valve 32 are opened to supply water to the bowl margin of the toilet body 2.

In act 130, the bowl rim water supply power unit 42 is opened, and the water flow in the water tank 1 of the toilet is pumped to supply water to the bowl rim of the toilet body 2. In actual operation, the bowl rim water supply power unit 42 may be opened after the general water inlet assembly and the bowl rim water inlet valve 32 are opened for a period of time. At this time, the water pumped from the water tank enters the bowl rim power outlet pipe 44 and is mixed with the previous water flow, so that the flushing force is increased, and the toilet body can be flushed more cleanly while saving the water flow.

In act 140, the bowl rim water inlet valve 32 and the bowl rim water supply power unit 42 are closed, and the jet hole water supply mechanism 5 is opened to discharge water to the jet hole 20 of the toilet body 2. In actual operation, act 140 may be performed after the bowl rim water supply power unit 42 is opened for a period of time, so that the dirt in the toilet body 2 can been completely flushed into the siphon pipe, and then the water is sprayed to the jet hole 20, thus the dirt can be carried and removed completely, and the water can be saved. Moreover, the jet hole water supply mechanism 5 may be opened after the bowl rim water inlet valve 32 and the bowl rim water supply power unit 42 are closed, or the three may be operated simultaneously. A plurality of various operation forms can be used, which will not be specifically described here.

Further, the act of opening the jet hole water supply mechanism 5 specifically includes opening the water tank discharge valve 54, the jet hole discharge power unit 55 and the jet hole water inlet valve 33. The sequence of opening the water tank discharge valve 54, the jet hole discharge power unit 55 and the jet hole water inlet valve 33 does not need to be specifically limited here.

Moreover, following the act of discharging water to the jet hole 20 of the toilet body 2 in act 130, the method further includes the following acts:

Act 150 is executed to close the jet hole discharge power unit 55 and the water inlet valve 33 of the jet after the water tank discharge valve 54 is opened for a preset length of time;

After the jet hole discharge power unit 55 and the jet hole water inlet valve 33 are closed, act 160 is executed to close the water tank discharge valve 54 and open the bowl rim water inlet valve 32 and the bowl rim water supply power unit 42, and suck the water flow in the water tank 1 to continuously supply water to the bowl margin of the toilet body 2; and Act 170, when a water level in the water tank 1 is lower than a preset water level, the medicament channel 62 of the medicament dispensing mechanism 6 is opened to communicate with the medicament storage box 61 to dispense medicament to the suction pipe of the bowl rim water supply mechanism.

Moreover, following the act of dispensing medicament to the suction pipe of the bowl rim water supply mechanism, the method further includes the following acts:

Act 180, the medicament inlet end 620 of the medicament channel 62 is closed;

Act 190, the bowl rim water inlet valve 32 and the bowl rim water supply power unit 42 are closed; and Act 111, the tank water inlet valve 34 is opened, and the tank water inlet valve 34 and the general water inlet assembly are closed after the water level in the water tank 1 reaches the upper limit.

It is not difficult to find that this embodiment is a system embodiment corresponding to the thirteenth embodiment, and this embodiment may be implemented in cooperation with the thirteenth embodiment. Relevant technical details mentioned in the thirteenth embodiment are still applicable in this embodiment, and thus will not be repeatedly described herein. Accordingly, related technical details mentioned in this embodiment may also be applied to the thirteenth embodiment. One or more acts as described above may be omitted or repeated when the method for flushing a toilet is performed. Also, after one circle of the flushing process is completed, one or more subsequent circles of the flushing process may be performed again. The subsequent circles of the flushing process may comprise the same or different acts in the preceding circle of the flushing process.

In a nutshell, the present disclosure relates to a sanitary apparatus and method, and discloses a toilet and a water supply mechanism for a bowl rim thereof. In the present disclosure, the water supply mechanism for the bowl rim of the toilet is configured to supply water to a bowl of a toilet body of the toilet for flushing, including: an inlet valve assembly communicated with a water source; a water-feeding power unit including a water inlet connected with the inlet valve assembly and a water outlet communicated with the water inlet of the water-feeding power unit; and an outlet pipe connected with the water outlet of the water-feeding power unit and communicated with a water channel at the bowl rim of the toilet body. Compared with the prior art, the toilet body is flushed under sufficient water pressure, so that the toilet body can be made cleaner.

The present disclosure also relates to a sanitary apparatus and method, and discloses a toilet and a water inlet mechanism thereof. In the present disclosure, the water inlet mechanism of the toilet includes a vacuum breaker including an inner cavity pipe provided with an upstream chamber, an outer cavity pipe arranged around the inner cavity pipe, and a chamber valve for allowing or blocking communication between the inner cavity pipe and the outer cavity pipe; the inner cavity pipe and the outer cavity pipe being separated from each other to form a downstream chamber, and the downstream chamber being configured to communicate with the upstream chamber when the chamber valve is opened; a general water inlet assembly connected with the inner cavity pipe and configured to allow or block communication between the upstream chamber and a water source; a bowl rim water inlet assembly connected with the outer cavity pipe, configured to allow or block communication between the downstream cavity and a toilet body of the toilet, and further configured to supply the water flow in the downstream cavity to the bowl of the toilet body when being opened; a tank water inlet assembly connected with the outer cavity pipe; and a jet water inlet assembly connected with the outer cavity pipe. Compared with the prior art, the water inlet mechanism is more integrated, the whole size of the toilet is decreased, and the cost of the toilet is reduced.

The present disclosure also relates to a sanitary apparatus and method, and discloses a toilet and a water supply mechanism thereof. In the present disclosure, the water supply mechanism of the toilet is configured to supply water to a jet hole arranged on a toilet body of the toilet, including: a water tank; a vacuum breaker arranged in the water tank; a discharge valve connected with the vacuum breaker; a discharge pipe connected with the discharge valve, including a gravity discharge channel and a power discharge channel which are both communicated with the discharge valve, and the gravity discharge channel and the power discharge channel are both configured to supply water flow in the water tank to the jet hole after the discharge valve is opened; and a discharge power unit communicated with the discharge valve and connected with the power discharge channel, and configured to pump water flow passing through the discharge valve into the power discharge channel. Compared with the prior art, a pipe structure of the water supply mechanism is simplified and the cost of the device is reduced.

The present disclosure also relates to a sanitary apparatus and method, and discloses a toilet and a jet structure thereof. In the present disclosure, the jet structure of the toilet includes: a ceramic wall arranged on a toilet body of the toilet and provided with an opening; a non-ceramic jet body passing through the opening; a connecting assembly configured to fix the non-ceramic jet body on the ceramic wall; a liquid delivery joint including a liquid output portion passing through the non-ceramic jet body and a plurality of liquid input portions communicated with the liquid output portion, wherein each of the liquid input portions is communicated with different water supply ends, and the liquid output portion is configured to spray water to a jet hole on the toilet body; and a locking assembly configured to fix the liquid delivery joint and the non-ceramic jet body together. Compared with the prior art, the jet structure can be connected with a plurality of water supply ends, and the toilet can be flushed and used stably and normally.

The present disclosure also relates to a sanitary apparatus and method, and discloses a toilet and a water supply mechanism for a jet hole thereof. According to the water supply mechanism for the jet hole of the toilet in the present disclosure, the toilet includes: a toilet body, and a water tank configured to store flushing water, including: a ceramic wall connected with the toilet body of the toilet, and the toilet body is provided with a jet hole. The ceramic wall is provided surrounding the periphery of the toilet body, and a water mixing cavity is formed in the surrounded region of the toilet body; a water tank discharge valve connected with the water tank; a gravity discharge channel connected with the downstream of the water tank discharge valve and connected to the water mixing cavity; an acceleration discharge channel connected with the downstream of the water tank discharge valve and connected to the water mixing cavity; a discharge power unit arranged on the acceleration discharge channel; and a water source discharge assembly communicated with an external water source and connected to the water mixing cavity to discharge the water flow in the external water source to the water mixing cavity. Compared with the prior art, the water flow with sufficient water pressure enters the jet hole and the cost is reduced.

The present disclosure also relates to a sanitary apparatus and method, and discloses a toilet and a medicament dispensing mechanism thereof. In the medicament dispensing mechanism of the toilet in the present disclosure, the toilet includes: a water tank, a toilet body, and a water supply mechanism for a bowl rim configured to supply water to the bowl of the toilet body. A suction pipe of the water supply mechanism for the bowl rim extends into the water tank to suck water in the water tank. The medicament dispensing mechanism includes: a medicament storage box configured to store medicament; a medicament channel communicated with the medicament storage box and connected with the suction pipe; and a channel opening-closing valve arranged in the water tank and configured to make the medicament channel communicate with the medicament storage box when a water level in the water tank is lower than a preset water level. Compared with the prior art, the medicament can be saved, and a service life of the medicament can be prolonged, thereby reducing the cost.

The present disclosure also relates to a sanitary apparatus and method, and discloses a toilet and a method for flushing the same. In the present disclosure, the toilet includes a toilet body and a water tank; the toilet further includes a main control module, a general water inlet mechanism, a bowl rim water supply mechanism and a jet hole water supply mechanism; the jet hole is arranged on the toilet body; the general water inlet mechanism includes a vacuum breaker, a general water inlet assembly, a bowl rim water inlet valve, a jet hole water inlet valve, and a tank water inlet valve; the bowl rim water supply mechanism includes a bowl rim connecting pipe, a bowl rim water supply power unit, a suction pipe, and a bowl rim power outlet pipe; and the main control module is electrically connected with the general water inlet assembly, the bowl rim water inlet valve, the jet hole water inlet valve, the tank water inlet valve and the bowl rim water supply power unit. Compared with the prior art, the water pressure is sufficient to make toilet be used normally, and the flushing of the toilet is cleaner.

The controller (e.g. the main control module 100) can be implemented by any appliances. The controller may include a processor, a memory, and a communication interface for interfacing with the devices as discussed in the present disclosure. The components of the controller may communicate using bus. The controller may be connected to a workstation or another external device (e.g., control panel, remote) and/or a database for receiving user inputs, system characteristics, and any of the values described herein. Optionally, the controller may include an input device and/or a sensing circuit in communication with any of the sensors. The sensing circuit receives sensor measurements from as described above. Optionally, the controller may include a drive unit for receiving and reading non-transitory computer media having instructions. Additional, different, or fewer components may be included. The processor is configured to perform instructions stored in memory for executing the algorithms described herein.

Processor may be a general purpose or specific purpose processor, an application specific integrated circuit (ASIC), one or more programmable logic controllers (PLCs), one or more field programmable gate arrays (FPGAs), a group of processing components, or other suitable processing components. Processor is configured to execute computer code or instructions stored in memory or received from other computer readable media (e.g., embedded flash memory, local hard disk storage, local ROM, network storage, a remote server, etc.). The processor may be a single device or combinations of devices, such as associated with a network, distributed processing, or cloud computing.

Memory may include one or more devices (e.g., memory units, memory devices, storage devices, etc.) for storing data and/or computer code for completing and/or facilitating the various processes described in the present disclosure. Memory may include random access memory (RAM), read-only memory (ROM), hard drive storage, temporary storage, non-volatile memory, flash memory, optical memory, or any other suitable memory for storing software objects and/or computer instructions. Memory may include database components, object code components, script components, or any other type of information structure for supporting the various activities and information structures described in the present disclosure. Memory may be communicably connected to processor via a processing circuit and may include computer code for executing (e.g., by processor) one or more processes described herein. For example, memory may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface may include any operable connection. An operable connection may be one in which signals, physical communications, and/or logical communications may be sent and/or received. An operable connection may include a physical interface, an electrical interface, and/or a data interface. The communication interface may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

Those of ordinary skills in the art can understand that the above embodiments are specific embodiments for implementing the present disclosure, and in practical applications, various changes in form or detail can be made without departing from the spirit and scope of the present disclosure.

I claim:

1. A water supply mechanism for a bowl rim of a toilet, the mechanism configured to supply water to a bowl of a toilet body of the toilet for flushing, the mechanism comprising:

an inlet valve assembly in fluid communication with a water source;

a water-feeding power unit comprising a water inlet connected with the inlet valve assembly and a water outlet in fluid communication with the water inlet of the water-feeding power unit; and an outlet pipe connected with the water outlet of the water-feeding power unit and the outlet pipe in fluid communication with a water channel at the bowl rim of the toilet body.

2. The water supply mechanism for the bowl rim of the toilet according to claim 1, wherein the inlet valve assembly comprises:

a valve body comprising a water inlet end in fluid communication with the water source and a water outlet end in fluid communication with the water inlet end of the valve body; and a connecting portion connecting the water outlet end of the valve body and the water inlet of the water-feeding power unit.

3. The water supply mechanism for the bowl rim of the toilet according to claim 2, wherein the toilet comprises: a water tank in fluid communication with the water source and configured to store flushing water, and wherein the water supply mechanism for the bowl rim further comprises: a suction pipe connected with the connecting portion and at least partially extending into the water tank and the suction pipe is configured to suck waterflow in the water tank when the water-feeding power unit is opened.

4. The water supply mechanism for the bowl rim of the toilet according to claim 3, wherein the water supply mechanism for the bowl rim further comprises: a one-way valve arranged on the suction pipe and configured to prevent the waterflow from entering the water tank via the suction pipe.

5. The water supply mechanism for the bowl rim of the toilet according to claim 3, wherein the water supply mechanism for the bowl rim further comprises: a flow limiter arranged at the water inlet end of the valve body.

6. The water supply mechanism for the bowl rim of the toilet according to claim 3, wherein the suction pipe comprises: a suction port extending into the water tank for sucking the water, and wherein a diameter of the suction port of the suction pipe is smaller than an inner diameter of the suction pipe.

7. The water supply mechanism for the bowl rim of the toilet according to claim 1, wherein the water supply mechanism for the bowl rim further comprises:

a main control module electrically connected with the water-feeding power unit and the inlet valve assembly and configured to control the water-feeding power unit and the inlet valve assembly to be opened or closed.

8. The water supply mechanism for the bowl rim of the toilet according to claim 7, wherein the water supply mechanism for the bowl rim further comprises: a power module electrically connected with the main control module and configured to supply power to the inlet valve assembly.

9. A water inlet mechanism of a toilet, the mechanism comprising:

a vacuum breaker, comprising:

an inner cavity pipe including an upstream chamber;

an outer cavity pipe arranged around the inner cavity pipe; and a chamber valve configured to allow or block communication between the inner cavity pipe and the outer cavity pipe, the inner cavity pipe and the outer cavity pipe being separated from each other to form a downstream chamber configured to communicate with the upstream chamber when the chamber valve is opened;

a general water inlet assembly connected with the inner cavity pipe and configured to allow or block communication between the upstream chamber and a water source;

a bowl rim water inlet assembly connected with the outer cavity pipe, configured to allow or block communication between the downstream chamber and a toilet body of the toilet, and further configured to supply waterflow in the downstream chamber to the bowl of the toilet body when being opened;

a tank water inlet assembly connected with the outer cavity pipe, configured to allow or block communication between the downstream chamber and a water tank of the toilet, and further configured to supply the waterflow in the downstream chamber to the water tank when being opened; and a jet water inlet assembly connected with the outer cavity pipe, configured to allow or block communication between the downstream chamber and the toilet body of the toilet, and further configured to supply the waterflow in the downstream chamber to a jet hole of the toilet body when being opened.

10. The water inlet mechanism of the toilet according to claim 9, wherein the inner cavity pipe comprises, from bottom to top, a liquid inlet abutting against the general water inlet assembly and a liquid outlet arranged opposite to the liquid inlet, wherein both the liquid inlet of the inner cavity pipe and the liquid outlet of the inner cavity pipe are in fluid communication with the upstream chamber; and the chamber valve is arranged at the liquid outlet of the inner cavity pipe.

11. The water inlet mechanism of the toilet according to claim 10, wherein a bracket for installing the vacuum breaker is arranged in the toilet, and wherein the vacuum breaker comprises:

an upper valve body partially penetrating through the bracket, wherein the liquid outlet is arranged on the upper valve body and the upper valve body comprises a part of the inner cavity pipe and a part of the outer cavity pipe;

a connecting assembly configured to fix the upper valve body on the bracket;

a lower valve body being in butt joint with the upper valve body, wherein the liquid inlet is arranged on the lower valve body and the lower valve body comprises another part of the inner cavity pipe and another part of the outer cavity pipe; and a locking assembly configured to fix the upper valve body and the lower valve body to one another.

12. The water inlet mechanism of the toilet according to claim 11, wherein the outer cavity pipe of the upper valve body includes an abutting portion abutting against a side of the bracket facing the liquid outlet, wherein the side of the outer cavity pipe of the upper valve body facing the liquid inlet includes an external thread, and wherein the connecting assembly comprises a nut engaged with the external thread and configured to fix the upper valve body on the bracket in coordination with the abutting portion.

13. The water inlet mechanism of the toilet according to claim 12, wherein the connecting assembly further comprises:

a first sealing element sleeved on the outer cavity pipe of the upper valve body and arranged between the abutting portion and the bracket; and a second sealing element sleeved on the outer cavity pipe of the upper valve body and arranged between the nut and the bracket.

14. The water inlet mechanism of the toilet according to claim 12, wherein the locking assembly comprises:

a union nut that can be engaged with the external thread and configured to fix the outer cavity pipe of the upper valve body to the outer cavity pipe of the lower valve body.

15. The water inlet mechanism of the toilet according to claim 14, wherein the outer cavity pipe of the lower valve body comprises an insertion portion inserted into the downstream chamber of the upper valve body, and the insertion portion abuts against an inner wall of the outer cavity pipe of the upper valve body, wherein the inner cavity pipe of the lower valve body abuts against the inner cavity pipe of the upper valve body, and wherein the locking assembly further comprises:

at least one sealing ring sleeved on the insertion portion and abutting against the inner wall of the outer cavity pipe of the upper valve body; and a sealing gasket arranged at the position where the inner cavity pipe of the lower valve body abuts against the inner cavity pipe of the upper valve body.

16. The water inlet mechanism of the toilet according to claim 10, wherein the general water inlet assembly comprises:

a general water inlet valve connected with the liquid inlet.

17. The water inlet mechanism of the toilet according to claim 16, wherein the general water inlet assembly further comprises:

a filtering module connected with the general water inlet valve and in fluid communication with the water source.

18. The water inlet mechanism of the toilet according to claim 11, wherein a bowl rim opening is arranged on the outer cavity pipe of the upper valve body, and wherein the bowl rim water inlet assembly comprises:

a bowl rim pipe leading to the bowl of the toilet body; and a bowl rim valve connected with the bowl rim pipe and the bowl rim opening.

19. The water inlet mechanism of the toilet according to claim 11, wherein a tank opening is arranged on the outer cavity pipe of the upper valve body; and the tank water inlet assembly comprises a tank valve connected with the tank opening so as to supply water to the water tank.

20. The water inlet mechanism of the toilet according to claim 11, wherein a jet opening is arranged on the outer cavity pipe of the lower valve body, and wherein the jet water inlet assembly comprises:

a jet pipe leading to the jet hole; and a jet valve connected with the jet pipe and the jet opening.

* * * * *